US012297603B2

(12) United States Patent
Zheng et al.

(10) Patent No.: US 12,297,603 B2
(45) Date of Patent: May 13, 2025

(54) WET BLANK FLIPPING METHOD FOR MANUFACTURING MOLDED PULP PRODUCTS AND PULP MOLDING MACHINE

(71) Applicants: ZHEJIANG EURASIA UNITED EQUIPMENT GROUP CO., LTD., Zhejiang (CN); Tianbo Zheng, Zhejiang (CN)

(72) Inventors: Tianbo Zheng, Zhejiang (CN); Zhuo Zheng, Zhejiang (CN)

(73) Assignees: ZHEJIANG EURASIA UNITED EQUIPMENT GROUP CO., LTD., Hangzhou (CN); Tianbo Zheng, Hangzhou (CN)

( * ) Notice: Subject to any disclaimer, the term of this patent is extended or adjusted under 35 U.S.C. 154(b) by 0 days.

(21) Appl. No.: 18/901,412

(22) Filed: Sep. 30, 2024

(65) Prior Publication Data

US 2025/0019906 A1 Jan. 16, 2025

Related U.S. Application Data

(63) Continuation of application No. PCT/CN2022/103261, filed on Jul. 1, 2022.

(30) Foreign Application Priority Data

Dec. 10, 2021 (CN) ..... 202111510195.0

(51) Int. Cl.
*D21J 3/12* (2006.01)
*D21J 5/00* (2006.01)

(52) U.S. Cl.
CPC .. *D21J 3/12* (2013.01); *D21J 5/00* (2013.01)

(58) Field of Classification Search
CPC ..... D21J 3/12; D21J 5/00
See application file for complete search history.

(56) References Cited

U.S. PATENT DOCUMENTS

2015/0292154 A1* 10/2015 Zheng ..... D21F 7/006 162/253
2021/0047784 A1* 2/2021 Kuo ..... A24F 40/42
2024/0200278 A1* 6/2024 Halletz ..... D21J 5/00

FOREIGN PATENT DOCUMENTS

CN 206142441 U 5/2017
CN 108265569 A 7/2018
(Continued)

OTHER PUBLICATIONS

Notice of Allowance of counterpart Chinese Patent Application No. 202111510195.0 issued on Jun. 10, 2024.
(Continued)

*Primary Examiner* — Jacob T Minskey
*Assistant Examiner* — Elisa H Vera

(57) ABSTRACT

A wet blank flipping method for manufacturing pulp molded products, which follows these steps: after the wet blank is formed in the suction filtration forming mold, it is transferred to the hot-pressing shaping device for hot-press drying and shaping to create pulp molded products, characterized in that: said transfer is done using a first wet blank transfer device and a second wet blank transfer device to move the wet blank from the suction filtration forming mold to the hot-pressing shaping device; wherein, the first wet blank transfer device extracts the wet blank from the suction filtration forming mold and transfers it to the second wet blank transfer device, which then moves the wet blank to the hot-pressing shaping device.

16 Claims, 32 Drawing Sheets

(56) References Cited

FOREIGN PATENT DOCUMENTS

| | | | | | |
|---|---|---|---|---|---|
| CN | 110578274 | A | | 12/2019 | |
| CN | 114059393 | A | | 2/2022 | |
| CN | 114059394 | A | | 2/2022 | |
| CN | 218540229 | U | | 2/2023 | |
| CN | 218540230 | U | | 2/2023 | |
| CN | 218540231 | U | | 2/2023 | |
| EP | 3904598 | A1 | * | 11/2021 | ..... D21J 3/00 |
| WO | 2021063361 | A1 | | 4/2021 | |

OTHER PUBLICATIONS

2nd Office Action of counterpart Chinese Patent Application No. 202111510195.0 issued on Apr. 26, 2024.
1st Search report of counterpart Chinese Patent Application No. 202111510195.0 issued on Nov. 21, 2023.

* cited by examiner

C–C

C-C

D-D

E–E

WET BLANK FLIPPING METHOD FOR MANUFACTURING MOLDED PULP PRODUCTS AND PULP MOLDING MACHINE

CROSS REFERENCE TO RELATED APPLICATIONS

The present application is a Continuation application of PCT Application No. PCT/CN2022/103261 filed on Jul. 1, 2022, which claims the benefit of Chinese Patent Application No. 202111510195.0 filed on Dec. 10, 2021. All the above are hereby incorporated by reference in their entirety.

TECHNICAL FIELD

This disclosure relates to a method and apparatus for manufacturing products including paper pulp from plant fibers (referred to as pulp; the same below) using a molding process. It is suitable for manufacturing disposable plant fiber molded products, especially suitable for manufacturing disposable non-flat paper products, such as pulp molded delicate packaging products, plant fiber (pulp) molded tableware, plant fiber (pulp) molded trays, plant fiber (pulp) molded industrial shock-absorbing pads, packaging boxes and packaging trays, disposable non-flat plant fiber (pulp) molded decorative three-dimensional wall panels (also known as plant fiber three-dimensional wallpaper or pulp molded three-dimensional wallpaper), and all disposable plant fiber (pulp) molded products. The fully automatic plant fiber molding machine includes a fully automatic pulp molding machine.

BACKGROUND TECHNOLOGY

The manufacturing process of plant fiber molded products is as follows: plant fibers first undergo suction filtration forming in the suction filtration forming device to create a wet blank of the product. The wet blank is then sent into the hot-press mold of the hot-pressing shaping device, where the hot-press mold closes and performs hot-pressing drying and shaping to create plant fiber molded products of various shapes. When moving the wet blank from the suction filtration mold to the hot-press mold, the wet blank's movement is always translational, meaning that from its formation in the suction filtration mold to its insertion into the hot-press mold of the hot-pressing shaping device, the orientation of the wet blank does not change.

The hot-press mold is divided into an upper hot-press mold and a lower hot-press mold. For ventilation purposes, the surface of either the upper or lower hot-press mold is covered with a metal wire mesh (generally stainless steel wire mesh). Therefore, when the upper and lower hot-press molds close, either the upper or lower mold surface will always be covered with a metal wire mesh, called the "mesh surface of the hot-press mold", while the other surface without metal wire mesh is called the "smooth surface of the hot-press mold". Due to the convenience of installing the metal wire mesh on the lower hot-press mold and the case of vacuum suction for steam on the lower hot-press mold, the metal wire mesh is generally placed on the lower hot-press mold. The "mesh surface of the hot-press mold" is usually on the lower mold.

The surface of plant fiber molded products is thus formed by the "mesh surface of the hot-press mold" and the "smooth surface of the hot-press mold". Therefore, the produced plant fiber molded products have a mesh pattern on the side that contacts the "mesh surface of the hot-press mold", while the other side is without a mesh pattern. These are respectively called the "mesh surface of the product" and the "smooth surface of the product". If the "mesh surface of the hot-press mold" is on the lower mold, then the produced products will have the "mesh surface of the product" facing down and the "smooth surface of the product" facing up.

Wet blanks are all formed by vacuum suction on suction filtration forming molds covered with one or more layers of wire mesh (generally stainless steel wire mesh). During suction filtration forming, the side in contact with the suction filtration mesh is called the "mesh surface of the wet blank". As the thickness of the wet blank increases during the suction filtration forming process, the suction force on the pulp gradually decreases, causing the material of the wet blank to become looser and develop an irregular surface with peaks and valleys. Therefore, the side away from the suction filtration mesh (the back of the "mesh surface of the wet blank") is called the "fuzzy surface of the wet blank".

Usually, the working surface of the suction filtration forming mold with stainless steel wire mesh as the suction filtration mesh faces upward in the pulp tank for pulp suction. Therefore, the "mesh surface of the wet blank" is on the bottom of the wet blank (the mesh surface of the wet blank faces down), and the "fuzzy surface of the wet blank" faces up. Even with a flipping suction filtration mold, where the mold face is down in the pulp tank during pulp suction, after suction is complete, the mold face is flipped upward before transferring the wet blank. So the produced wet blank also has the "mesh surface of the wet blank" facing down and the "fuzzy surface of the wet blank" facing up.

Because the movement of the wet blank is always translational, when the wet blank is lifted from the suction filtration forming mold and transferred to the hot-press mold for hot-pressing shaping, the result is that the "fuzzy surface of the wet blank" corresponds to the "smooth surface of the product", and the "mesh surface of the wet blank" corresponds to the "mesh surface of the product".

Until now, the "smooth surface of the product" in plant fiber molded products has not been smooth, and the "non-smoothness of the product's smooth surface" has become a worldwide problem in the production of plant fiber molded products. The main reason for the "smooth surface of the product" not being "smooth" is that the "fuzzy surface of the wet blank" has wrinkles and is loose. The "smooth surface of the hot-press mold" has difficulty in pressing the "fuzzy surface of the wet blank" smooth.

To overcome this problem, the common existing method is to increase the clamping force of the hot-press mold and adjust the mold gap based on the surface effect of the product. Where it cannot be pressed smooth, the mold gap is reduced in that area. As a result, even when the clamping force of the hot-press mold is increased significantly, causing some parts of the product to be pressed until they turn black while other parts still cannot be pressed "smooth", there is no significant change in the surface quality of the product. Moreover, what's more troublesome is: (1) Adjusting the mold gap based on the surface effect of the product is highly arbitrary, often leading to a situation where fixing one problem creates another, making it difficult to achieve the goal; (2) The cost of adjusting the mold gap is very high. To adjust the mold gap, the machine must be stopped, the mold removed and re-processed. The mold, which is around 200° C., needs to be cooled to room temperature, which takes a long time, resulting in significant heat loss, excessive time consumption, and low efficiency.

Therefore, it is necessary to invent a method to solve the problem of the hot-press mold's difficulty in pressing the product surface smooth during hot-press drying and shaping.

Additionally, in the manufacturing process of plant fiber molded products, if a concave mold is used for pulp suction, the bottom wall of the formed wet blank is thicker than the top, and the deeper the product, the more uneven the wall thickness of the wet blank. The wet blank is easily cracked during pressing, resulting in final products with very uneven wall thickness and prone to forming defective products with cracks. If a convex mold is used for pulp suction, it can make the wall thickness of the wet blank uniform for deep products, but when the wet blank is moved into the hot-pressing shaping device, the lower hot-press mold must also correspond to the convex mold. When producing deeper products, if the lower hot-press mold is convex, it becomes difficult to demold the product.

In this industry, achieving both uniform wall thickness and easy demolding is a dilemma. Therefore, it is also necessary to invent a method to solve this problem.

SUMMARY OF THE DISCLOSURE

The purpose of this disclosure is to overcome the shortcomings of the above background technology and provide a wet blank flipping method for manufacturing pulp molded products and a wet blank flipping pulp molding machine. This is to achieve the ideal effect of uniform product wall thickness, easy demolding, and products that are less prone to cracking, thereby improving product quality and machine operational stability.

After years of research and practice, the inventor discovered that during hot-press shaping, the "mesh surface of the wet blank" is easily pressed smooth by the "smooth surface of the hot-press mold", resulting in a very smooth "smooth surface of the product". Meanwhile, the "fuzzy surface of the wet blank" is easily imprinted with a mesh pattern by the "mesh surface of the hot-press mold", creating a beautiful "mesh surface of the product".

This is because during the suction filtration forming process, the "mesh surface of the wet blank" forms first. As it directly contacts the suction filtration mesh, there is no fiber resistance, resulting in a stronger vacuum suction force on the pulp and fibers. Therefore, the "mesh surface of the wet blank" is dense and smooth. As the wet blank thickens during suction filtration forming, the suction force on the pulp and fibers decreases, causing the material to become looser and develop an irregular surface with peaks and valleys. As a result, the "fuzzy surface of the wet blank" has a loose texture and wrinkled surface.

The technical solution provided by this disclosure is:

A wet blank flipping method for manufacturing pulp molded products, which follows these steps:

After the wet blank is formed in the suction filtration forming mold, it is transferred to the hot-pressing shaping device for hot-press drying and shaping to create pulp molded products. The key feature is: the transfer is done using a first wet blank transfer device and a second wet blank transfer device to move the wet blank from the suction filtration forming mold to the hot-pressing shaping device. The first wet blank transfer device extracts the wet blank from the suction filtration forming mold and transfers it to the second wet blank transfer device, which then moves the wet blank to the hot-pressing shaping device.

There can be one or multiple hot-pressing shaping devices, where multiple devices include a left hot-pressing shaping device and a right hot-pressing shaping device.

The first wet blank transfer mold of the first wet blank transfer device transfers the wet blank extracted from the suction filtration forming mold to the second wet blank transfer mold of the second wet blank transfer device. The second wet blank transfer mold then flips the wet blank 180 degrees vertically before transferring it to the hot-pressing shaping device. Alternatively, the first wet blank transfer mold extracts the wet blank from the suction filtration forming mold, flips it 180 degrees vertically first, then transfers the flipped wet blank to the second wet blank transfer mold, which then transfers the received wet blank to the hot-pressing shaping device.

The second wet blank transfer mold can move horizontally along the left-right translation rail to transfer the wet blank above the lower hot-press mold. The vertically movable lower hot-press mold then extracts the wet blank from the second wet blank transfer mold.

There can be one or multiple lower hot-press molds, where multiple molds include a left lower hot-press mold and a right lower hot-press mold.

The first wet blank transfer mold transfers the wet blank to the second wet blank transfer mold, and the second wet blank transfer mold transfers the flipped wet blank to the lower hot-press mold. Both of these actions are completed directly below the first wet blank transfer mold.

The lower hot-press mold of the hot-pressing shaping device can move along the left-right translation rail to a position directly below the first wet blank transfer mold to receive the flipped wet blank from the second wet blank transfer mold. The second wet blank transfer mold moves below the first wet blank transfer mold to receive the wet blank transferred from the first wet blank transfer mold, then either moves out from under the first wet blank transfer mold with the wet blank or directly flips 180 degrees vertically while under the first wet blank transfer mold. It then transfers the flipped wet blank into the lower hot-press mold, which has moved along the left-right translation rail to a position directly below the first wet blank transfer mold. The lower hot-press mold, now containing the flipped wet blank, moves back along the left-right translation rail to a position directly below the upper hot-press mold, thus achieving the flipping of the wet blank and its transfer to the hot-pressing shaping device.

There can be one or multiple lower hot-press molds, where multiple molds include a left lower hot-press mold and a right lower hot-press mold. There can also be one or multiple upper hot-press molds, where multiple molds include a left upper hot-press mold and a right upper hot-press mold.

In the hot-pressing shaping device, the lower hot-press mold is fixed while the upper hot-press mold can move vertically. The first wet blank transfer mold of the first wet blank transfer device can move vertically to extract the wet blank from the suction filtration forming mold. Alternatively, the first wet blank transfer mold can be fixed while the suction filtration forming mold moves vertically, transferring the wet blank to the first wet blank transfer mold as it moves upward. The second wet blank transfer mold, driven by a multi-degree-of-freedom robotic arm or mechanical arm, can flip vertically, move in three dimensions, or rotate to directly transfer the wet blank received from the first wet blank transfer mold to the lower hot-press mold, which always remains below the upper hot-press mold, after flipping it vertically.

There can be one or multiple lower hot-press molds, where multiple molds include a left lower hot-press mold and a right lower hot-press mold. There can also be one or multiple upper hot-press molds, where multiple molds include a left upper hot-press mold and a right upper hot-press mold.

The first wet blank transfer mold or second wet blank transfer mold that performs the 180-degree vertical flip rotates around an axis.

The wet blank flipping pulp molding machine includes a frame, a suction filtration forming device, at least one hot-pressing shaping device, and also includes a first wet blank transfer device and a second wet blank transfer device. The first wet blank transfer device contains a first wet blank transfer mold that extracts the wet blank from the suction filtration forming mold. The second wet blank transfer device contains a second wet blank transfer mold that receives the wet blank from the first wet blank transfer mold and transfers it to the hot-pressing shaping device.

The first wet blank transfer device contains a first wet blank transfer mold that can move vertically and extract the wet blank from the suction filtration forming mold. The second wet blank transfer device contains a second wet blank transfer mold that can perform a 180-degree vertical flip and move horizontally along the left-right translation rail to receive the wet blank transferred from the first wet blank transfer mold, then flip the wet blank 180 degrees vertically before transferring it above the lower hot-press mold. The vertically movable lower hot-press mold extracts the flipped wet blank from the second wet blank transfer mold.

The first wet blank transfer device contains a first wet blank transfer mold that can both move vertically and flip 180 degrees vertically to extract the wet blank from the suction filtration forming mold, flip it 180 degrees vertically, and then transfer it to the second wet blank transfer mold. The second wet blank transfer device contains a second wet blank transfer mold that can move horizontally along the left-right translation rail fixed to the underside of the upper frame, to receive the flipped wet blank from the first wet blank transfer mold and transfer it above the lower hot-press mold. The vertically movable lower hot-press mold receives the flipped wet blank from the first wet blank transfer mold.

The second wet blank transfer device contains a second wet blank transfer mold that can receive the wet blank directly below the first wet blank transfer mold, flip it 180 degrees vertically, and transfer the flipped wet blank to the lower hot-press mold while still directly below the first wet blank transfer mold. This achieves the goal of receiving the wet blank from the first wet blank transfer mold, flipping it, and transferring it to the hot-pressing shaping device. The 180-degree vertical flip of the wet blank can be performed either directly below the first wet blank transfer mold or after moving out from under it.

The hot-pressing shaping device contains a lower hot-press mold that can move along the left-right translation rail between positions directly below the upper hot-press mold and directly below the first wet blank transfer mold. It receives the 180-degree flipped wet blank transferred from the second wet blank transfer mold, then returns along the left-right translation rail to a position directly below the upper hot-press mold to perform hot-press clamping with the upper hot-press mold, drying and shaping the wet blank.

There can be one or multiple lower hot-press molds, where multiple molds include a left lower hot-press mold and a right lower hot-press mold. There can also be one or multiple upper hot-press molds, where multiple molds include a left upper hot-press mold and a right upper hot-press mold.

In the hot-pressing shaping device, the lower hot-press mold is fixed while the upper hot-press mold can move vertically. The first wet blank transfer device contains a first wet blank transfer mold that can move vertically to extract the wet blank from the suction filtration forming mold. Alternatively, the first wet blank transfer device contains a fixed first wet blank transfer mold, while the suction filtration forming device contains a vertically movable suction filtration forming mold that moves upward to transfer the wet blank to the first wet blank transfer mold. The second wet blank transfer device contains a second wet blank transfer mold driven by a multi-degree-of-freedom robotic arm or mechanical arm. This second wet blank transfer mold can flip vertically, move in three dimensions, or rotate. Driven by the multi-degree-of-freedom robotic arm or mechanical arm, the second wet blank transfer mold extracts the wet blank from the first wet blank transfer mold, flips it, and directly transfers it to the lower hot-press mold.

The horizontal movement of the second wet blank transfer device along the left-right translation rail is driven by the horizontal driver of the second wet blank transfer device. This horizontal driver uses a gear and rack drive structure, consisting of a rack fixed to the frame and a gear power head fixed to the second wet blank transfer device. The gear power head contains a gear and a servo motor that drives the gear's rotation. The gear of the gear power head meshes with the rack, and the servo motor drives the gear's rotation, thus moving the second wet blank transfer device horizontally left and right. Alternatively, the horizontal movement of the second wet blank transfer device can be driven by a linear motor, with its moving part fixed to the second wet blank transfer device and its stationary part fixed to the frame. Another alternative is to use a ball screw mechanism to drive the horizontal movement of the second wet blank transfer device.

The second wet blank transfer mold can flip 180 degrees vertically, move horizontally along the longitudinal rail, and move up and down along the vertical rail. This allows it to go under the first wet blank transfer mold to receive the wet blank, then flip it 180 degrees vertically before transferring it to the lower hot-press mold, which has moved horizontally along the left-right translation rail to a position below the first wet blank transfer mold. Alternatively, the second wet blank transfer mold can be driven by a multi-degree-of-freedom robotic arm or mechanical arm to move and flip 180 degrees vertically, allowing it to receive the wet blank from below the first wet blank transfer mold, flip it 180 degrees vertically, and then transfer it to the lower hot-press mold that has moved along the left-right translation rail to a position below the first wet blank transfer mold.

The working principle of this disclosure is: After forming the wet blank in the suction filtration forming device, it is first removed from the suction filtration forming mold, then flipped 180 degrees, and the flipped wet blank is sent to the hot-pressing shaping device for hot-press drying and shaping. This allows the "smooth surface of the hot-press mold" to press against the dense, smooth, and high-quality "mesh surface of the wet blank", while the "mesh surface of the hot-press mold", which has some flexibility and can easily press against the entire surface of the wet blank, presses against the "fuzzy surface of the wet blank".

The implementation of this method is only effective when the wet blank is flipped after leaving the suction filtration forming mold.

The beneficial effects of this disclosure are: After the wet blank leaves the suction filtration forming mold, it is flipped 180 degrees vertically before being sent to the hot-pressing shaping device for hot-press drying and shaping. The "smooth surface of the hot-press mold" presses against the dense, smooth, and high-quality "mesh surface of the wet blank", while the "mesh surface of the hot-press mold", which has some flexibility and can easily press against the entire surface of the wet blank, presses against the "fuzzy surface of the wet blank". The smooth surface of the hot-press mold can press the product very smooth, while the fuzzy surface of the wet blank is easily imprinted with a dense mesh pattern by the mesh surface of the hot-press mold. As a result, both sides of the product achieve excellent processing effects, reducing the production difficulty of pulp molded products, especially high-quality, delicate industrial packaging products. The quality of the products is greatly improved, the pass rate is significantly increased, and production costs can be substantially reduced.

Removing the wet blank from the suction filtration forming mold, then flipping it 180 degrees vertically, and sending the flipped wet blank to the hot-pressing shaping device for hot-press drying and shaping also achieves the beneficial effect of allowing the suction filtration forming mold to use a convex mold for pulp suction, while the hot-pressing shaping device uses a concave mold for the lower hot-press mold. In a dipping-type suction filtration forming machine, using a convex mold for pulp suction can make the wall thickness of the wet blank uniform for deep products, while the concave mold in the hot-pressing shaping device as the lower hot-press mold makes it easy to demold deep products. This achieves the ideal processing effect of uniform product wall thickness, easy demolding, and products that are less prone to cracking, greatly improving product quality and machine operational stability.

REFERENCE NUMERALS

Figure 1:
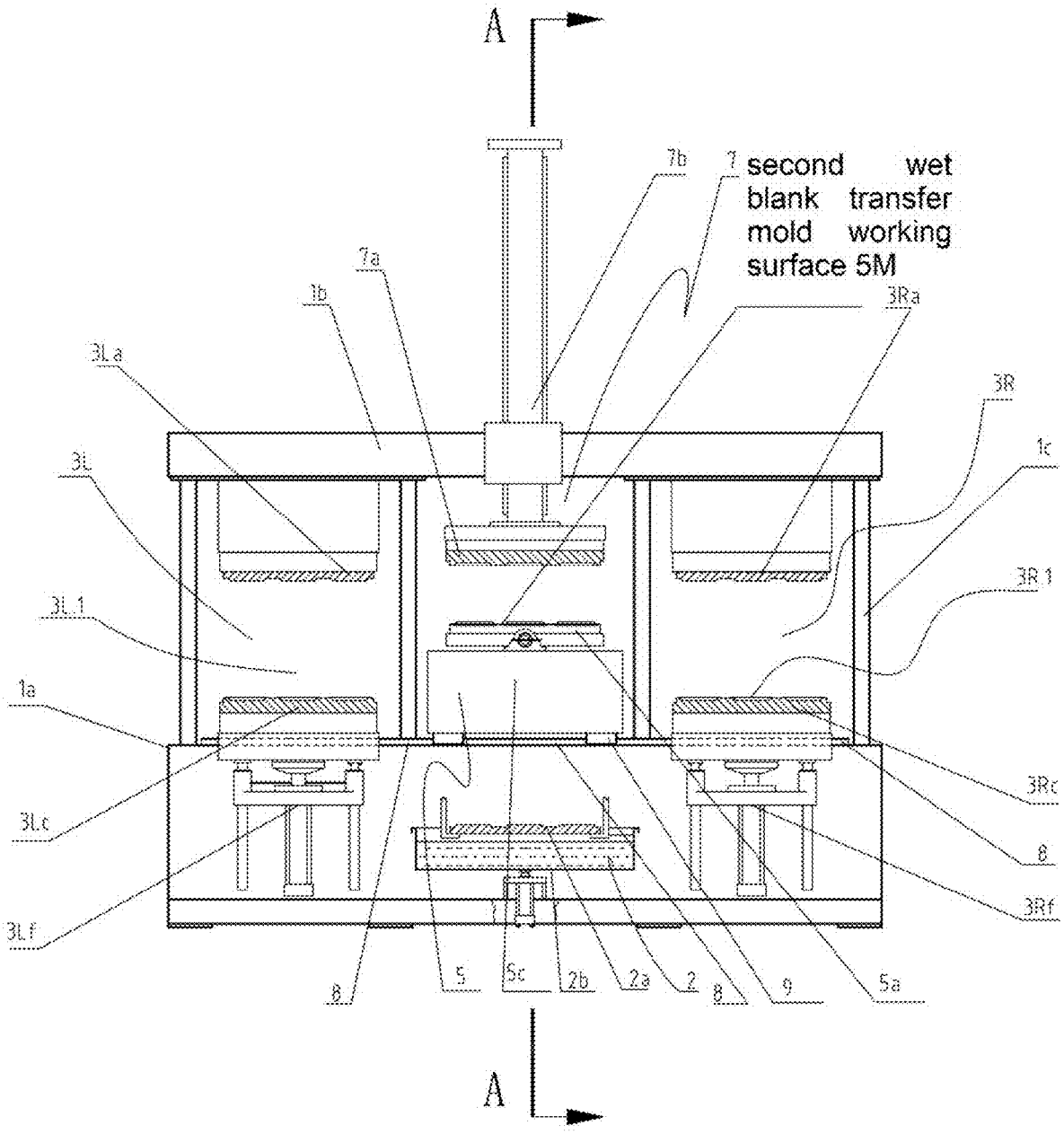
FIG. 1 is a front view structural diagram of Embodiment 1 of the "Wet Blank Flipping Pulp Molding Machine" with the left-right translation rail 8 fixed to the lower frame (showing the state when the second wet blank transfer device 5 has moved under the first wet blank transfer mold 7*a*, with the working surface 5M of the second wet blank transfer mold facing up).

1—frame; 1*a*—lower frame; 1*b*—upper frame; 1*c*—tie rod; 2—suction filtration forming device; 2*a*—suction filtration forming mold; 2*b*—suction filtration forming pulp tank; 3—hot-pressing shaping device (hot-press clamping device); 3L—left hot-pressing shaping device (left hot-press clamping device); 3R—right hot-pressing shaping device (right hot-press clamping device); 3.1—hot-pressing station; 3L.1—left hot-pressing station; 3R.1—right hot-pressing station; 3*a*—upper hot-press mold; 3La—left upper hot-press mold; 3Ra—right upper hot-press mold; 3*b*—upper hot-press mold driving device; 3Lb—left upper hot-press mold driving device; 3Rb—right upper hot-press mold driving device; 3*f*—lower hot-press mold driving device; 3Lf—left lower hot-press mold driving device; 3Rf—right lower hot-press mold driving device; 3*c*—lower hot-press mold; 3Lc—left lower hot-press mold; 3Rc—right lower hot-press mold; 5—second wet blank transfer device; 5.1—second wet blank flipping shaft; 5*a*—second wet blank transfer mold; 5*b*—wet blank flipping driver; 5*c*—second wet blank transfer device moving frame; 4—longitudinal rail; 4*a*—longitudinal rail slider; 4.1—vertical rail; 5M—second wet blank transfer mold working surface; 6—horizontal driver of second wet blank transfer device; 6*a*—gear power head; 6*b*—rack; 7—first wet blank transfer device; 7.1—first wet blank flipping shaft; 7.1*a*—first flipping shaft driver; 7*a*—first wet blank transfer mold; 7*b*—power transmission mechanism of first wet blank transfer mold; 7*c*—first wet blank moving frame; 7M—first wet blank transfer mold working surface; 8—left-right translation rail; 9—left-right translation rail slider; 10—horizontal driving mechanism of lower hot-press mold; 10L—left horizontal driving mechanism of lower hot-press mold; 10R—right horizontal driving mechanism of lower hot-press mold; T—transfer station of flipping mold 5*a* ("T position"); D—avoidance station of flipping mold 5*a* ("D position"); 11—dried and shaped product; 12—connector. 13—material receiving platform;

DETAILED DESCRIPTION OF EMBODIMENTS

This disclosure first provides a completely new paper pulp molding process, allowing the "smooth surface of the hot-press mold" to press against the "mesh surface of the wet blank", while the "mesh surface of the hot-press mold", which has some flexibility and can easily press against the entire surface of the wet blank, presses against the "fuzzy surface of the wet blank". This can easily achieve a smooth surface on the product. First, the wet blank is removed from the suction filtration forming mold. After the wet blank leaves the suction filtration forming mold and before it enters the hot-pressing shaping mold, a second wet blank transfer device flips the wet blank 180 degrees, then sends it into the hot-press mold for hot-press drying and shaping.

Secondly, due to the very compact structure of the fully automatic pulp molding machine, achieving such a 180-degree flip is extremely difficult. After years of research and effort by the inventor, a wet blank flipping method for manufacturing pulp molded products and a wet blank flipping pulp molding machine have been successfully realized.

The wet blank flipping pulp molding machine includes a frame 1, a suction filtration forming device 2, a hot-pressing shaping device 3, a first wet blank transfer device 7, a second wet blank transfer device 5, a control system (which can use existing technology), and other components. The wet blank is completed in the suction filtration forming device, then the first wet blank transfer device 7 extracts the wet blank from the suction filtration forming device 2 and transfers it to the second wet blank transfer mold of the second wet blank transfer device 5. The second wet blank transfer mold can adhere to the wet blank and perform a 180-degree vertical flip. After flipping the wet blank 180 degrees vertically, the second wet blank transfer mold inverts the wet blank, making the mesh surface of the wet blank face upwards. The wet blank with its mesh surface facing up is then transferred to the hot-pressing shaping device for hot-press drying and shaping. The smooth upper hot-press mold (the "smooth surface of the hot-press mold") presses against the upward-facing mesh surface of the wet blank ("mesh surface of the wet blank"), creating a dried and shaped pulp molded product with excellent processing effects on both sides.

The aforementioned hot-pressing shaping device 3 can be one or multiple (including a left hot-pressing shaping device 3L and a right hot-pressing shaping device 3R); the lower hot-press mold 3*c* can be one or multiple (including a left lower hot-press mold 3Lc and a right lower hot-press mold 3Rc), the upper hot-press mold 3*a* can be one or multiple (including a left upper hot-press mold 3La and a right upper hot-press mold 3Ra);

The 180-degree vertical flip mentioned in this disclosure refers to the working surface 5M of the second wet blank transfer mold changing from facing upwards to facing downwards, or from facing downwards to facing upwards.

The term "extract" used here all refer to the method of transferring the wet blank or semi-finished product from one component to another using negative pressure adsorption; this is existing technology.

Based on the different number of hot-pressing shaping devices and the different methods of transferring the flipped wet blank to the hot-pressing shaping device, the wet blank flipping method for manufacturing pulp molded products and the wet blank flipping pulp molding machine can have multiple implementation methods, specifically described as follows:

Embodiment 1

As shown in FIGS. 1B, 1C, 1, and 1A, in this embodiment, the wet blank flipping pulp molding machine includes a frame 1, a suction filtration forming device 2, a hot-pressing shaping device 3 (left hot-pressing shaping device 3L, right hot-pressing shaping device 3R), a second wet blank transfer device 5, a first wet blank transfer device 7, a left-right translation rail 8, a control system, and other components. The hot-pressing shaping device 3 includes two hot-pressing shaping devices, namely the left hot-pressing shaping device 3L and the right hot-pressing shaping device 3R.

Figure 6:
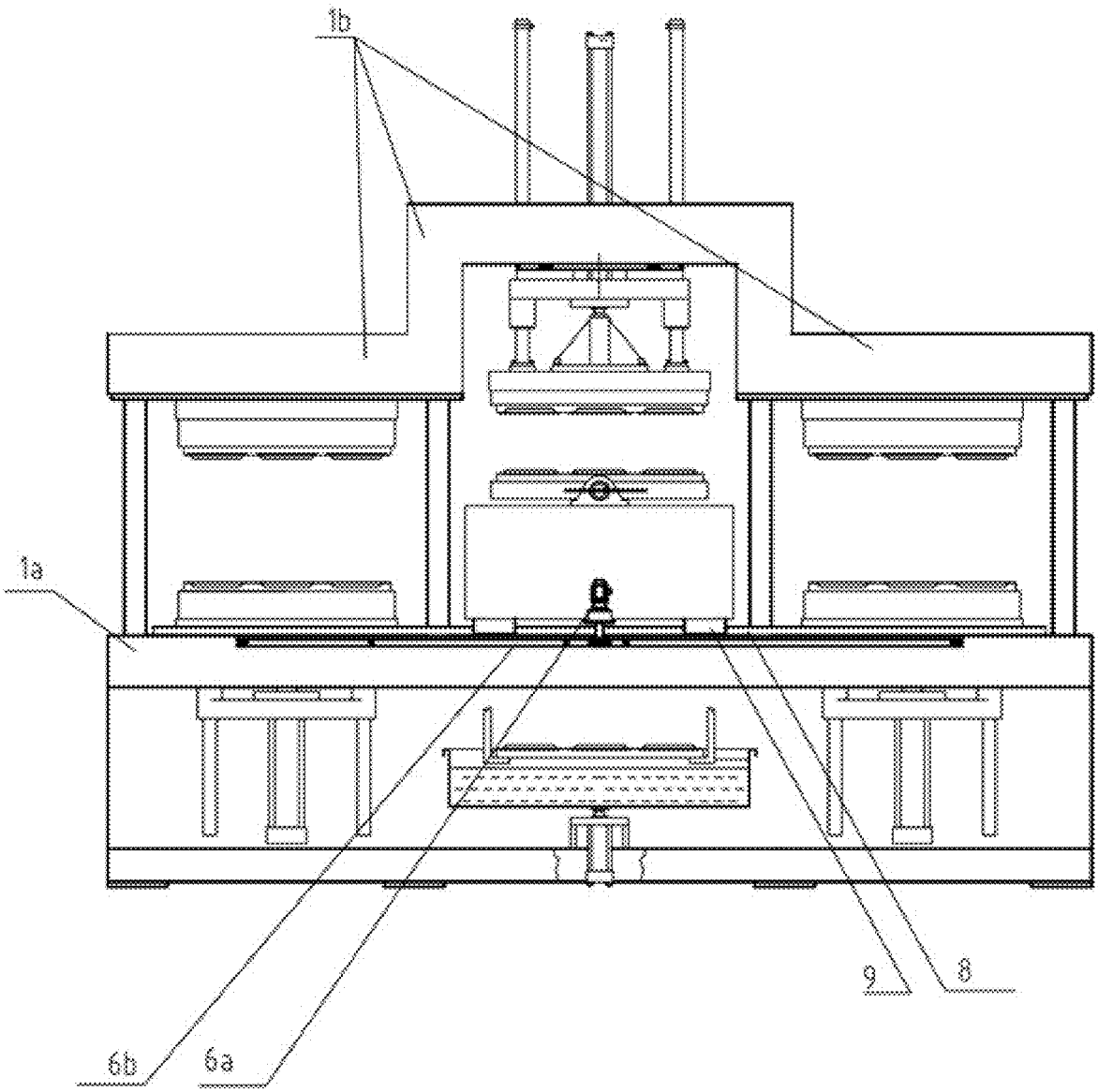
FIG. 6 is a front view structural diagram of Embodiment 1 of the "Wet Blank Flipping Pulp Molding Machine". The structure of the upper frame 1*b* varies according to the height changes of the hot-pressing shaping device and the first wet blank transfer device.

The frame 1 consists of a lower frame 1*a* and an upper frame 1*b*, with tie rods 1*c* fixing the lower frame 1*a* and upper frame 1*b* together. As shown in FIG. 6, the structure of the upper frame 1*b* can vary according to the height changes of the hot-pressing shaping device and the first wet blank transfer device.

The suction filtration forming device 2 is set in the middle of the lower frame 1*a*. The first wet blank transfer device 7 is set in the middle of the upper frame, above the suction filtration forming device 2. On the left and right sides of the frame, there is one hot-pressing shaping device 3 each, namely the left hot-pressing shaping device 3L and the right hot-pressing shaping device 3R. The left hot-pressing shaping device 3L and right hot-pressing shaping device 3R are also located on the left and right sides of the suction filtration forming device 2 and the first wet blank transfer device 7.

The suction filtration forming device 2 includes a suction filtration forming mold 2*a* and a suction filtration forming pulp tank 2*b*.

The first wet blank transfer device 7 includes a first wet blank transfer mold 7*a* and a power transmission mechanism of first wet blank transfer mold 7*b*.

The suction filtration forming mold 2*a* in the suction filtration forming device 2 forms the wet blank from the pulp slurry. The first wet blank transfer mold 7*a* extracts the wet blank from the suction filtration forming mold 2*a* and rises into position.

A mixture of plant fibers and water of appropriate concentration (referred to as pulp slurry) is intermittently or continuously injected into the suction filtration forming pulp tank 2*b*. The suction filtration forming mold 2*a* forms the wet blank from the pulp slurry. Various methods can be used to achieve the production of the wet blank.

Figure 1A:
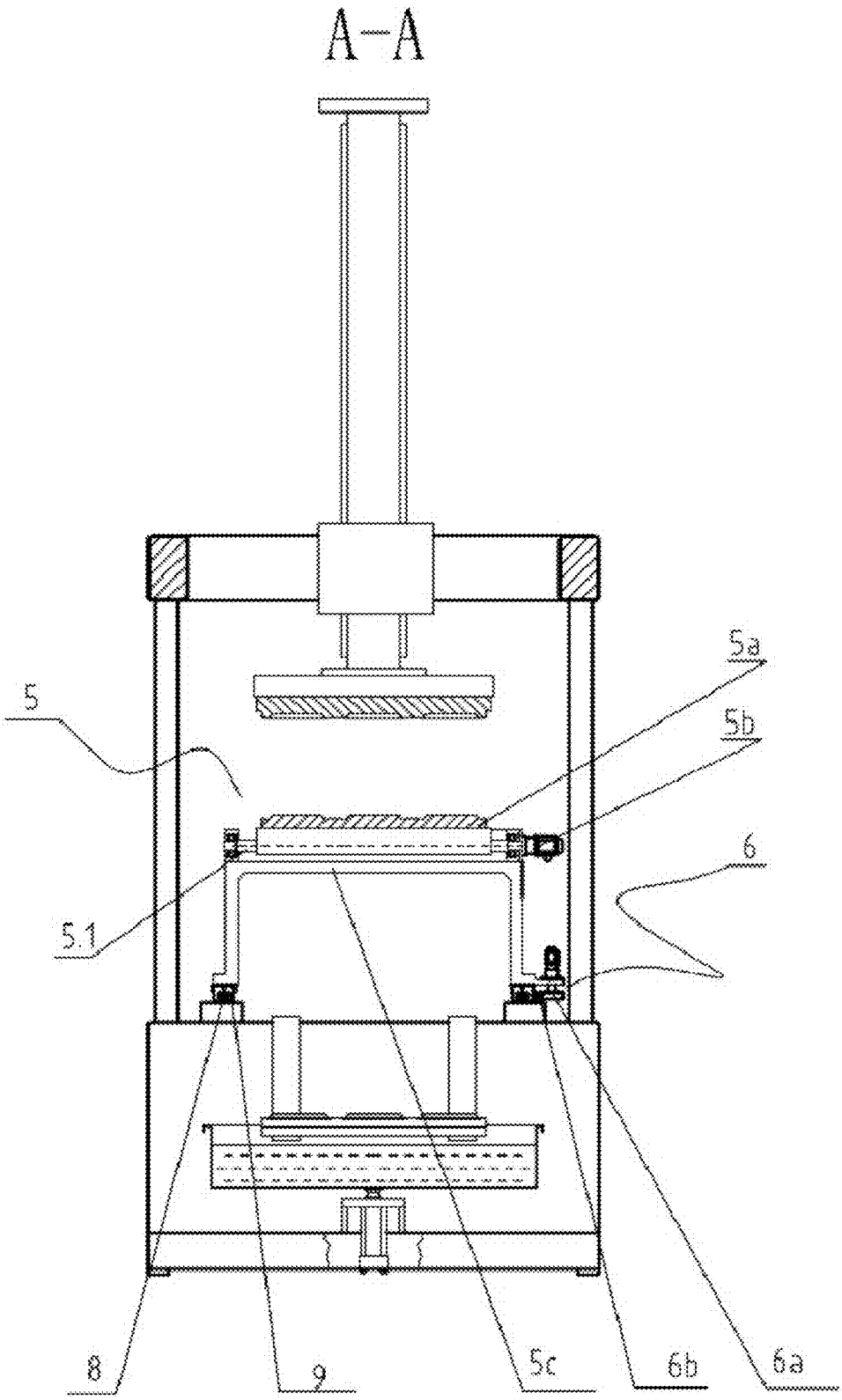
FIG. 1A is an A-A directional sectional view of FIG. 1.
Figure 1B:
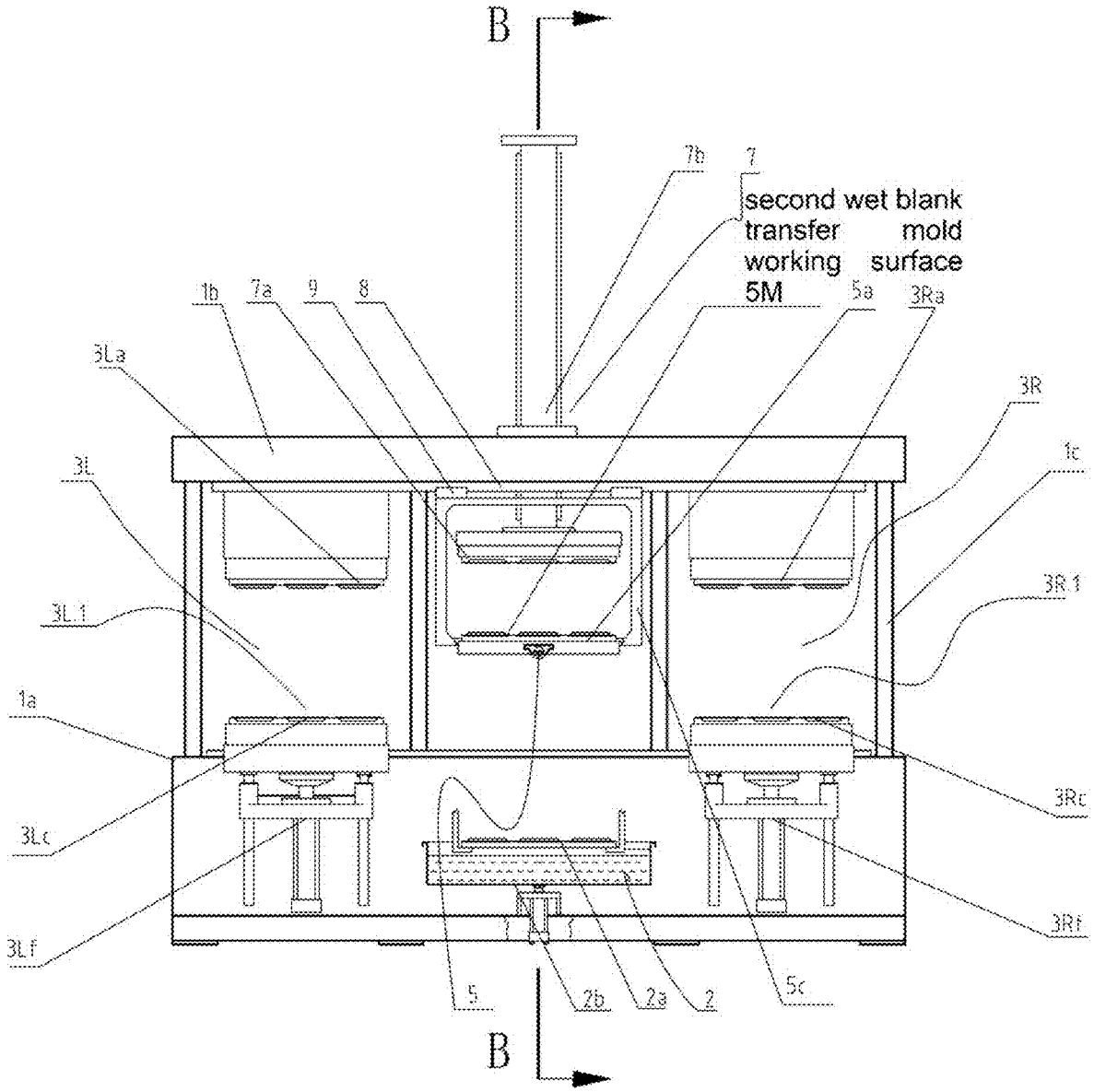
FIG. 1B is a front view structural diagram of Embodiment 1 of the "Wet Blank Flipping Pulp Molding Machine" with the left-right translation rail 8 fixed to the upper frame (showing the state when the second wet blank transfer device 5 has moved under the first wet blank transfer mold 7*a*, with the working surface 5M of the second wet blank transfer mold facing up).

As shown in FIGS. 1B and 1, the left hot-pressing shaping device 3L contains a vertically movable left lower hot-press mold 3Lc, a left lower hot-press mold driving device 3Lf, and a left upper hot-press mold 3La fixed to the upper frame. The left upper hot-press mold 3La and left lower hot-press mold 3Lc are a matching pair of hot-press molds, called the left hot-pressing shaping mold (left hot-press mold). The left lower hot-press mold 3Lc can move up and down driven by the left lower hot-press mold driving device 3Lf.

The right hot-pressing shaping device 3R contains a vertically movable right lower hot-press mold 3Rc, a right lower hot-press mold driving device 3Rf, and a right upper hot-press mold 3Ra fixed to the upper frame. The right upper hot-press mold 3Ra and right lower hot-press mold 3Rc are a matching pair of hot-press molds, called the right hot-pressing shaping mold (right hot-press mold). The right lower hot-press mold 3Rc can move up and down driven by the right lower hot-press mold driving device 3Rf.

The left lower hot-press mold 3Lc and right lower hot-press mold 3Rc are collectively referred to as the lower hot-press mold 3*c*, while the left upper hot-press mold 3La and right upper hot-press mold 3Ra are collectively referred to as the upper hot-press mold 3*a*.

Figure 1C:
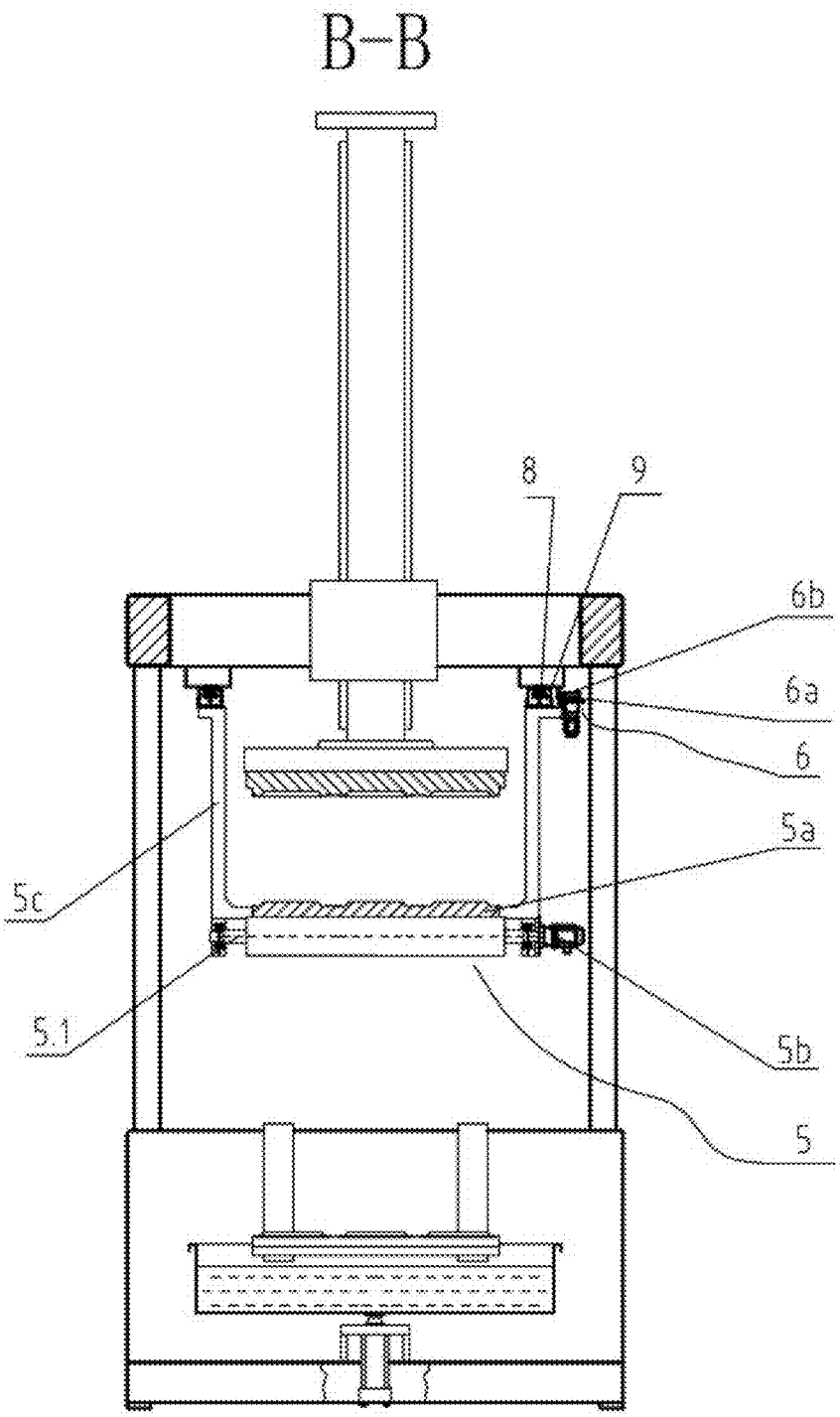
FIG. 1C is a B-B directional sectional view of FIG. 1B.
Figure 1D:
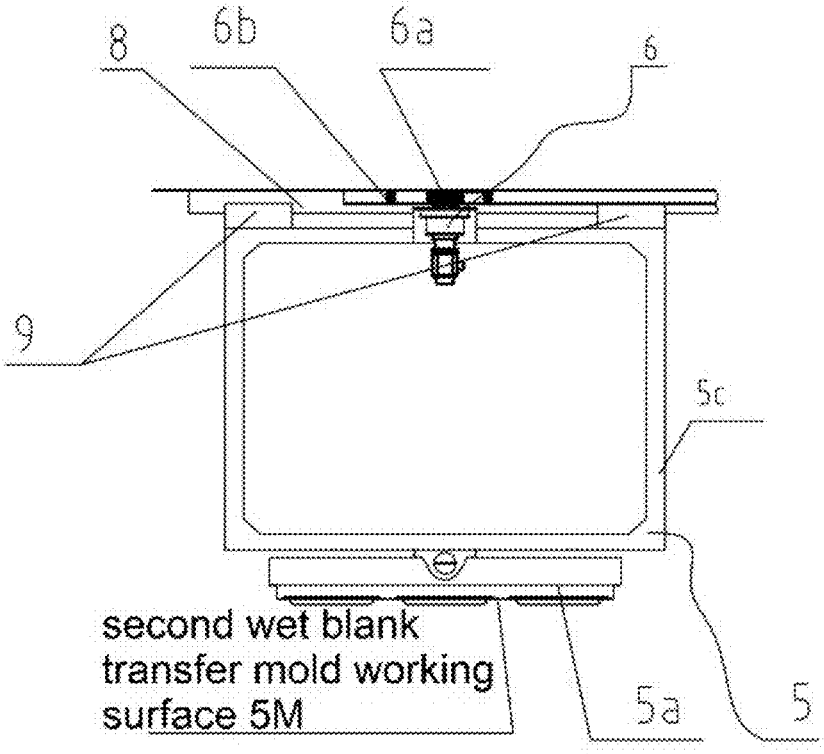
FIG. 1D is a partial enlarged view of the second wet blank transfer device 5 and the horizontal driver 6 of the second wet blank transfer device in Embodiment 1 of the "Wet Blank Flipping Pulp Molding Machine" with the left-right translation rail 8 fixed to the upper frame.
Figure 2:
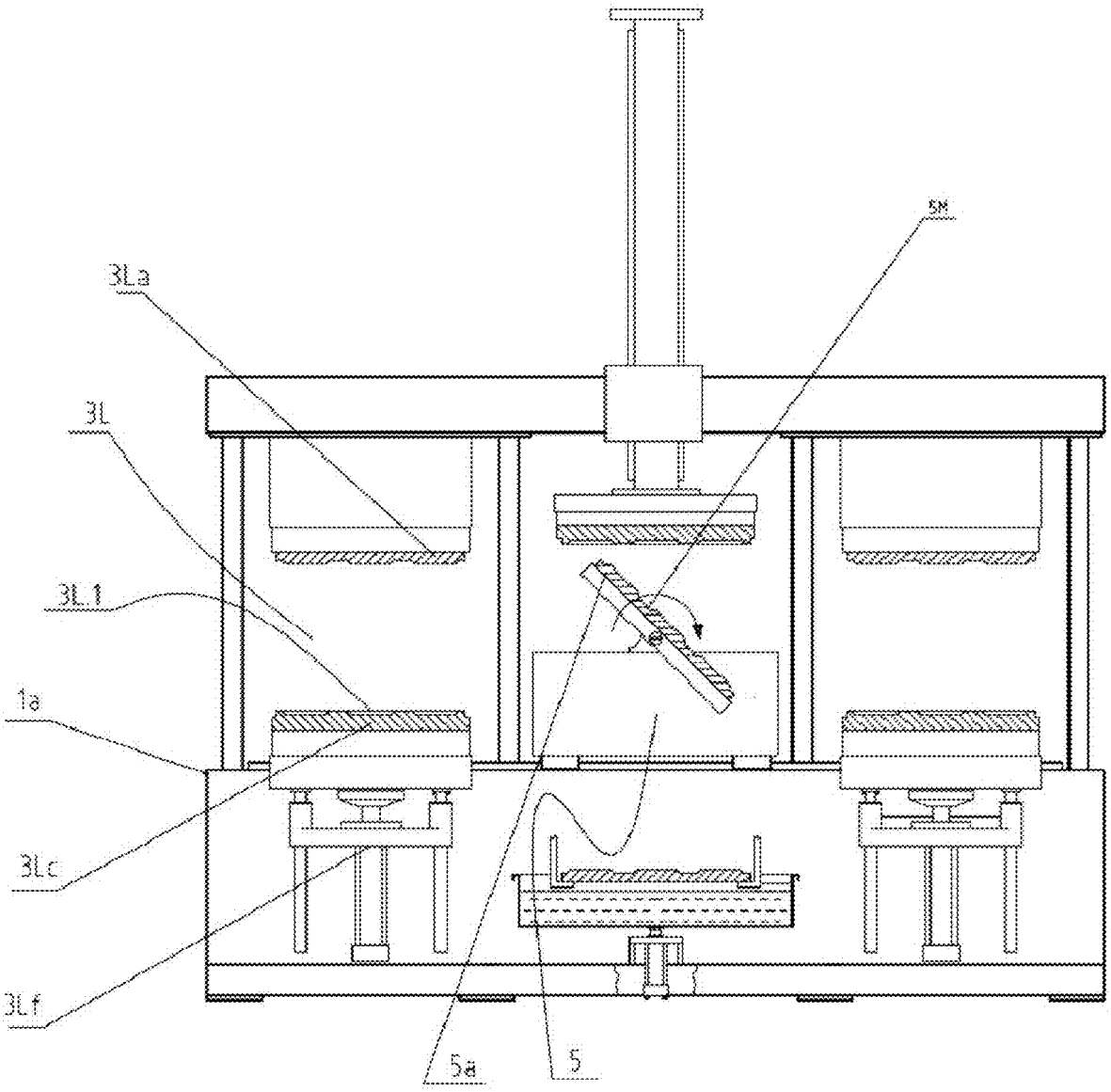
FIG. 2 is a front view structural diagram of Embodiment 1 of the "Wet Blank Flipping Pulp Molding Machine" with the left-right translation rail 8 fixed to the lower frame (showing the state when the second wet blank transfer device 5 has moved under the first wet blank transfer mold 7*a*, and the second wet blank transfer mold 5*a* is flipping).
Figure 2A:
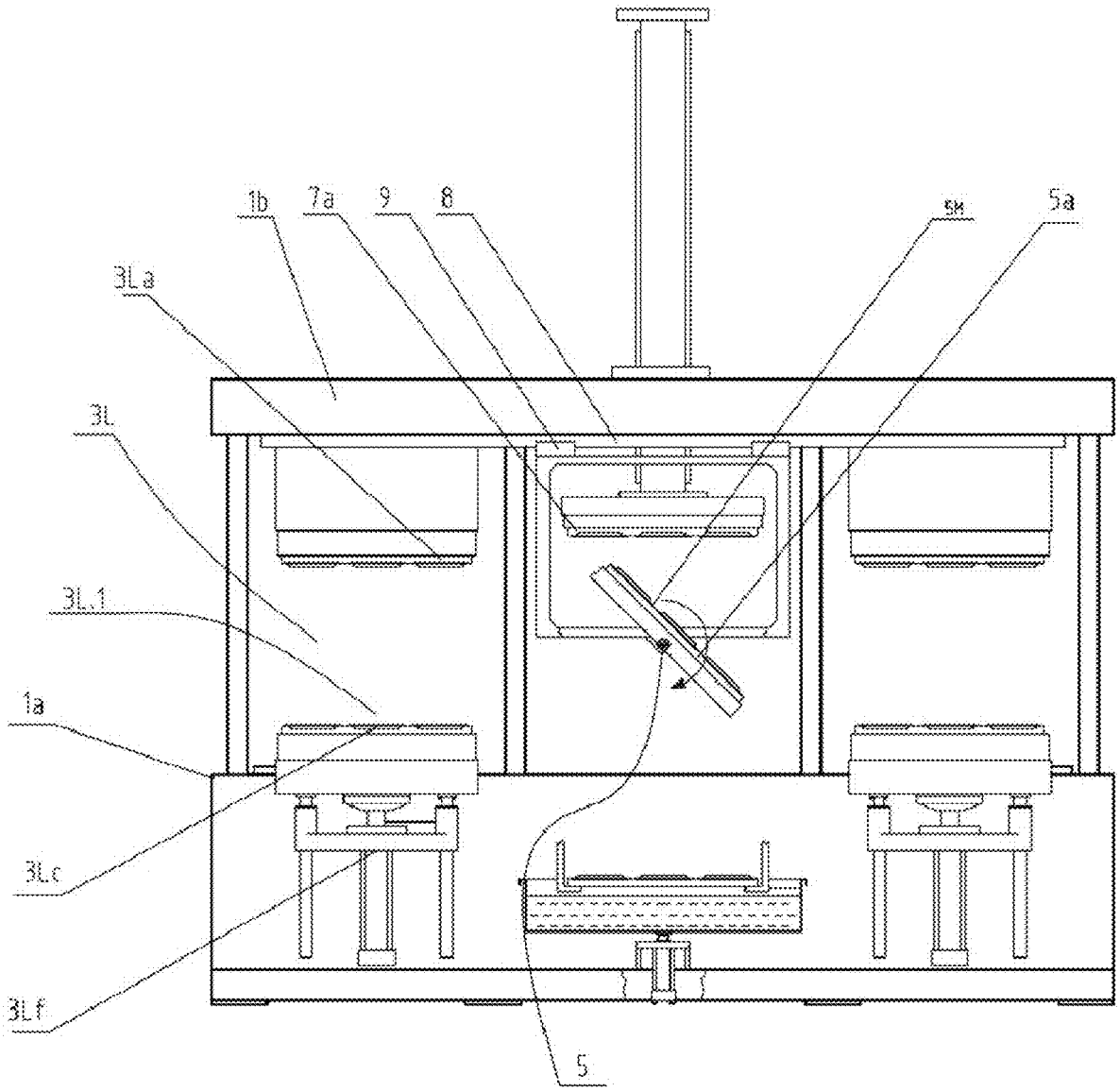
FIG. 2A is a front view structural diagram of Embodiment 1 of the "Wet Blank Flipping Pulp Molding Machine" with the left-right translation rail 8 fixed to the upper frame (showing the state when the second wet blank transfer device 5 has moved under the first wet blank transfer mold 7*a*, and the second wet blank transfer mold 5*a* is flipping).
Figure 3:
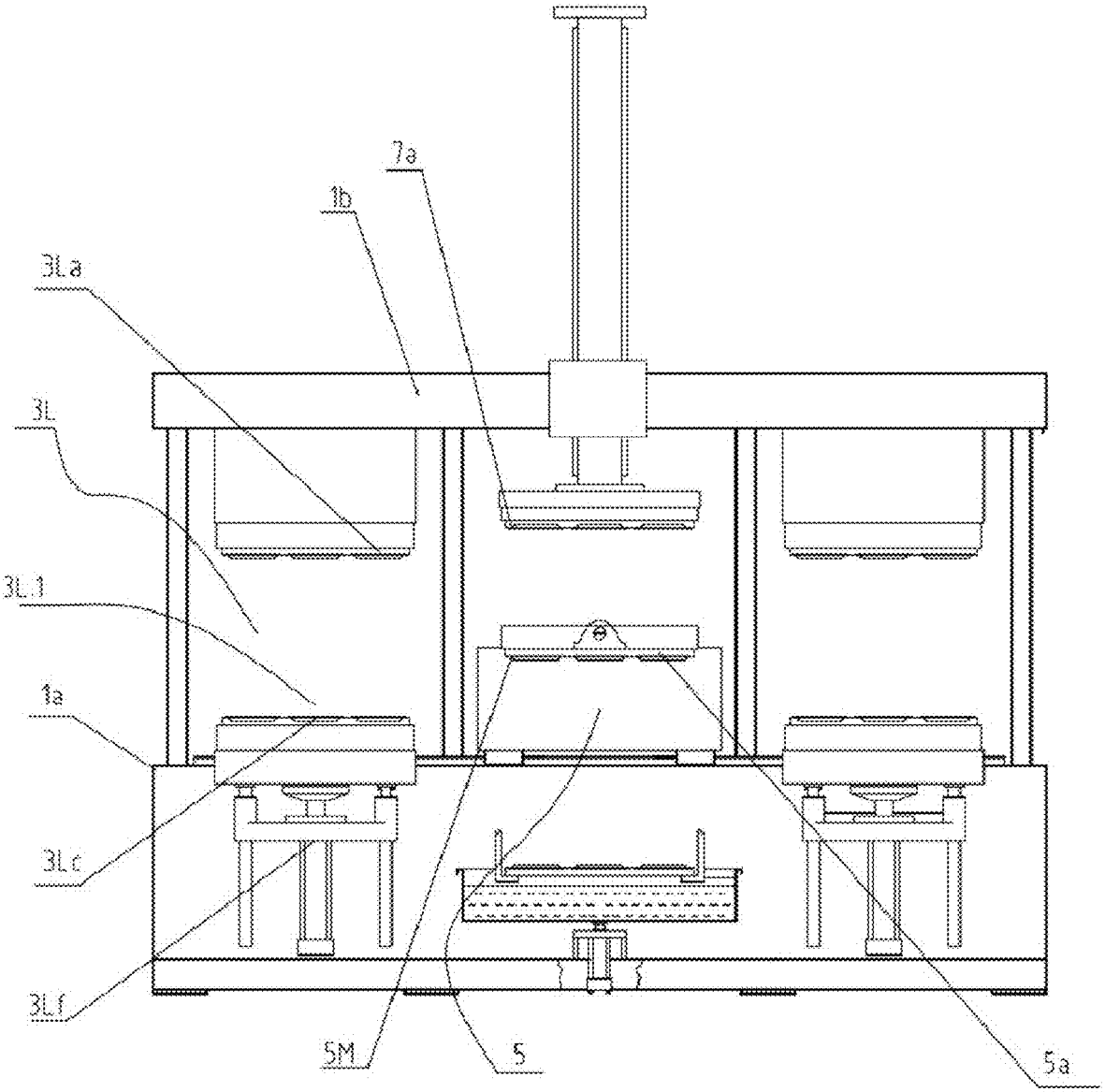
FIG. 3 is a front view structural diagram of Embodiment 1 of the "Wet Blank Flipping Pulp Molding Machine" with the left-right translation rail 8 fixed to the lower frame (showing the state when the second wet blank transfer device 5 has moved under the first wet blank transfer mold 7*a*, with the working surface 5M of the second wet blank transfer mold facing down).
Figure 3A:
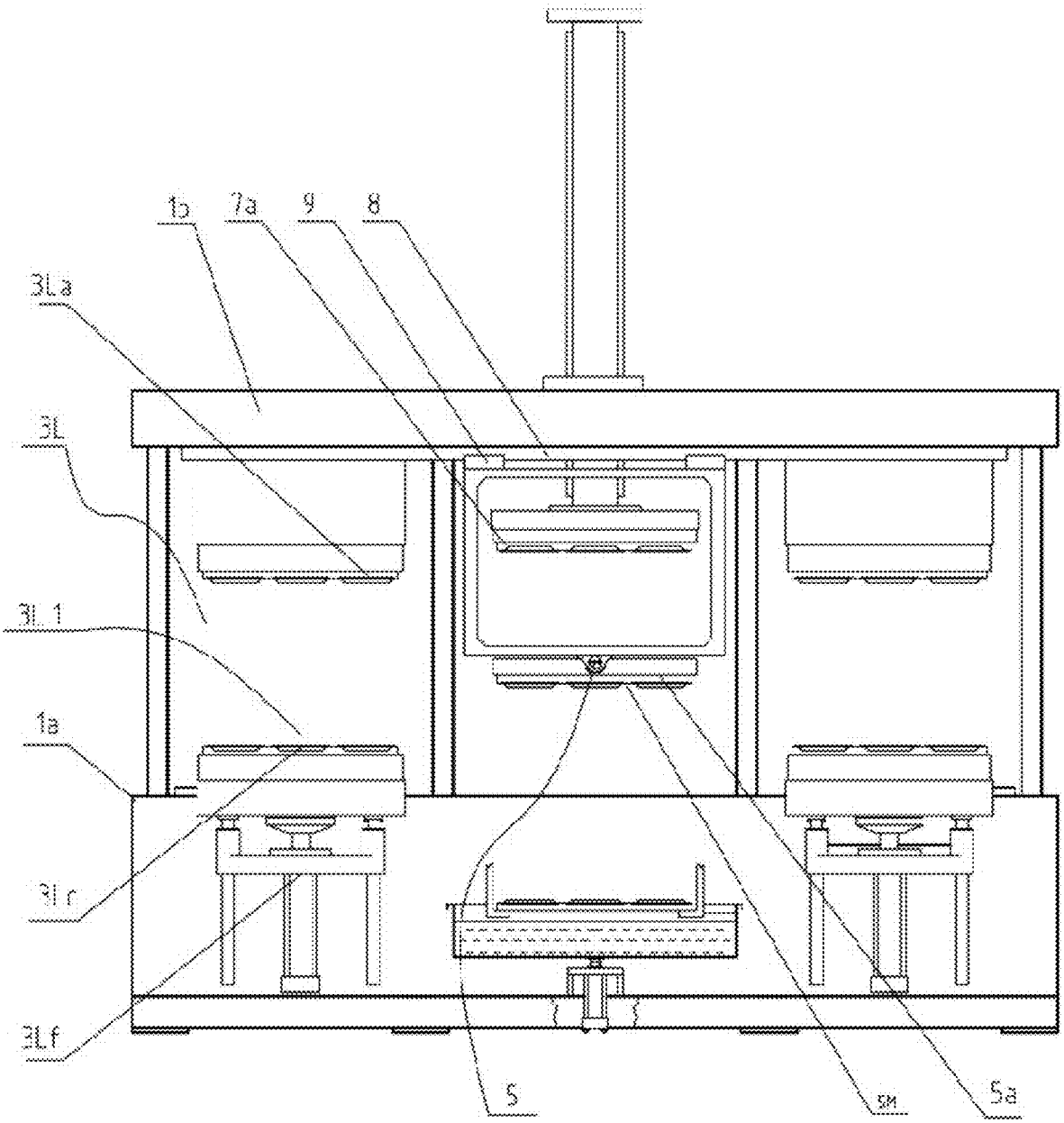
FIG. 3A is a front view structural diagram of Embodiment 1 of the "Wet Blank Flipping Pulp Molding Machine" with the left-right translation rail 8 fixed to the upper frame (showing the state when the second wet blank transfer device 5 has moved under the first wet blank transfer mold 7*a*, with the working surface 5M of the second wet blank transfer mold facing down).

As shown in FIGS. 1B, 1C, and 1D, two (or two sets of) left-right translation rails 8 are fixed to the underside of the upper frame, extending from the left end to the right end. Left-right translation rail sliders 9 that can slide horizontally along the rails are set on the left-right translation rails 8. The second wet blank transfer device 5 is fixed to the left-right translation rail sliders 9, suspended from the underside of the upper frame through the left-right translation rail sliders 9, and can move horizontally left and right along the left-right translation rails 8.

As shown in FIGS. 1 and 1A, the left-right translation rails 8 can also be fixed to the lower frame. Two (or two sets of) left-right translation rails 8 are fixed on the lower frame, extending from the left end to the right end. Left-right translation rail sliders 9 that can slide horizontally along the rails are set on the left-right translation rails 8. The second wet blank transfer device 5 is fixed to the left-right translation rail sliders 9 and can move left and right along the left-right translation rails 8 through the left-right translation rail sliders 9.

As shown in FIGS. 1, 1A, 1B, 1C, and 1D, the second wet blank transfer device 5 contains a second wet blank transfer mold 5*a*, a wet blank flipping driver 5*b*, a second wet blank transfer device moving frame 5*c*, and a horizontal driver of second wet blank transfer device 6. The mold face of the second wet blank transfer mold 5*a* used to adhere to the wet blank is called the "second wet blank transfer mold working surface" 5M. The second wet blank transfer mold 5*a* can perform a 180-degree vertical flip driven by the wet blank flipping driver 5*b*. As can be seen from the figures: The second wet blank flipping shaft 5.1 is rotatably positioned on the second wet blank transfer device moving frame 5*c* through bearings. The base of the wet blank flipping driver 5*b* (such as a motor with a reducer) is fixed to one side of the second wet blank transfer device moving frame 5*c*. The drive shaft of the wet blank flipping driver 5*b* (such as the motor output shaft or reducer output shaft) is coaxially connected with the second wet blank flipping shaft 5.1. Obviously, when the wet blank flipping driver starts, it can drive the second wet blank transfer mold to perform a 180-degree flip around the second wet blank flipping shaft 5.1.

As shown in FIGS. 1B, 2A, 3A, 1, 2, and 3, the second wet blank transfer mold 5*a* can perform a 180-degree vertical flip with the wet blank transferred from the first wet blank transfer mold 7*a*. After flipping, the second wet blank transfer mold working surface 5M and the adhered wet blank face downwards (with the mesh surface of the wet blank facing up). The wet blank, after the 180-degree vertical flip, is alternately sent to the left hot-pressing shaping device 3L and the right hot-pressing shaping device 3R for hot-press drying and shaping. There are multiple ways for the second wet blank transfer mold 5*a* to perform the 180-degree vertical flip. As a preferred solution, the 180-degree vertical flip of the second wet blank transfer mold 5*a* can be performed around an axis parallel to the horizontal plane, i.e., it can flip 180 degrees up and down around the axis, achieving the purpose of flipping the second wet blank transfer mold working surface 5M from facing up to facing down.

The horizontal movement of the second wet blank transfer device 5 is driven by the horizontal driver of second wet blank transfer device 6. As shown in FIGS. 1C, 1D, 4A, 1A, and 5, the horizontal driver of second wet blank transfer device 6 uses a gear and rack drive method. The horizontal driver of second wet blank transfer device 6 contains a gear power head 6*a* fixed to the second wet blank transfer device 5, and a rack 6*b* fixed to the lower frame or upper frame. The gear power head 6*a* contains a gear and a servo motor that drives the gear's rotation. The gear meshes with the rack 6*b*, and the servo motor drives the gear's rotation, thus moving the second wet blank transfer device 5 horizontally left and right. Alternatively, the horizontal movement of the second wet blank transfer device 5 can be driven by a linear motor, with its moving part fixed to the second wet blank transfer device 5 and its stationary part fixed to the upper frame or lower frame. Another alternative is to use a ball screw mechanism to drive the horizontal movement of the second wet blank transfer device 5.

The left-right translation rail 8 horizontally spans across the left hot-pressing shaping device 3L, the first wet blank transfer device 7, and the right hot-pressing shaping device 3R. Driven by the horizontal driver of second wet blank transfer device 6, the second wet blank transfer device 5 can move along the left-right translation rail 8 between positions above the left lower hot-press mold 3Lc, below the first wet blank transfer device 7, and above the right lower hot-press mold 3Rc.

The first wet blank transfer mold 7*a* extracts the wet blank from the suction filtration forming mold 2*a* and rises into position. Driven by the horizontal driver of second wet blank transfer device 6, the second wet blank transfer device 5 carries the second wet blank transfer mold 5*a* along the left-right translation rail 8 to a position under the first wet blank transfer mold 7*a*. The second wet blank transfer mold 5*a*, which had its wet blank transferred away in the previous production cycle, now has its "second wet blank transfer mold working surface" 5M facing downwards. Therefore, the second wet blank transfer mold 5*a* needs to flip 180 degrees vertically to make the second wet blank transfer mold working surface 5M face upwards, i.e., towards the first wet blank transfer mold 7*a*, in order to receive the wet blank transferred from the first wet blank transfer mold 7*a*, as shown in FIGS. 1B and 1. After the first wet blank transfer mold 7*a* moves down to transfer the wet blank to the second wet blank transfer mold 5*a*, it moves back up to its original position. The second wet blank transfer mold 5*a* receives the wet blank, and at this point, the second wet blank transfer mold working surface 5M and the wet blank are facing upwards.

As shown in FIGS. 1B, 2A, 3A, 1, 2, and 3, driven by the wet blank flipping driver 5*b*, the second wet blank transfer mold 5*a* with the received wet blank flips 180 degrees vertically. After completing the flip, the second wet blank transfer mold working surface 5M and the adhered wet blank face downwards (with the mesh surface of the wet blank facing up).

Figure 4:
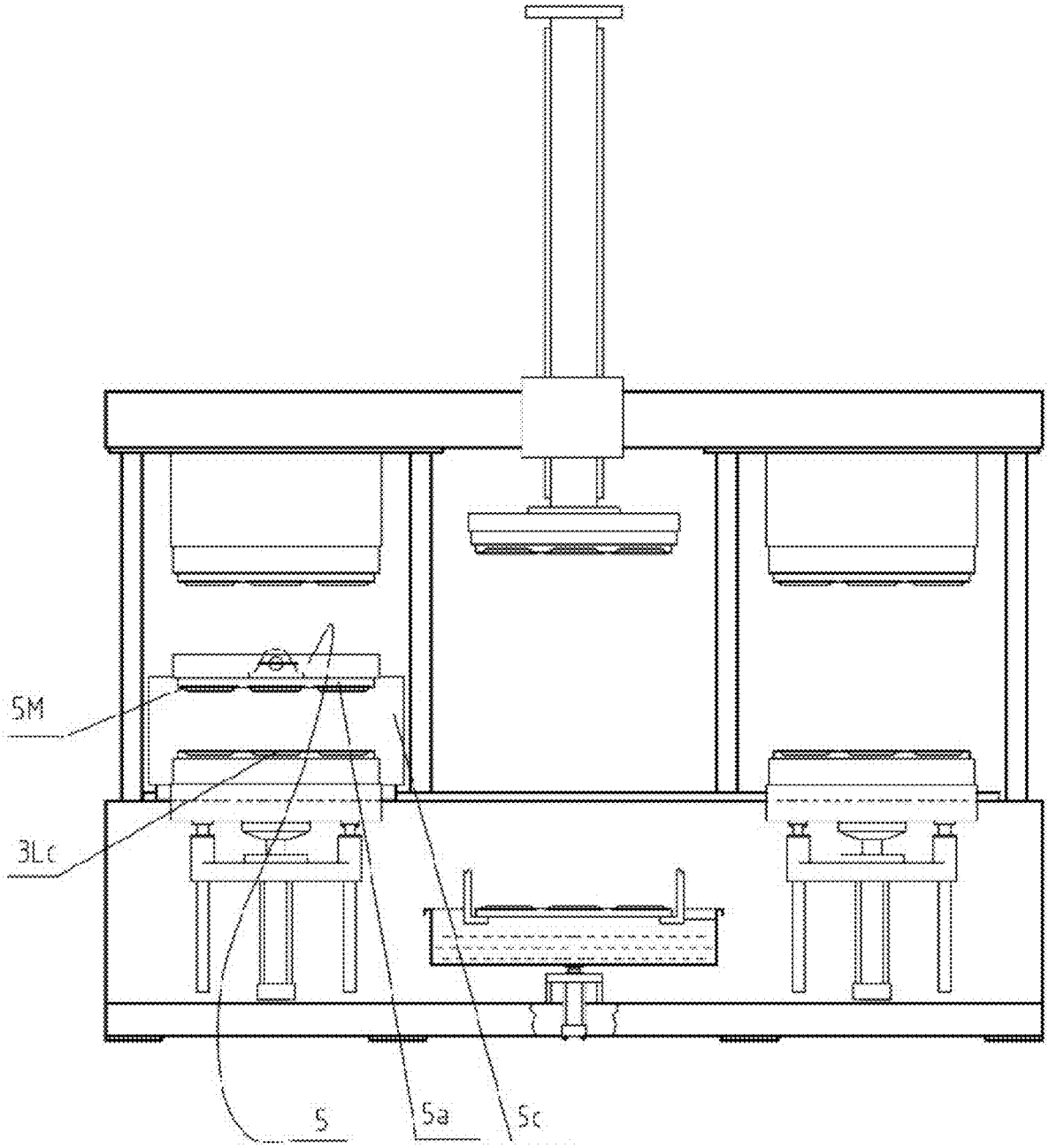
FIG. 4 is a front view structural diagram of Embodiment 1 of the "Wet Blank Flipping Pulp Molding Machine" with the left-right translation rail 8 fixed to the lower frame (showing the state when the second wet blank transfer device 5, with its working surface 5M facing down, has moved above the left lower hot-press mold 3Lc).
Figure 4A:
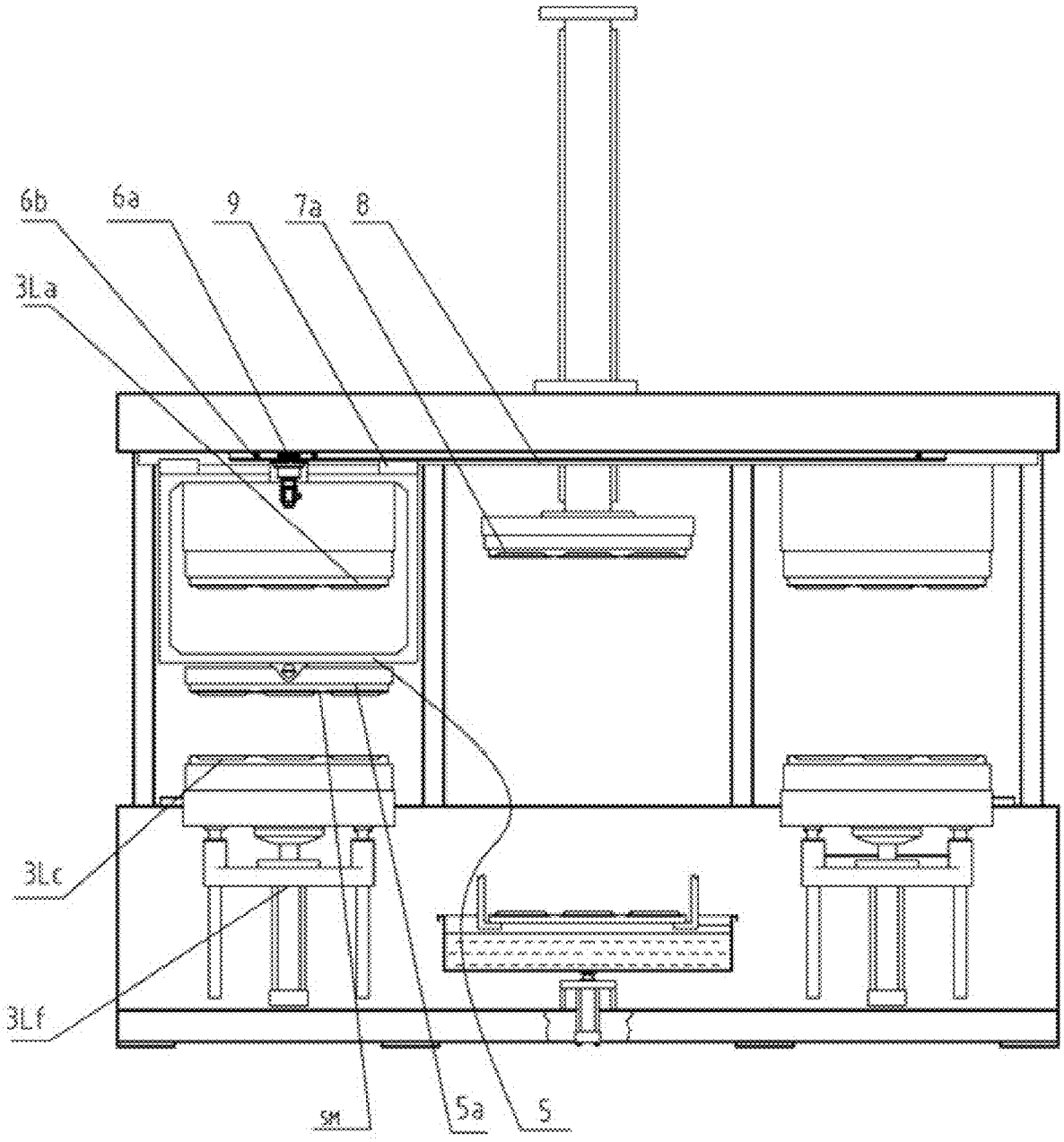
FIG. 4A is a front view structural diagram of Embodiment 1 of the "Wet Blank Flipping Pulp Molding Machine" with the left-right translation rail 8 fixed to the upper frame (showing the state when the second wet blank transfer device 5, with its working surface 5M facing down, has moved above the left lower hot-press mold 3Lc).
Figure 5:
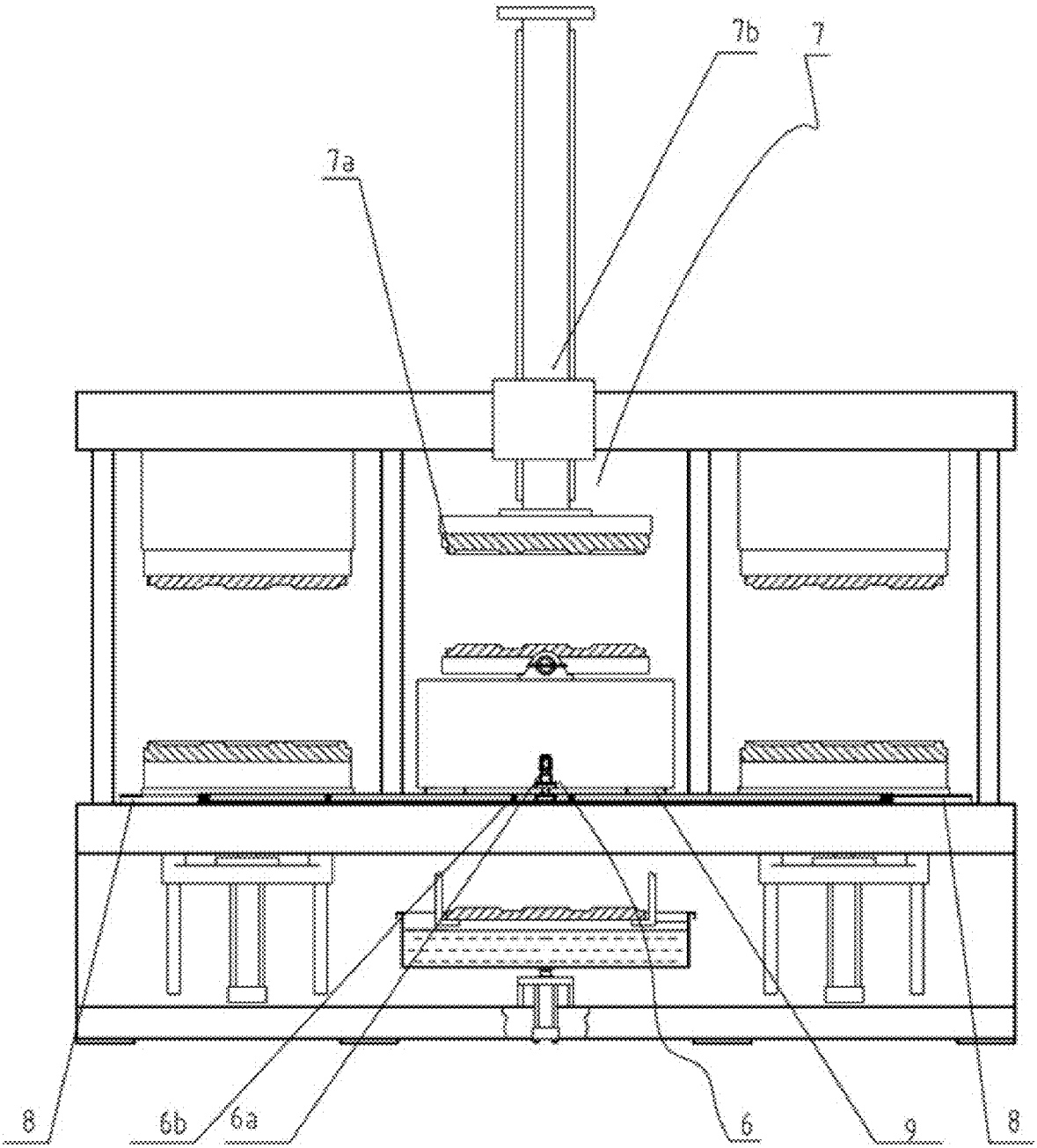
FIG. 5 is a front view structural diagram of Embodiment 1 of the "Wet Blank Flipping Pulp Molding Machine" with the left-right translation rail 8 fixed to the lower frame. The figure shows the horizontal movement driving method of the second wet blank transfer device 5, where a servo motor drives the gear and rack to move the second wet blank transfer device 5 horizontally.

As shown in FIGS. 4 and 4A, driven by the horizontal driver of second wet blank transfer device 6, the second wet blank transfer mold 5*a* with the flipped wet blank moves left along the left-right translation rail 8 to a position above the vertically movable left lower hot-press mold 3Lc. The left lower hot-press mold 3Lc moves up to extract the wet blank from the second wet blank transfer mold 5*a*, then moves down into position. Simultaneously, the first wet blank transfer mold 7*a* moves down to the suction filtration forming device 2 to extract the wet blank from the suction filtration forming mold 2*a* and rises back into position.

The second wet blank transfer mold 5*a* returns along the left-right translation rail 8 to a position below the first wet blank transfer mold 7*a*. The second wet blank transfer mold 5*a* flips 180 degrees vertically again, with the second wet blank transfer mold working surface 5M facing upwards towards the first wet blank transfer mold 7*a* (as shown in FIGS. 1 and 1B). The first wet blank transfer mold 7*a* moves down again to transfer the wet blank to the second wet blank transfer mold 5*a*, then moves back up to its original position. The second wet blank transfer mold 5*a* receives another wet blank, while simultaneously, the left lower hot-press mold 3Lc moves up to close with the left upper hot-press mold 3La for hot-press drying and shaping of the wet blank. After hot-press drying and shaping, the left hot-press mold opens, and the pulp molded product is promptly removed from the pulp molding machine at the appropriate time.

The second wet blank transfer mold 5*a*, now with a new wet blank, is driven by the wet blank flipping driver 5*b* to flip 180 degrees vertically again. After completing the flip, the second wet blank transfer mold 5*a* with the flipped wet blank moves right along the left-right translation rail 8 to a position above the vertically movable right lower hot-press mold 3Rc. The right lower hot-press mold 3Rc moves up to extract the wet blank from the second wet blank transfer mold 5*a*, then moves down into position. Simultaneously, the first wet blank transfer mold 7*a* moves down to the suction filtration forming device 2 to extract the wet blank from the suction filtration forming mold 2*a* and rises back into position.

The second wet blank transfer mold 5*a* returns along the left-right translation rail 8 to a position below the first wet blank transfer mold 7*a*. The second wet blank transfer mold 5*a* flips 180 degrees vertically again, with the second wet blank transfer mold working surface 5M facing upwards towards the first wet blank transfer mold 7*a*. The first wet blank transfer mold 7*a* moves down again to transfer the wet blank to the second wet blank transfer mold 5*a*, then moves back up to its original position. The second wet blank transfer mold 5*a* receives another wet blank. Simultaneously, the right lower hot-press mold 3Rc moves up to close with the right upper hot-press mold 3Ra for hot-press drying and shaping of the wet blank. After hot-press drying and shaping, the right hot-press mold opens, and the pulp molded product is promptly removed from the pulp molding machine at the appropriate time.

The complete implementation process of this embodiment is typically as follows:

(1) The second wet blank transfer mold 5*a*, which has had its wet blank transferred away, moves along the left-right translation rail 8 to a position below the first wet blank transfer mold 7*a*. The second wet blank transfer mold 5*a* flips 180 degrees vertically, with the second wet blank transfer mold working surface 5M facing upwards towards the first wet blank transfer mold 7*a*. The first wet blank transfer mold 7*a* moves down to transfer the wet blank to the second wet blank transfer mold 5*a*, then moves back up to its original position. The second wet blank transfer mold 5*a*, now with the wet blank, flips 180 degrees vertically again. After completing the flip, the second wet blank transfer mold working surface 5M and the adhered wet blank face downwards (with the mesh surface of the wet blank facing up).

(2) The wet blank, along with the second wet blank transfer mold 5*a*, moves left along the left-right translation rail 8 to a position above the vertically movable left lower hot-press mold 3Lc (as shown in FIGS. 4A and 4). The left lower hot-press mold 3Lc moves up to extract the wet blank from the second wet blank transfer mold 5*a*, then moves down into position. Simultaneously, the first wet blank transfer mold 7*a* moves down to the suction filtration forming device 2 to extract the wet blank from the suction filtration forming mold 2*a* and rises back into position.

(3) The second wet blank transfer mold 5*a*, which has had its wet blank transferred away, returns along the left-right translation rail 8 to a position below the first wet blank transfer mold 7*a*. The second wet blank transfer mold 5*a* flips 180 degrees vertically again, with the second wet blank transfer mold working surface 5M facing upwards towards the first wet blank transfer mold 7*a*. The first wet blank transfer mold 7*a* moves down again to transfer the wet blank to the second wet blank transfer mold 5*a*, then moves back up to its original position. The second wet blank transfer mold 5*a* receives another wet blank, then flips 180 degrees vertically with the wet blank, making the second wet blank transfer mold working surface 5M and the adhered wet blank face downwards, with the mesh surface of the wet blank facing up.

Meanwhile, the left lower hot-press mold 3Lc moves up to close with the left upper hot-press mold 3La for hot-press drying and shaping of the wet blank. After hot-press drying and shaping, the left hot-press mold opens, and the pulp molded product is promptly removed from the pulp molding machine at the appropriate time.

(4) The wet blank, along with the second wet blank transfer mold 5*a*, moves right to a position above the vertically movable right lower hot-press mold 3Rc. The right lower hot-press mold 3Rc moves up to extract the wet blank from the second wet blank transfer mold 5*a*, then moves down into position. Simultaneously, the first wet blank transfer mold 7*a* moves down to the suction filtration forming device 2 to extract the wet blank from the suction filtration forming mold 2*a* and rises back into position.

(5) The second wet blank transfer mold 5*a*, which has had its wet blank transferred away, returns to a position below the first wet blank transfer mold 7*a*. The second wet blank transfer mold 5*a* flips 180 degrees vertically again, with the second wet blank transfer mold working surface 5M facing upwards towards the first wet blank transfer mold 7*a*. The first wet blank transfer mold 7*a* moves down again to transfer the wet blank to the second wet blank transfer mold 5*a*, then moves back up to its original position. The second wet blank transfer mold 5*a* receives another wet blank, then flips 180 degrees vertically with the wet blank, making the second wet blank transfer mold working surface 5M and the adhered wet blank face downwards, with the mesh surface of the wet blank facing up.

Meanwhile, the right lower hot-press mold 3Rc moves up to close with the right upper hot-press mold 3Ra for hot-press drying and shaping of the wet blank. After hot-press drying and shaping, the right hot-press mold opens, and the pulp molded product is promptly removed from the pulp molding machine at the appropriate time.

(6) The wet blank, along with the second wet blank transfer mold 5*a*, moves left along the left-right translation rail 8 to a position above the vertically movable left lower hot-press mold 3Lc. The left lower hot-press mold 3Lc moves up to extract the wet blank from the second wet blank transfer mold 5*a*, then moves down into position. Simultaneously, the first wet blank transfer mold 7*a* moves down to the suction filtration forming device 2 to extract the wet blank from the suction filtration forming mold 2*a* and rises back into position.

The wet blank flipping pulp molding machine operates in a cyclic manner according to the above steps, continuously producing pulp molded products, which are promptly removed from the pulp molding machine.

Throughout the entire production process of pulp molded products, the wet blank made by the suction filtration forming mold 2*a* is taken by the first wet blank transfer mold 7*a* and sent to the second wet blank transfer mold 5*a*. It is then flipped 180 degrees vertically by the second wet blank transfer mold 5*a* (with the second wet blank transfer mold working surface 5M and the adhered wet blank facing down, and the mesh surface of the wet blank facing up) before being sent to either the left or right hot-pressing shaping device for hot-press drying and shaping. This achieves the effect of matching the "mesh surface of the wet blank" with the "smooth surface of the hot-press mold". It can also achieve the ideal processing effect of uniform product wall thickness and easy demolding, greatly improving the machine's operational stability, product quality, and pass rate, while significantly reducing production costs.

Embodiment 2

Figure 7:
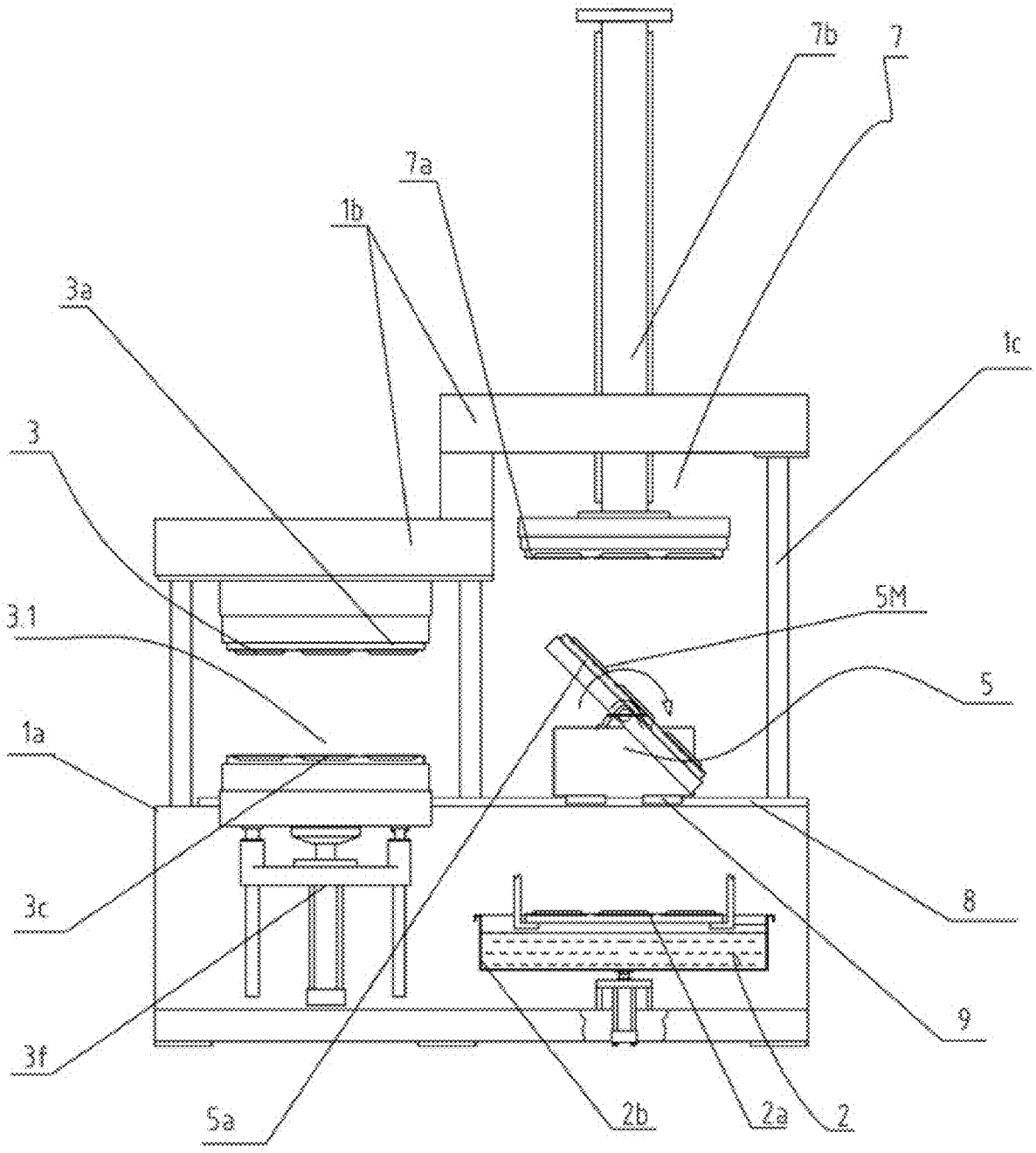
FIG. 7 is a front view structural diagram of Embodiment 2 of the "Wet Blank Flipping Pulp Molding Machine" with the left-right translation rail 8 fixed to the lower frame (showing the state when the second wet blank transfer device 5 has moved under the first wet blank transfer mold 7*a*, and the second wet blank transfer mold 5*a* is flipping).
Figure 7A:
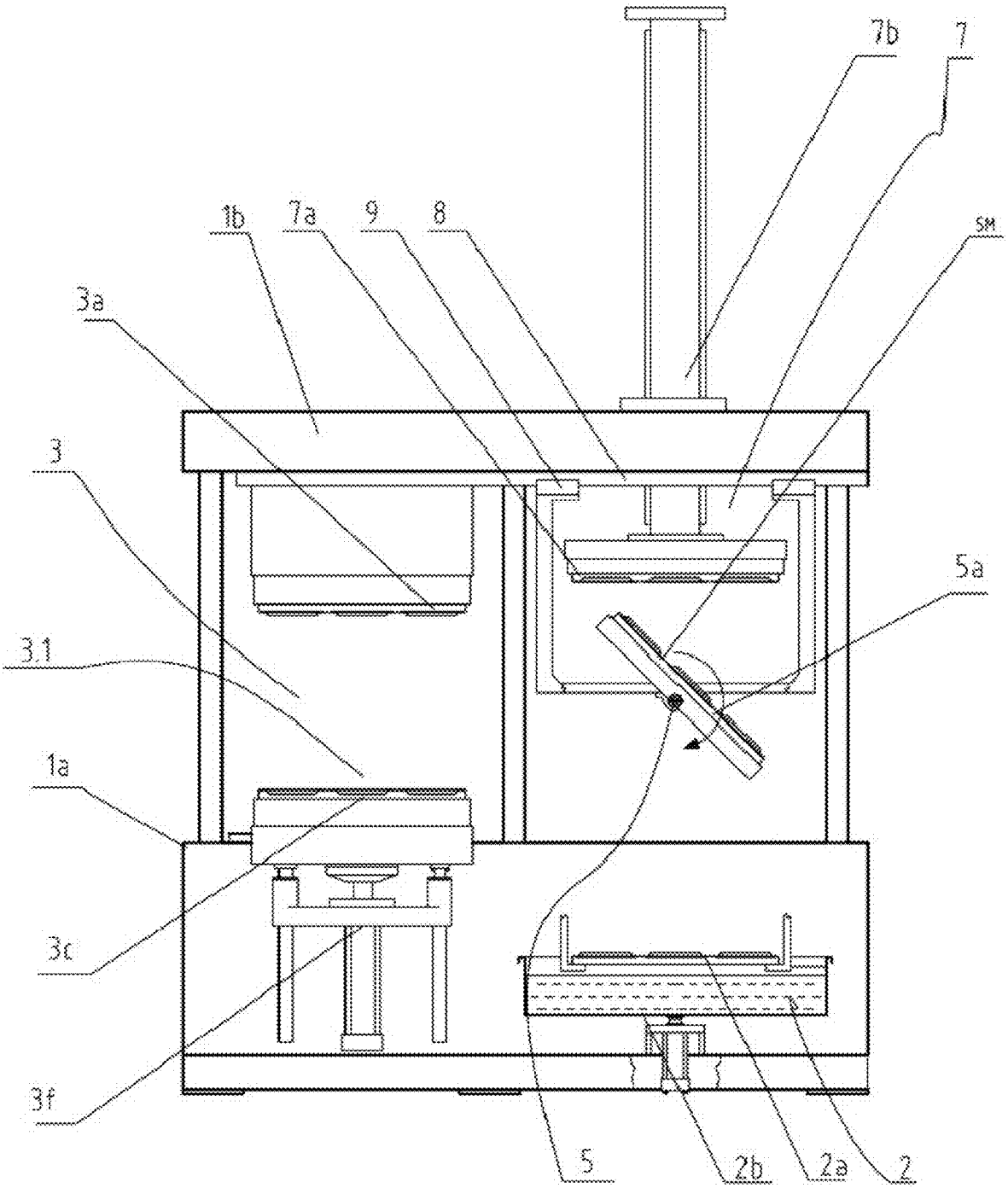
FIG. 7A is a front view structural diagram of Embodiment 2 of the "Wet Blank Flipping Pulp Molding Machine" with the left-right translation rail 8 fixed to the upper frame (showing the state when the second wet blank transfer device 5 has moved under the first wet blank transfer mold 7*a*, and the second wet blank transfer mold 5*a* is flipping).

This embodiment is a simplified version of Embodiment 1. As shown in FIGS. 7A and 7, the wet blank flipping pulp molding machine in this embodiment contains only one hot-pressing shaping device. In this implementation, the wet blank flipping pulp molding machine includes a frame 1, a suction filtration forming device 2, a hot-pressing shaping device 3, a second wet blank transfer device 5, a first wet blank transfer device 7, a control system, and other components.

Because there is only one hot-pressing shaping device, there is no distinction between left and right hot-pressing shaping devices.

The first wet blank transfer device 7 transfers the wet blank made by the suction filtration forming device 2 to the second wet blank transfer device 5. After a 180-degree vertical flip by the second wet blank transfer device 5, the second wet blank transfer mold working surface 5M and the adhered wet blank face downwards, with the mesh surface of the wet blank facing up. The flipped wet blank is then sent into the hot-pressing shaping device for hot-press drying and shaping. This achieves the beneficial effect of matching the "mesh surface of the wet blank" with the "smooth surface of the hot-press mold".

The suction filtration forming mold 2*a* in the suction filtration forming device 2 forms the wet blank from the pulp slurry. The first wet blank transfer mold 7*a* extracts the wet blank from the suction filtration forming mold 2*a* and rises into position.

The complete implementation process of this embodiment is typically as follows:

(1) The second wet blank transfer mold 5*a*, which has had its wet blank transferred away, returns along the left-right translation rail 8 to a position below the first wet blank transfer mold 7*a*. The second wet blank transfer mold 5*a* flips 180 degrees vertically, with the second wet blank transfer mold working surface 5M facing towards the first wet blank transfer mold 7*a*. The first wet blank transfer mold 7*a* moves down to transfer the wet blank to the second wet blank transfer mold 5*a*, then moves back up to its original position. The second wet blank transfer mold 5*a* receives the wet blank, then flips 180 degrees vertically with the wet blank, making the second wet blank transfer mold working surface 5M and the adhered wet blank face downwards, with the mesh surface of the wet blank facing up.

Meanwhile, the lower hot-press mold 3*c* moves up to close with the upper hot-press mold 3*a* for hot-press drying and shaping of the previously received wet blank. After hot-press drying and shaping, the hot-press mold opens, and the pulp molded product is promptly removed from the pulp molding machine at the appropriate time.

(2) The second wet blank transfer mold 5*a*, with the wet blank facing down, moves again to a position above the vertically movable lower hot-press mold 3*c*. The lower hot-press mold 3*c* moves up to extract the wet blank from the second wet blank transfer mold 5*a*, then moves down into position. Simultaneously, the first wet blank transfer mold 7*a* moves down to the suction filtration forming device 2 to extract the wet blank from the suction filtration forming mold 2*a* and rises back into position.

(3) The second wet blank transfer mold 5*a*, which has had its wet blank transferred away, returns to a position below the first wet blank transfer mold 7*a*. The second wet blank transfer mold 5*a* flips 180 degrees vertically again, with the second wet blank transfer mold working surface 5M facing upwards towards the first wet blank transfer mold 7*a*. The first wet blank transfer mold 7*a* moves down again to transfer the wet blank to the second wet blank transfer mold 5*a*, then moves back up to its original position. The second wet blank transfer mold 5*a* receives another wet blank, then flips 180 degrees vertically with the wet blank, making the second wet blank transfer mold working surface 5M and the adhered wet blank face downwards, with the mesh surface of the wet blank facing up.

Meanwhile, the lower hot-press mold 3*c* moves up to close with the upper hot-press mold 3*a* for hot-press drying and shaping of the wet blank. After hot-press drying and shaping, the hot-press mold opens, and the pulp molded product is promptly removed from the pulp molding machine at the appropriate time.

The wet blank flipping pulp molding machine operates in a cyclic manner according to the above steps, continuously producing pulp molded products. Throughout the entire production process of pulp molded products, the wet blank made by the suction filtration forming mold 2*a* is taken by the first wet blank transfer mold 7*a* and sent to the second wet blank transfer mold 5*a*. It is then flipped 180 degrees vertically by the second wet blank transfer mold 5*a* before being sent to the hot-pressing shaping device for hot-press drying and shaping. This achieves the beneficial effect of matching the "mesh surface of the wet blank" with the "smooth surface of the hot-press mold". It also achieves the ideal processing effect of uniform product wall thickness and easy demolding, greatly improving the machine's operational stability and product quality. The pass rate is also significantly increased, and production costs can be substantially reduced.

Embodiment 3

In this embodiment, the hot-pressing shaping device 3 includes two hot-pressing shaping devices, namely the left hot-pressing shaping device 3L and the right hot-pressing shaping device 3R. The left lower hot-press mold 3Lc and right lower hot-press mold 3Rc can move horizontally. As shown in FIGS. 8, 9A, 9B, 10, 10A, 11, 12, and 13, the wet blank flipping pulp molding machine in this embodiment includes a frame 1, a suction filtration forming device 2, a hot-pressing shaping device 3 (left hot-pressing shaping device 3L, right hot-pressing shaping device 3R), a second wet blank transfer device 5, a first wet blank transfer device 7, a control system, and other components.

The frame 1 consists of a lower frame 1*a*, an upper frame 1*b*, tie rods 1*c*, and other components.

The suction filtration forming device 2 includes a suction filtration forming mold 2*a* and a suction filtration forming pulp tank 2*b*. The first wet blank transfer device 7 includes a first wet blank transfer mold 7*a* and a power transmission mechanism of first wet blank transfer mold 7*b*. The first wet blank transfer device 7 is positioned above the suction filtration forming device 2.

A mixture of plant fibers and water of appropriate concentration (referred to as pulp slurry) is intermittently or continuously injected into the suction filtration forming pulp tank 2*b*. The suction filtration forming mold 2*a* forms the wet blank from the pulp slurry. Various methods can be used to achieve the production of the wet blank.

The suction filtration forming mold 2*a* in the suction filtration forming device 2 forms the wet blank from the fibers in the pulp slurry. The first wet blank transfer mold 7*a* extracts the wet blank from the suction filtration forming mold 2*a* and rises into position, removing the wet blank from the suction filtration forming mold 2*a*. The wet blank is then hot-press dried and shaped in the hot-pressing shaping device 3.

The lower hot-press mold 3*c* includes the left lower hot-press mold 3Lc and the right lower hot-press mold 3Rc, while the upper hot-press mold 3*a* includes the left upper hot-press mold 3La and the right upper hot-press mold 3Ra.

As shown in FIGS. 8, 9A, 9B, 10, and 10A, two (or two sets of) left-right translation rails 8 are fixed to the lower frame, extending from the left end to the right end. Left-right translation rail sliders 9 that can slide along the rails are set on the left-right translation rails 8. From left to right, the left-right translation rails 8 span across the left hot-pressing shaping device 3L, the first wet blank transfer device 7, and the right hot-pressing shaping device 3R.

The left hot-pressing shaping device 3L contains a vertically movable left upper hot-press mold 3La and a horizontally movable left lower hot-press mold 3Lc. The left upper hot-press mold 3La and left lower hot-press mold 3Lc are a matching pair of left hot-press molds (left hot-pressing shaping molds). When the left lower hot-press mold 3Lc is below the left upper hot-press mold 3La, the left hot-pressing shaping molds can close vertically, and the wet blank of the product is hot-press dried and shaped in the left hot-pressing shaping device 3L. This position is called the left hot-pressing station 3L.1.

Figure 8:
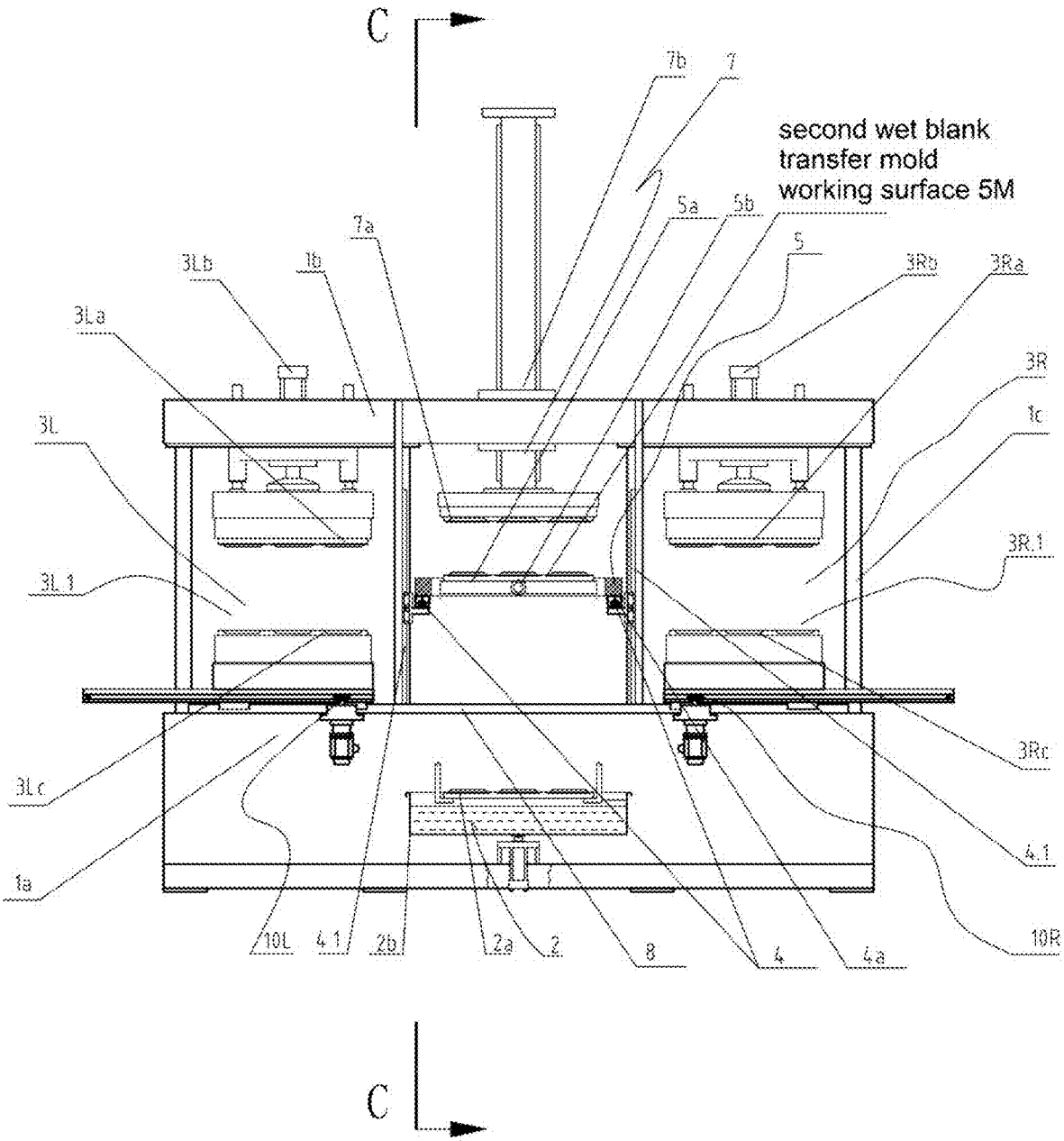
FIG. 8 is a front view structural diagram of Embodiment 3 of the "Wet Blank Flipping Pulp Molding Machine" (showing the state when the second wet blank transfer device 5 has moved under the first wet blank transfer mold 7*a*, with the working surface 5M of the second wet blank transfer mold facing up).
Figure 13:
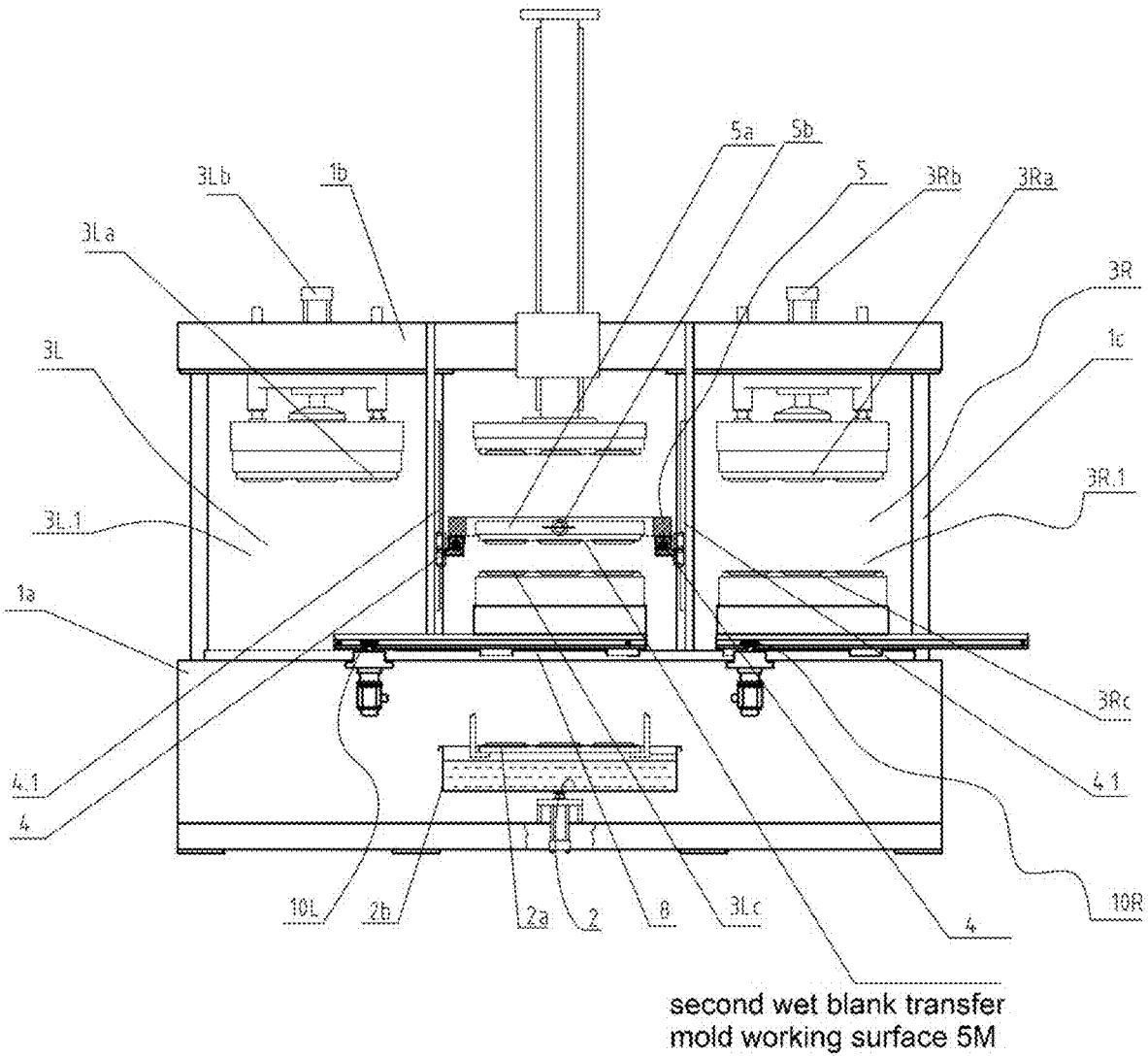
FIG. 13 is a front view structural diagram of Embodiment 3 of the "Wet Blank Flipping Pulp Molding Machine" (showing the state when the working surface 5M of the second wet blank transfer mold is facing down, and the left lower hot-press mold 3Lc has moved under the second wet blank transfer mold 5*a*).

As shown in FIGS. 8 and 13, the left lower hot-press mold 3Lc is fixed to the left-right translation rail sliders 9, which can move horizontally on the left-right translation rails 8. Driven by the left horizontal driving mechanism of lower hot-press mold 10L, the left lower hot-press mold 3Lc can move horizontally along the left-right translation rails 8 between positions below the left upper hot-press mold 3La and below the first wet blank transfer mold 7*a*.

The right hot-pressing shaping device 3R contains a vertically movable right upper hot-press mold 3Ra and a horizontally movable right lower hot-press mold 3Rc. The right upper hot-press mold 3Ra and right lower hot-press mold 3Rc are a matching pair of right hot-press molds (right hot-pressing shaping molds). When the right lower hot-press mold 3Rc is below the right upper hot-press mold 3Ra, the right hot-pressing shaping molds can close vertically, and the wet blank of the product is hot-press dried and shaped in the right hot-pressing shaping device 3R. This position is called the right hot-pressing station 3R.1.

As shown in FIG. 8, the right lower hot-press mold 3Rc is fixed to the left-right translation rail sliders 9, which can move horizontally on the left-right translation rails 8. Driven by the right horizontal driving mechanism of lower hot-press mold 10R, the right lower hot-press mold 3Rc can move horizontally along the left-right translation rails 8 between positions below the right upper hot-press mold 3Ra and below the first wet blank transfer mold 7*a*.

As shown in FIG. 8, there is a first wet blank transfer device 7 above the suction filtration forming device 2. The first wet blank transfer device 7 is fixed to the upper frame 1*b* and contains a vertically movable first wet blank transfer mold 7*a* and a power transmission mechanism of first wet blank transfer mold 7*b* that drives the vertical movement of the first wet blank transfer mold 7*a*. There are multiple structural options for the power transmission mechanism of first wet blank transfer mold 7*b*, with servo motor drive being preferred, though hydraulic cylinder drive or other drive methods are also possible.

The second wet blank transfer device 5 contains a second wet blank transfer mold 5*a* and a wet blank flipping driver 5*b*. As shown in FIGS. 8, 9A, 9B, 11, and 12, the second wet blank transfer mold 5*a* can perform a 180-degree vertical flip driven by the wet blank flipping driver 5*b*. There are multiple ways for the second wet blank transfer mold 5*a* to perform the 180-degree flip, it can rotate around an axis or flip without an axis. As a preferred solution, the 180-degree vertical flip of the second wet blank transfer mold 5*a* can be performed around an axis parallel to the horizontal plane, i.e., it can flip 180 degrees up and down around the axis, achieving the purpose of flipping the second wet blank transfer mold working surface 5M from facing up to facing down.

Figure 9A:
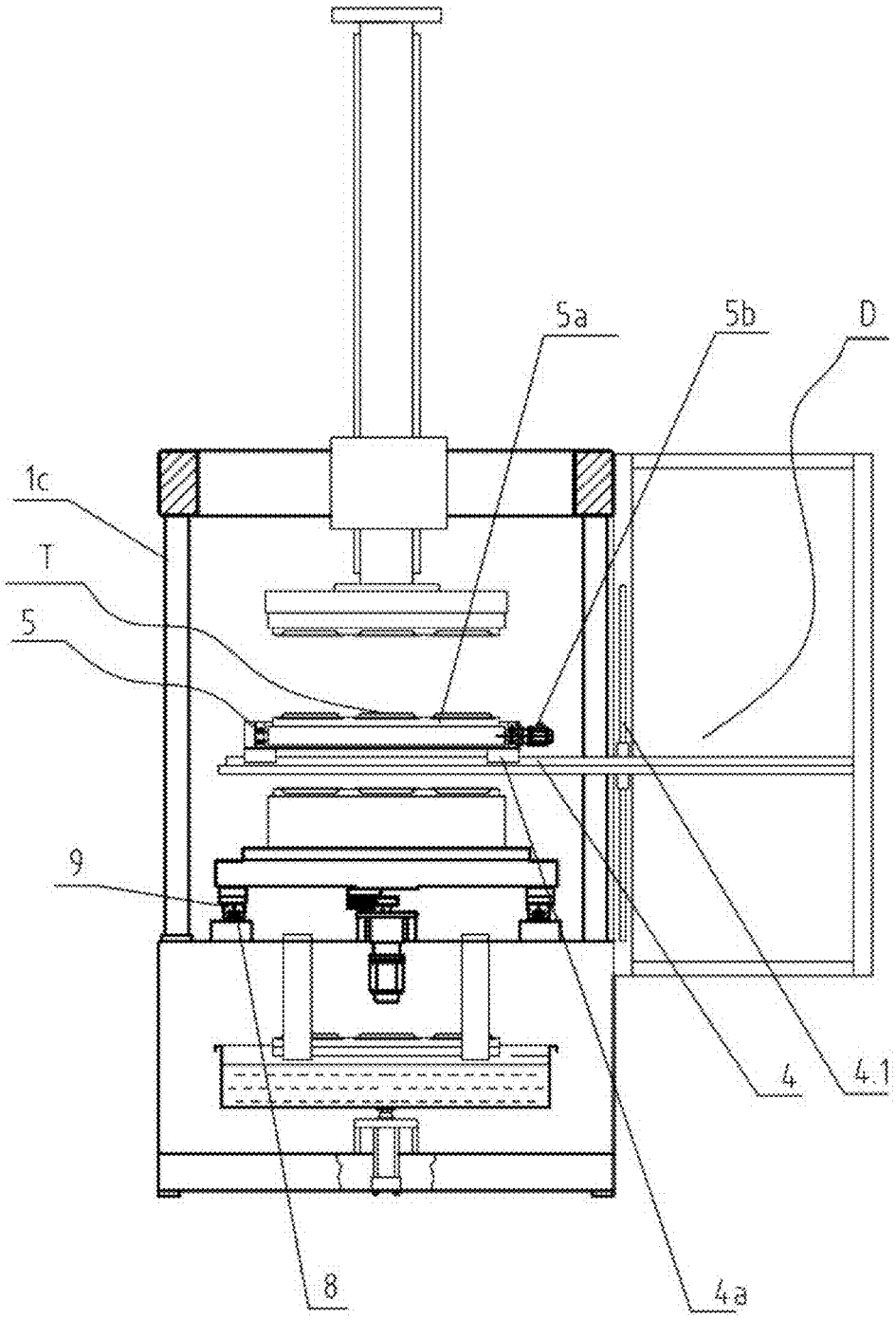
FIG. 9A is a C-C directional sectional view of FIG. 8, with the flipping mold 5*a* in the "T position".
Figure 9B:
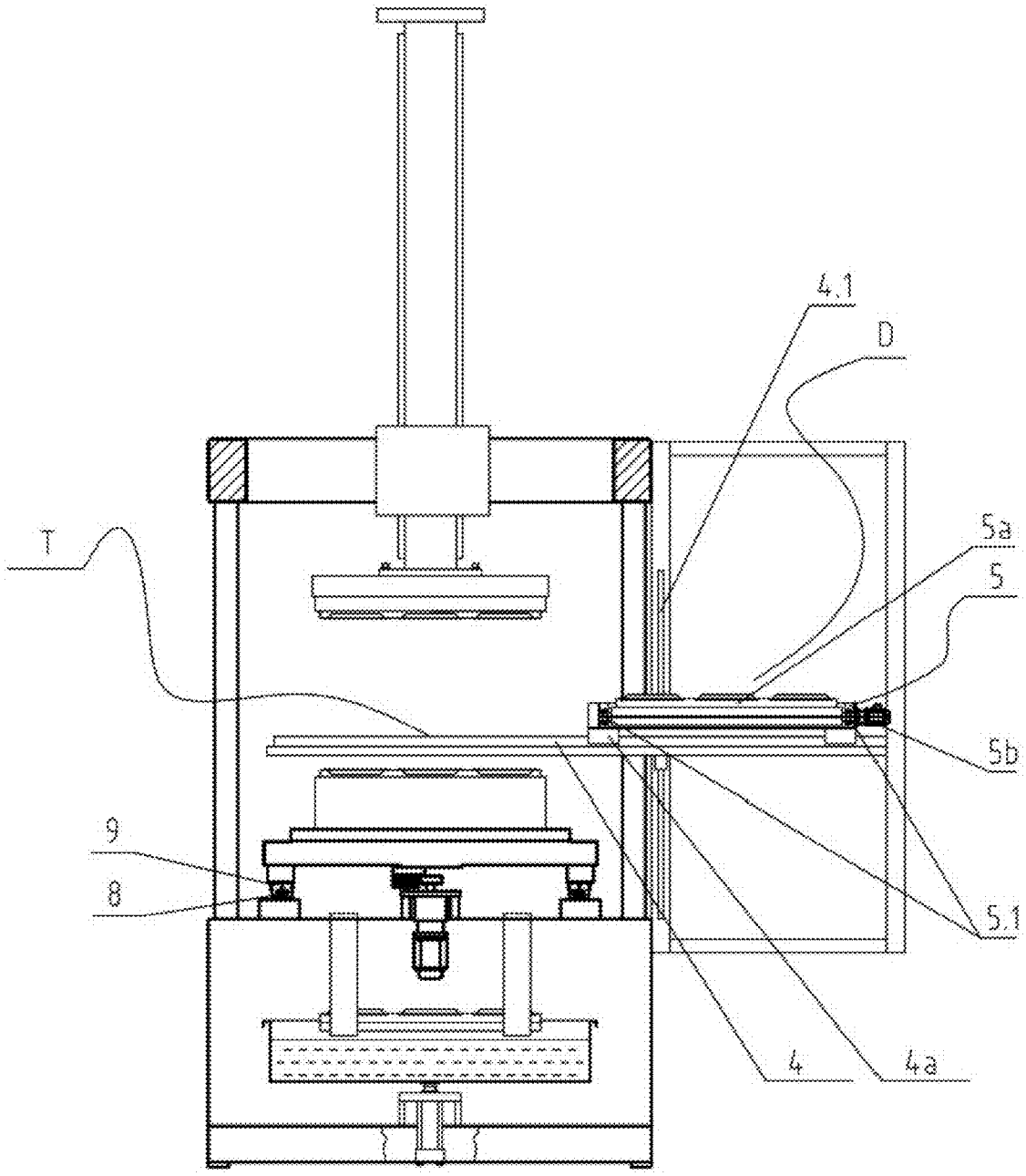
FIG. 9B is a C-C directional sectional view of FIG. 8, with the flipping mold 5*a* in the "D position".

As shown in FIGS. 8, 9A, and 9B, below the first wet blank transfer device 7, the second wet blank transfer device 5 receives the wet blank from the first wet blank transfer mold 7*a*. After flipping, the wet blank is also transferred to the left lower hot-press mold 3Lc or right lower hot-press mold 3Rc below the first wet blank transfer device 7. This position is called the transfer station T of the flipping mold 5*a* (also known as the "T position"). When the first wet blank transfer mold 7*a* needs to move down to extract the wet blank from the suction filtration forming mold 2*a*, the second wet blank transfer device 5 must clear the way by moving forward, leaving the T position to reach the avoidance station D of the flipping mold 5*a* (also known as the "D position") located in front of the first wet blank transfer device 7.

As shown in FIGS. 8, 9A, 9B, 10, and 10A, to the left of the first wet blank transfer device 7 is the left hot-pressing shaping device 3L, to the right is the right hot-pressing shaping device 3R, and in front of the first wet blank transfer device 7 is the avoidance station D of the flipping mold 5*a*.

As shown in FIGS. 8, 9A, 9B, and 10, as a preferred solution, two (or two sets of) longitudinal rails 4 are set in front of the first wet blank transfer device 7. The longitudinal rails 4 are horizontally arranged higher than the left-right translation rails 8 and perpendicular to them. The two (or two sets of) longitudinal rails 4 are set horizontally and extend towards the first wet blank transfer device 7. The second wet blank transfer device 5 is fixed to the longitudinal rail sliders 4*a*, which can move back and forth along the longitudinal rails 4. This means the second wet blank transfer device 5 can move between the T position and D position along the longitudinal rails 4. As shown in FIGS. 8 and 9A, vertical rails 4.1 are set up and down in front of the first wet blank transfer device 7, and the longitudinal rails 4 can move up and down along the vertical rails 4.1. Therefore, the second wet blank transfer mold 5*a* can flip up and down, and also move up and down and back and forth with the second wet blank transfer device 5.

Figure 10:
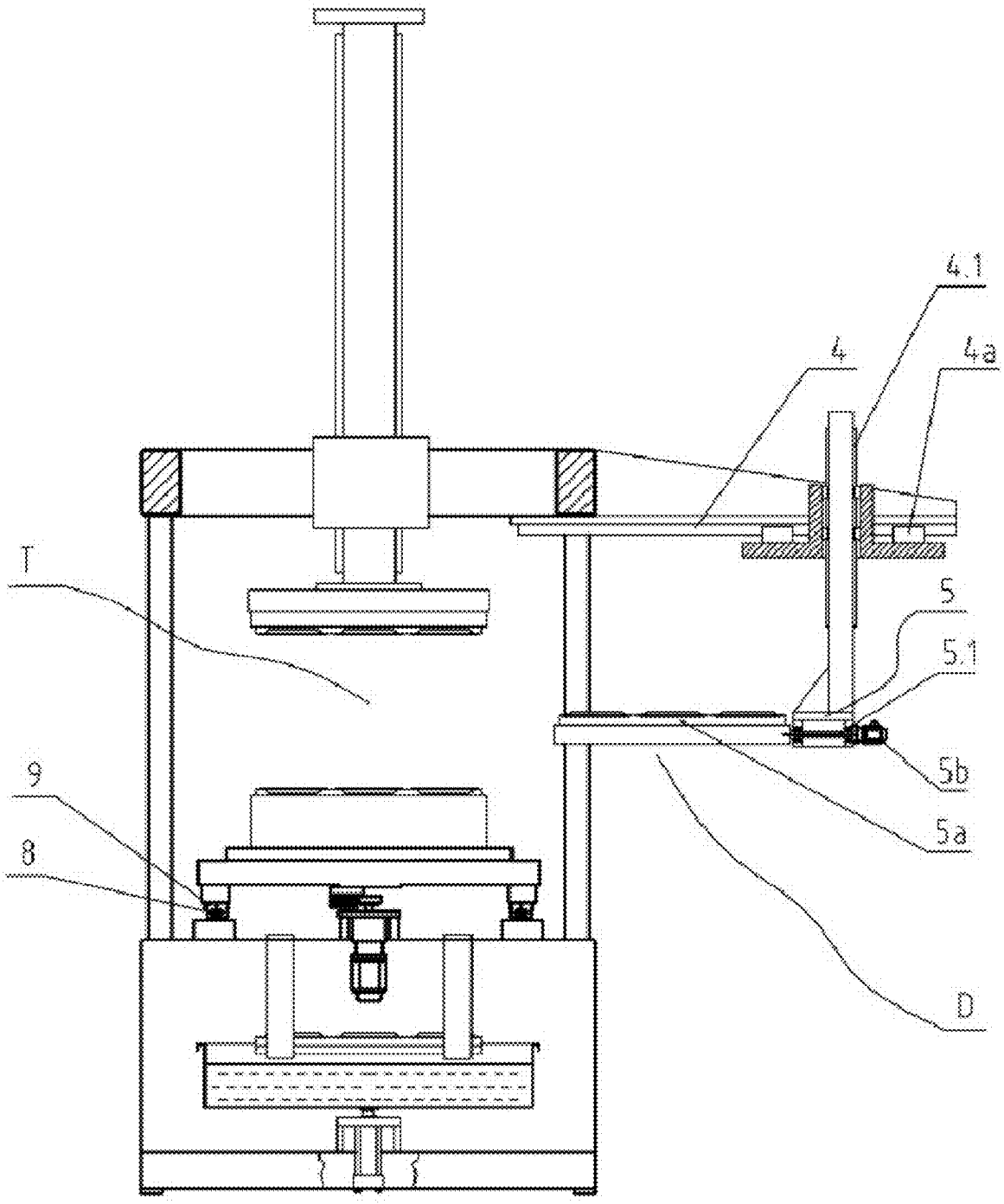
FIG. 10 is a side view structural diagram of Embodiment 3 of the "Wet Blank Flipping Pulp Molding Machine".
Figure 10A:
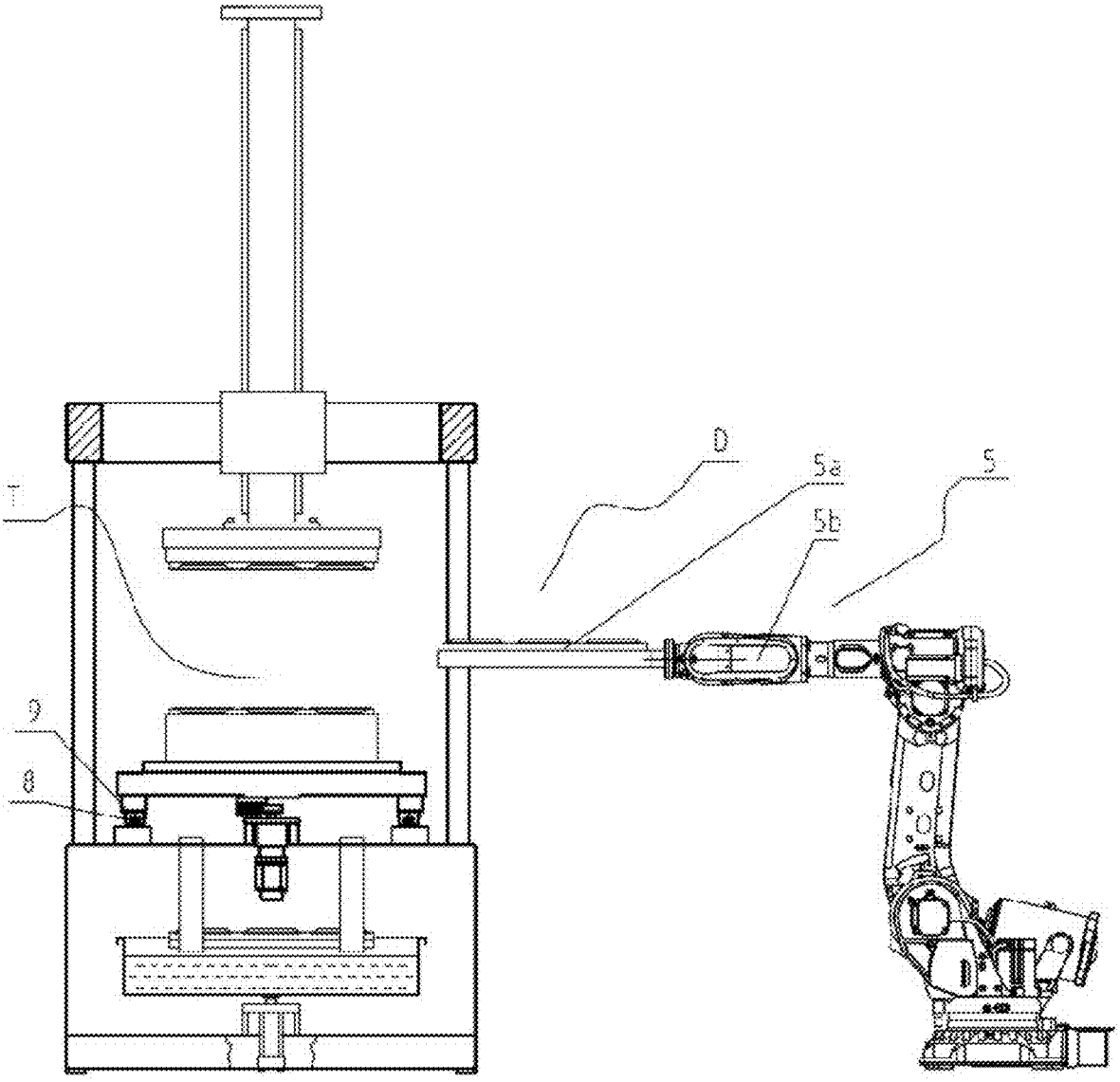
FIG. 10A is a side view structural diagram of Embodiment 3 of the "Wet Blank Flipping Pulp Molding Machine" (where the second wet blank transfer device 5 is a combination of a multi-degree-of-freedom robotic arm or mechanical arm with the second wet blank transfer mold 5*a*).
Figure 11:
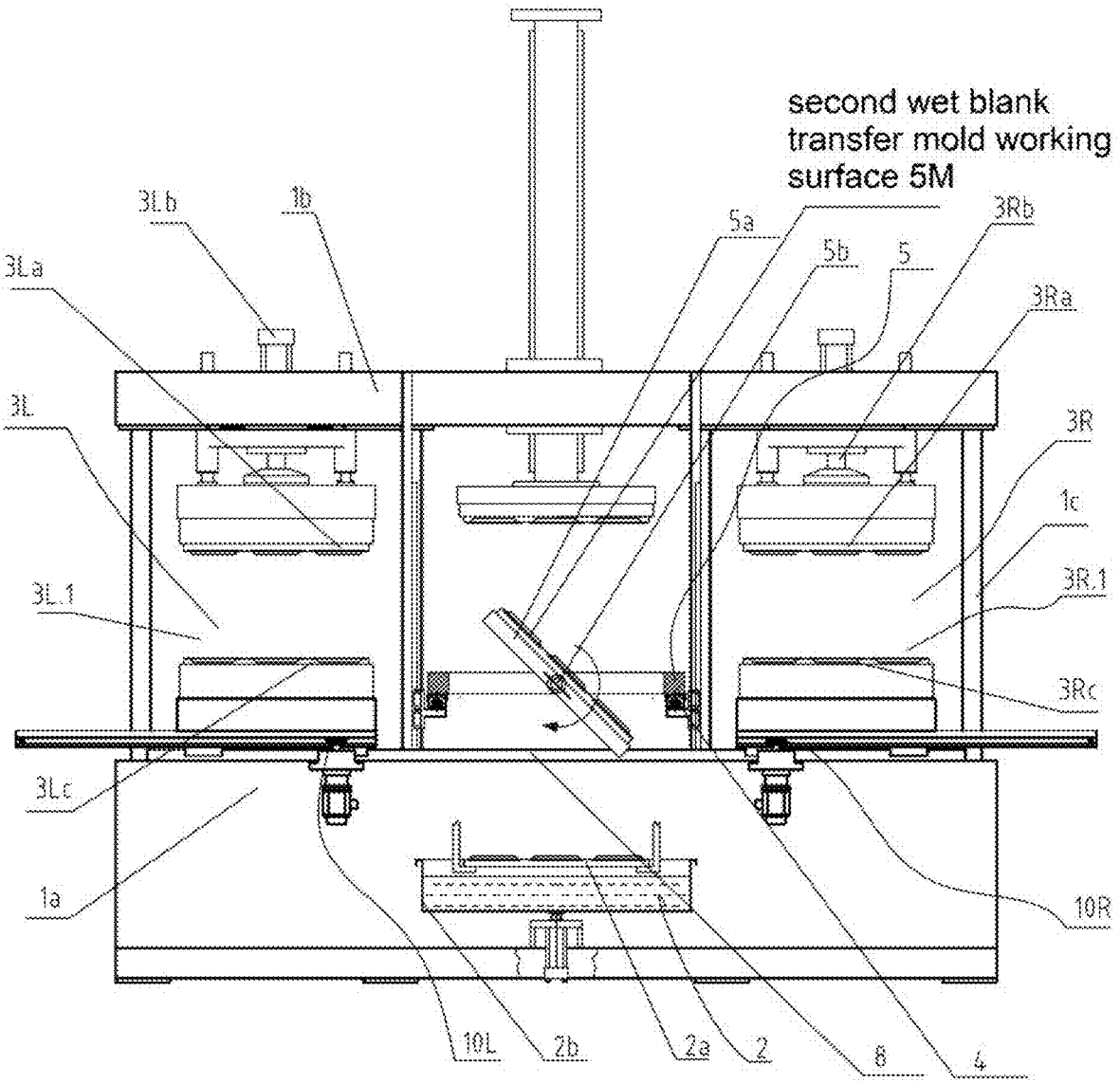
FIG. 11 is a front view structural diagram of Embodiment 3 of the "Wet Blank Flipping Pulp Molding Machine" (showing the state when the second wet blank transfer device 5 has moved under the first wet blank transfer mold 7*a*, and the second wet blank transfer mold 5*a* is flipping).
Figure 12:
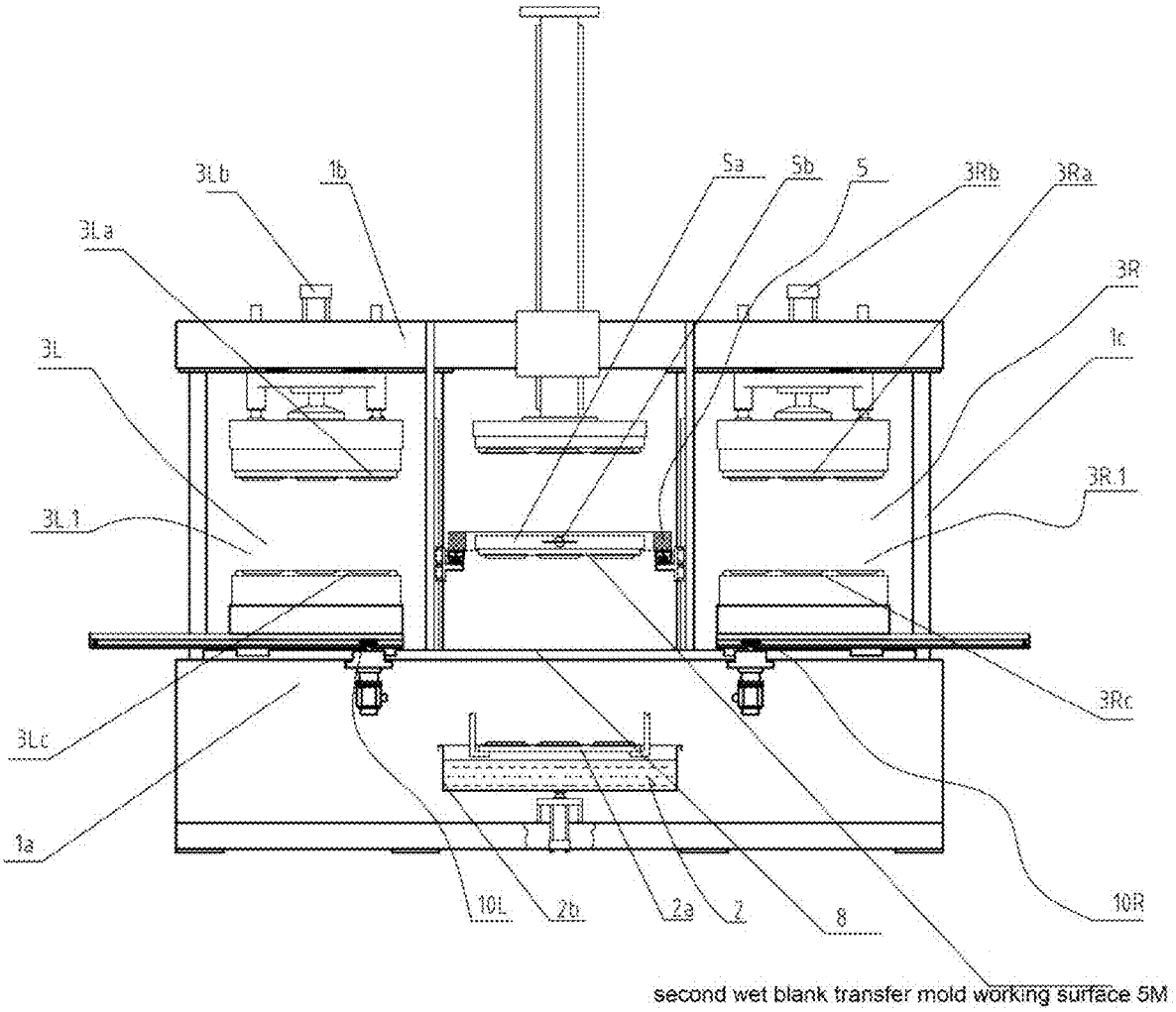
FIG. 12 is a front view structural diagram of Embodiment 3 of the "Wet Blank Flipping Pulp Molding Machine" (showing the state when the second wet blank transfer device 5 has moved under the first wet blank transfer mold 7*a*, with the working surface 5M of the second wet blank transfer mold facing down).

Alternatively, as shown in FIG. 10A, the second wet blank transfer device 5 can be a combination of a multi-degree-of-freedom robotic arm or mechanical arm with the second wet blank transfer mold 5*a*, capable of driving the second wet blank transfer mold 5*a* to flip up and down and move in three dimensions. The combination of a multi-degree-of-freedom robotic arm or mechanical arm with the second wet blank transfer mold 5*a* is also a structural form of the second wet blank transfer device 5, where the multi-degree-of-freedom robotic arm or mechanical arm drives the second wet blank transfer mold 5*a* to flip up and down and move in three dimensions. The multi-degree-of-freedom robotic arm or mechanical arm is a universal device that can rotate on multiple axes and move in three dimensions, such as a 6-axis robotic arm or mechanical arm.

The left lower hot-press mold 3Lc, right lower hot-press mold 3Rc, second wet blank transfer device 5, and first wet blank transfer device 7 work together to achieve the flipping and transfer of the wet blank.

To avoid action conflicts, after receiving the wet blank from the second wet blank transfer mold 5*a*, the left lower hot-press mold 3Lc and right lower hot-press mold 3Rc each return to their respective left hot-pressing station and right hot-pressing station. After receiving the wet blank from the first wet blank transfer mold 7*a*, the second wet blank transfer mold 5*a* must first move from the T position to the D position to avoid interference, and then flip the wet blank 180 degrees vertically at the D position. At this time, the first wet blank transfer mold 7*a* can extract the wet blank from the suction filtration forming mold 2*a*.

As shown in FIG. 13, after the first wet blank transfer mold 7*a* extracts the wet blank from the suction filtration forming mold 2*a* and rises into position, the left lower hot-press mold 3Lc or right lower hot-press mold 3Rc moves along the left-right translation rail 8 to a position below the first wet blank transfer mold 7*a*. Simultaneously, the second wet blank transfer mold 5*a* moves back from the D position to the T position, also coming below the first wet blank transfer mold 7*a* and positioning itself above the left lower hot-press mold 3Lc or right lower hot-press mold 3Rc that has already moved below the first wet blank transfer mold 7*a* along the left-right translation rail 8. The second wet blank transfer mold working surface 5M and the adhered wet blank face downwards. The second wet blank transfer mold 5*a* moves down with the wet blank, transferring it to the left lower hot-press mold 3Lc or right lower hot-press mold 3Rc. After the left lower hot-press mold 3Lc or right lower hot-press mold 3Rc returns to the left hot-pressing station or right hot-pressing station with the wet blank, the second wet blank transfer mold 5*a* flips 180 degrees vertically at the T position, with its working surface 5M facing upwards. The second wet blank transfer mold 5*a* then moves up to receive the wet blank from the first wet blank transfer mold 7*a*. After receiving the wet blank from the first wet blank transfer mold 7*a*, the second wet blank transfer mold 5*a* moves from the T position to the D position to avoid interference, and then flips the wet blank 180 degrees vertically at the D position.

After receiving the wet blank from the second wet blank transfer mold 5*a*, the left lower hot-press mold 3Lc returns to the left hot-pressing station 3L.1, positioned below the left upper hot-press mold 3La. The left upper hot-press mold 3La moves down, driven by the left upper hot-press mold driving device 3Lb, to close with the left lower hot-press mold 3Lc. The left hot-press mold then performs hot-press drying and shaping on the wet blank.

After receiving the wet blank from the second wet blank transfer mold 5*a*, the right lower hot-press mold 3Rc returns to the right hot-pressing station 3R.1, positioned below the right upper hot-press mold 3Ra. The right upper hot-press mold 3Ra moves down, driven by the right upper hot-press mold driving device 3Rb, to close with the right lower hot-press mold 3Rc. The right hot-press mold then performs hot-press drying and shaping on the wet blank.

The pulp slurry of appropriate concentration in the suction filtration forming pulp tank forms a wet blank in the suction filtration forming mold 2*a*. When the wet blank formation is complete, the first wet blank transfer mold 7*a* moves down to the suction filtration forming mold 2*a*, extracts the wet blank from the suction filtration forming mold 2*a*, and rises into position (completing the wet blank extraction). After the formed wet blank is removed, the suction filtration forming mold continues to filter the pulp slurry to form a new wet blank and waits for the next extraction by the first wet blank transfer mold.

Above the left-right translation rail 8 and in front of the first wet blank transfer device 7, two (or two sets of) longitudinal rails 4 are set up. The longitudinal rails 4 are horizontally arranged higher than the left-right translation rails 8, extend horizontally towards the first wet blank transfer device 7, and are perpendicular to the left-right translation rails 8.

In summary, the complete implementation process of this embodiment is typically as follows:

(1) The second wet blank transfer mold working surface 5M below the first wet blank transfer mold 7*a* faces upwards towards the first wet blank transfer mold 7*a*. The second wet blank transfer mold 5*a* moves up (or the first wet blank transfer mold 7*a* moves down), the first wet blank transfer mold 7*a* and second wet blank transfer mold 5*a* close together, and the first wet blank transfer mold 7*a* transfers the wet blank to the second wet blank transfer mold 5*a*. The second wet blank transfer mold 5*a* and first wet blank transfer mold 7*a* then separate, the second wet blank transfer mold 5*a* moves down (or the first wet blank transfer mold 7*a* moves up), and the second wet blank transfer mold 5*a* receives the wet blank. At this point, the second wet blank transfer mold working surface 5M and the wet blank are facing upwards.

(2) After receiving the wet blank, the second wet blank transfer mold 5*a* moves from the transfer station T of the flipping mold 5*a* to the avoidance station D of the flipping mold 5*a*. The second wet blank transfer mold 5*a* then flips 180 degrees vertically with the wet blank, making the second wet blank transfer mold working surface 5M and the adhered wet blank face downwards. Meanwhile, the first wet blank transfer mold 7*a* moves down to extract another wet blank from the suction filtration forming mold 2*a* and rises back into position.

(3) The left lower hot-press mold 3Lc and right lower hot-press mold 3Rc, each driven by their respective power sources, alternately move along the left-right translation rail 8 to a position below the first wet blank transfer mold 7*a*. Simultaneously, the second wet blank transfer mold 5*a* moves back from the avoidance station D of the flipping mold 5*a* to the transfer station T of the flipping mold 5*a*. At the T position, the second wet blank transfer mold 5*a* moves down with the wet blank to the left lower hot-press mold 3Lc or right lower hot-press mold 3Rc, transfers the wet blank to the left lower hot-press mold 3Lc or right lower hot-press mold 3Rc, and then moves back up to its original position.

(4) After receiving the wet blank, the left lower hot-press mold or right lower hot-press mold returns to the left hot-pressing station 3L.1 or right hot-pressing station 3R.1 driven by the power transmission mechanism. The hot-press mold closes to perform hot-press drying and shaping on the wet blank. After hot-press drying and shaping, the hot-press mold opens, and the pulp molded product is promptly removed from the pulp molding machine at the appropriate time. Meanwhile, the second wet blank transfer mold 5*a*, which has had its wet blank transferred away, flips 180 degrees vertically at the transfer station T of the flipping mold 5*a*, making the second wet blank transfer mold working surface 5M face upwards towards the first wet blank transfer mold 7*a*.

(5) The second wet blank transfer mold working surface 5M below the first wet blank transfer mold 7*a* faces towards the first wet blank transfer mold 7*a*. The second wet blank transfer mold 5*a* moves up (or the first wet blank transfer mold 7*a* moves down), the first wet blank transfer mold 7*a* and second wet blank transfer mold 5*a* close together, and the first wet blank transfer mold 7*a* transfers the wet blank to the second wet blank transfer mold 5*a*. The second wet blank transfer mold 5*a* and first wet blank transfer mold 7*a* then separate, the second wet blank transfer mold 5*a* moves down (or the first wet blank transfer mold 7*a* moves up), and the second wet blank transfer mold 5*a* receives the wet blank. At this point, the second wet blank transfer mold working surface 5M and the wet blank are facing upwards.

(6) After receiving the wet blank, the second wet blank transfer mold 5*a* moves from the transfer station T of the flipping mold 5*a* to the avoidance station D of the flipping mold 5*a*. At the D position, the second wet blank transfer mold 5*a* flips 180 degrees vertically with the wet blank, making the second wet blank transfer mold working surface 5M and the adhered wet blank face downwards. Meanwhile, the first wet blank transfer mold 7*a* moves down to extract another wet blank from the suction filtration forming mold 2*a* and rises back into position.

(7) The left lower hot-press mold 3Lc and right lower hot-press mold 3Rc, each driven by their respective power sources, alternately move along the left-right translation rail 8 to a position below the first wet blank transfer mold 7*a*. Simultaneously, the second wet blank transfer mold 5*a* moves back from the D position to the T position. At the T position, the second wet blank transfer mold 5*a* moves down with the wet blank to the left lower hot-press mold 3Lc or right lower hot-press mold 3Rc, transfers the wet blank to the left lower hot-press mold 3Lc or right lower hot-press mold 3Rc, and then moves back up to its original position.

(8) After receiving the wet blank, the left lower hot-press mold or right lower hot-press mold returns to the left hot-pressing station 3L.1 or right hot-pressing station 3R.1 driven by the power transmission mechanism. The hot-press mold closes to perform hot-press drying and shaping on the wet blank. After hot-press drying and shaping, the hot-press mold opens, and the pulp molded product is promptly removed from the pulp molding machine at the appropriate time. Meanwhile, the second wet blank transfer mold 5*a*, which has had its wet blank transferred away, flips 180 degrees vertically at the transfer station T of the flipping mold 5*a*, making the second wet blank transfer mold working surface 5M face upwards towards the first wet blank transfer mold 7*a*.

(9) The second wet blank transfer mold working surface 5M below the first wet blank transfer mold 7*a* faces towards the first wet blank transfer mold 7*a*. The second wet blank transfer mold 5*a* moves up (or the first wet blank transfer mold 7*a* moves down), the first wet blank transfer mold 7*a* and second wet blank transfer mold 5*a* close together, and the first wet blank transfer mold 7*a* transfers the wet blank to the second wet blank transfer mold 5*a*. The second wet blank transfer mold 5*a* and first wet blank transfer mold 7*a* then separate, the second wet blank transfer mold 5*a* moves down (or the first wet blank transfer mold 7*a* moves up), and the second wet blank transfer mold 5*a* receives the wet blank. At this point, the second wet blank transfer mold working surface 5M and the wet blank are facing upwards.

(10) After receiving the wet blank, the second wet blank transfer mold 5*a* moves from the transfer station T of the flipping mold 5*a* to the avoidance station D of the flipping mold 5*a*. At the D position, the second wet blank transfer mold 5*a* flips 180 degrees vertically with the wet blank, making the second wet blank transfer mold working surface 5M and the adhered wet blank face downwards. Meanwhile, the first wet blank transfer mold 7*a* moves down to extract another wet blank from the suction filtration forming mold 2*a* and rises back into position.

The production continues in a cyclic manner according to the above process. Pulp molded products are continuously produced and promptly removed from the pulp molding machine or moved to the next process. The key feature is that the transfer of the wet blank from the first wet blank transfer mold (7*a*) to the second wet blank transfer mold 5*a*, and the transfer of the flipped wet blank from the second wet blank transfer mold (5*a*) to the lower hot-press mold (3*c*) are both completed directly below the first wet blank transfer mold (7*a*).

Throughout the entire production process of pulp molded products, the wet blank made by the suction filtration forming mold 2*a* is extracted when the first wet blank transfer mold 7*a* moves down to the suction filtration forming mold 2*a*, picks up the wet blank (extracts the wet blank) and rises back into position. The left lower hot-press mold 3Lc and right lower hot-press mold 3Rc alternately move along the left-right translation rail 8 to a position below the first wet blank transfer mold 7*a* to receive the wet blank. These are all existing technologies.

The key feature of this embodiment is: The left lower hot-press mold 3Lc and right lower hot-press mold 3Rc alternately move along the left-right translation rail 8 to a position below the first wet blank transfer mold 7*a* to receive the wet blank, but they do not receive the wet blank directly from the first wet blank transfer mold 7*a*. Instead, they receive the flipped wet blank from the second wet blank transfer mold 5*a*. After taking the wet blank from below the first wet blank transfer mold 7*a*, the second wet blank transfer mold 5*a* moves out from under the first wet blank transfer mold 7*a* to the D position, where it flips 180 degrees vertically with the wet blank. It then returns to the position below the first wet blank transfer mold 7*a* with the flipped wet blank. As shown in FIG. 13, when the second wet blank transfer mold 5*a* returns to the position below the first wet blank transfer mold 7*a* after flipping with the wet blank, it is also positioned above the left lower hot-press mold 3Lc or right lower hot-press mold 3Rc. At this point, the first wet blank transfer mold 7*a* moves down, transfers the flipped wet blank to the left lower hot-press mold 3Lc or right lower hot-press mold 3Rc, and then moves back up into position. After receiving the wet blank, the left lower hot-press mold or right lower hot-press mold returns to the left hot-pressing station 3L.1 or right hot-pressing station 3R.1, where the left hot-pressing shaping device and right hot-pressing shaping device perform hot-press drying and shaping on the wet blank. This achieves the effect of matching the "mesh surface of the wet blank" with the "smooth surface of the hot-press mold".

During the hot-press drying and shaping of the wet blank in the hot-pressing shaping device, the "smooth surface of the hot-press mold" presses against the dense, smooth, and high-quality "mesh surface of the wet blank", while the "mesh surface of the hot-press mold", which has some flexibility and can easily press against all parts of the wet blank, presses against the "fuzzy surface of the wet blank". The smooth surface of the hot-press mold can press the product very smooth, while the fuzzy surface of the wet blank is easily imprinted with a dense mesh pattern by the mesh surface of the hot-press mold. As a result, both sides of the product achieve excellent processing effects, reducing the production difficulty of pulp molded products, especially high-quality, delicate industrial packaging products. It also achieves the ideal processing effect of uniform product wall thickness and easy demolding. The machine's operational stability and product quality are greatly improved, the pass rate is significantly increased, and production costs can be substantially reduced.

Embodiment 4

Figure 14:
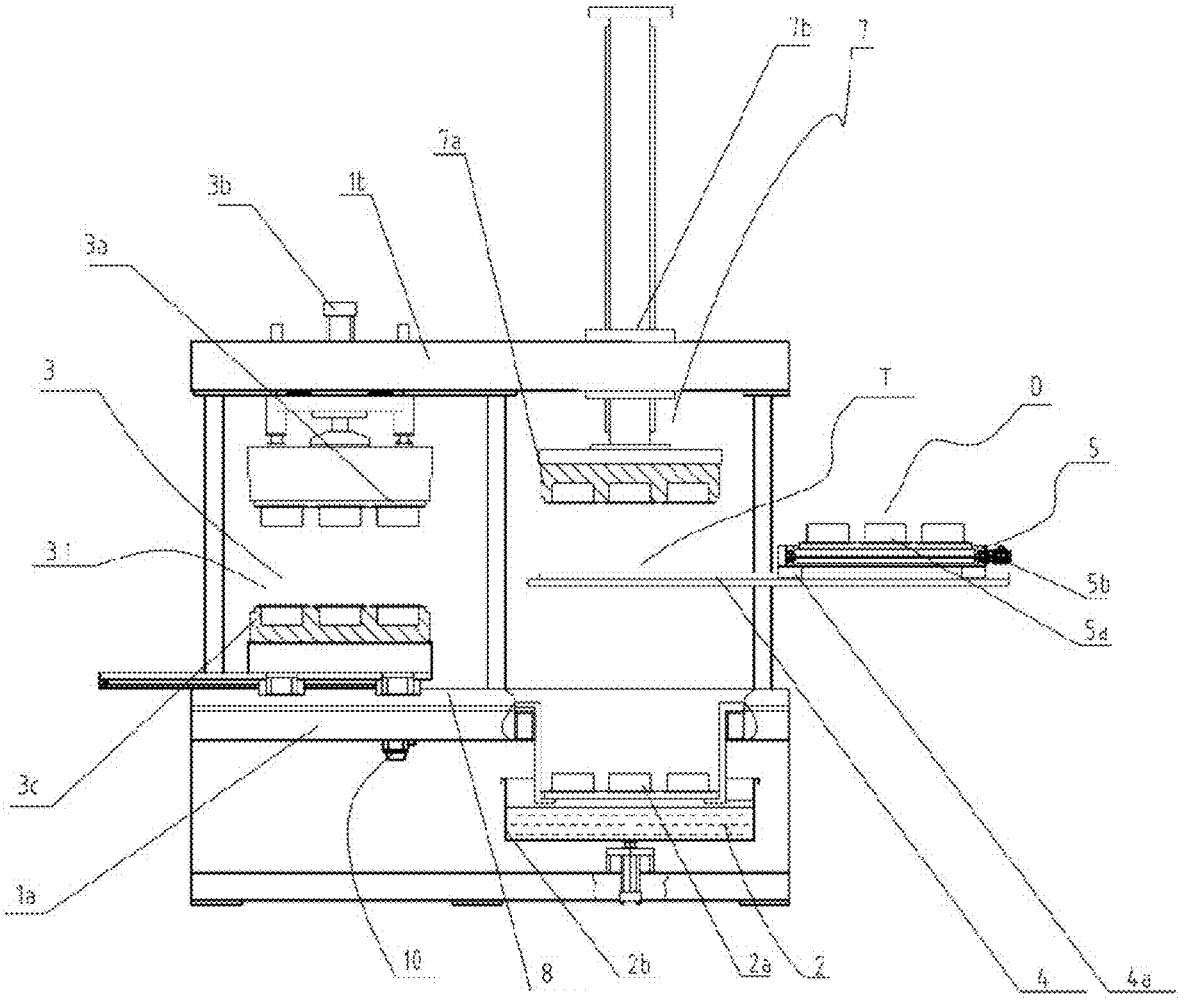
FIG. 14 is a front view structural diagram of Embodiment 4 of the "Wet Blank Flipping Pulp Molding Machine".

As shown in FIG. 14, this embodiment is a simplified version of Embodiment 3. The hot-pressing shaping device 3 contains only one hot-pressing shaping device, and the lower hot-press mold moves horizontally. The wet blank flipping pulp molding machine in this embodiment includes a frame 1, a suction filtration forming device 2, a hot-pressing shaping device 3, a second wet blank transfer device 5, a first wet blank transfer device 7, and other components. Since this embodiment has only one hot-pressing shaping device, the avoidance station D of the flipping mold 5*a* can also be placed on the right side of the first wet blank transfer device 7.

Because there is only one hot-pressing shaping device, there is no distinction between left and right hot-pressing shaping devices. The lower hot-press mold 3*c* can move horizontally along the left-right translation rail 8 between positions directly below the upper hot-press mold 3*a* and directly below the first wet blank transfer mold 7*a*. Above the left-right translation rail 8 and in front of or to the right of the first wet blank transfer device 7, two (or two sets of) longitudinal rails 4 are set up. The longitudinal rails 4 are horizontally arranged higher than the left-right translation rails 8 and perpendicular to them. The two (or two sets of) longitudinal rails 4 are set horizontally and extend towards the first wet blank transfer device 7.

The complete implementation process of this embodiment is typically as follows:

(1) The second wet blank transfer mold working surface 5M below the first wet blank transfer mold 7*a* faces upwards towards the first wet blank transfer mold 7*a*. The second wet blank transfer mold 5*a* moves up (or the first wet blank transfer mold 7*a* moves down), the first wet blank transfer mold 7*a* and second wet blank transfer mold 5*a* close together, and the first wet blank transfer mold 7*a* transfers the wet blank to the second wet blank transfer mold 5*a*. The second wet blank transfer mold 5*a* and first wet blank transfer mold 7*a* then separate, the second wet blank transfer mold 5*a* moves down (or the first wet blank transfer mold 7*a* moves up), and the second wet blank transfer mold 5*a* receives the wet blank. At this point, the second wet blank transfer mold working surface 5M and the wet blank are facing upwards.

(2) After receiving the wet blank, the second wet blank transfer mold 5*a* moves from the transfer station T of the flipping mold 5*a* to the avoidance station D of the flipping mold 5*a*. The second wet blank transfer mold 5*a* then flips 180 degrees vertically with the wet blank, making the second wet blank transfer mold working surface 5M and the adhered wet blank face downwards. Meanwhile, the first wet blank transfer mold 7*a* moves down to extract another wet blank from the suction filtration forming mold 2*a* and rises back into position.

(3) The lower hot-press mold 3*c*, driven by its power source, moves along the left-right translation rail 8 to a position below the first wet blank transfer mold 7*a*. Simultaneously, the second wet blank transfer mold 5*a* moves back from the avoidance station D of the flipping mold 5*a* to the transfer station T of the flipping mold 5*a*. At the T position, the second wet blank transfer mold 5*a* moves down with the wet blank to the lower hot-press mold 3*c*, transfers the wet blank to the lower hot-press mold 3*c*, and then moves back up to its original position.

(4) After receiving the wet blank, the lower hot-press mold returns to the hot-pressing station 3.1 driven by the power transmission mechanism. The hot-press mold closes to perform hot-press drying and shaping on the wet blank. After hot-press drying and shaping, the hot-press mold opens, and the pulp molded product is promptly removed from the pulp molding machine at the appropriate time. Meanwhile, the second wet blank transfer mold 5*a*, which has had its wet blank transferred away, flips 180 degrees vertically at the transfer station T of the flipping mold 5*a*, making the second wet blank transfer mold working surface 5M face upwards towards the first wet blank transfer mold 7*a*.

(5) The second wet blank transfer mold working surface 5M below the first wet blank transfer mold 7*a* faces towards the first wet blank transfer mold 7*a*. The second wet blank transfer mold 5*a* moves up (or the first wet blank transfer mold 7*a* moves down), the first wet blank transfer mold 7*a* and second wet blank transfer mold 5*a* close together, and the first wet blank transfer mold 7*a* transfers the wet blank to the second wet blank transfer mold 5*a*. The second wet blank transfer mold 5*a* and first wet blank transfer mold 7*a* then separate, the second wet blank transfer mold 5*a* moves down (or the first wet blank transfer mold 7*a* moves up), and the second wet blank transfer mold 5*a* receives the wet blank. At this point, the second wet blank transfer mold working surface 5M and the wet blank are facing upwards.

(6) After receiving the wet blank, the second wet blank transfer mold 5*a* moves from the transfer station T of the flipping mold 5*a* to the avoidance station D of the flipping mold 5*a*. At the D position, the second wet blank transfer mold 5*a* flips 180 degrees vertically with the wet blank, making the second wet blank transfer mold working surface 5M and the adhered wet blank face downwards. Meanwhile, the first wet blank transfer mold 7*a* moves down to extract another wet blank from the suction filtration forming mold 2*a* and rises back into position.

The production continues in a cyclic manner according to the above process. Pulp molded products are continuously produced and promptly removed from the pulp molding machine or moved to the next process. The key feature is that the transfer of the wet blank from the first wet blank transfer mold (7*a*) to the second wet blank transfer mold 5*a*, and the transfer of the flipped wet blank from the second wet blank transfer mold (5*a*) to the lower hot-press mold (3*c*) are both completed directly below the first wet blank transfer mold (7*a*).

Throughout the entire production process of pulp molded products, the wet blank made by the suction filtration forming mold 2*a* is taken by the first wet blank transfer mold 7*a* and sent to the second wet blank transfer mold 5*a*. It is then flipped 180 degrees vertically by the second wet blank transfer mold 5*a* before being sent into the lower hot-press mold. After receiving the wet blank, the lower hot-press mold returns to the hot-pressing station 3.1 driven by the power transmission mechanism. The hot-pressing shaping device then performs hot-press drying and shaping on the wet blank. This achieves the effect of matching the "mesh surface of the wet blank" with the "smooth surface of the hot-press mold".

During the hot-press drying and shaping of the wet blank in the hot-pressing shaping device, the "smooth surface of the hot-press mold" presses against the dense, smooth, and high-quality "mesh surface of the wet blank", while the "mesh surface of the hot-press mold", which has some flexibility and can easily press against all parts of the wet blank, presses against the "fuzzy surface of the wet blank". The smooth surface of the hot-press mold can press the product very smooth, while the fuzzy surface of the wet blank is easily imprinted with a dense mesh pattern by the mesh surface of the hot-press mold. As a result, both sides of the product achieve excellent processing effects, reducing the production difficulty of pulp molded products, especially high-quality, delicate industrial packaging products. It also achieves the ideal processing effect of uniform product wall thickness and easy demolding. The machine's operational stability and product quality are greatly improved, the pass rate is significantly increased, and production costs can be substantially reduced.

Embodiment 5

Figure 15:
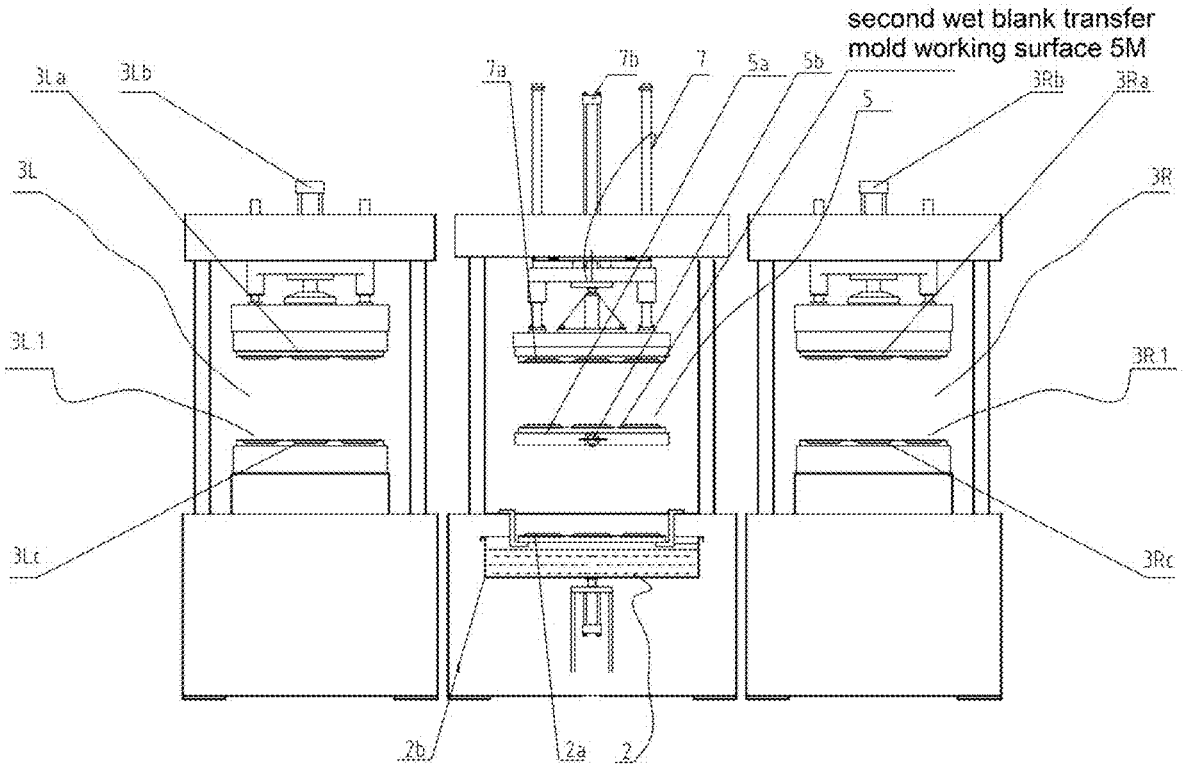
FIG. 15 is a front view structural diagram of Embodiment 5 of the "Wet Blank Flipping Pulp Molding Machine", and also a D-D directional sectional view of FIG. 16.
Figure 16:
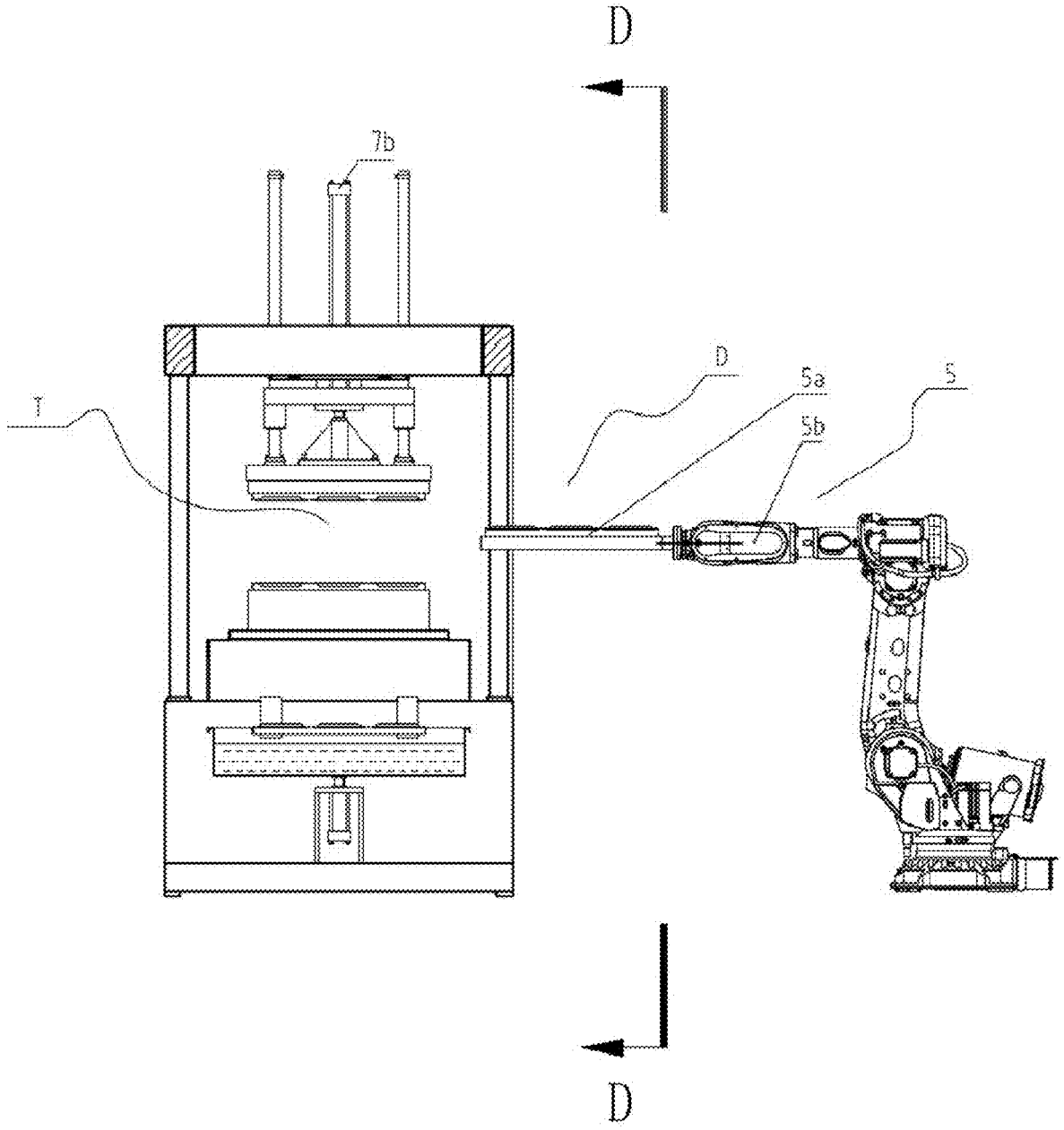
FIG. 16 is a side view structural diagram of Embodiment 5 of the "Wet Blank Flipping Pulp Molding Machine".

In this embodiment, the hot-pressing shaping device 3 includes two hot-pressing shaping devices, namely the left hot-pressing shaping device 3L and the right hot-pressing shaping device 3R. As shown in FIGS. 15 and 16, the wet blank flipping pulp molding machine includes a suction filtration forming device 2, a hot-pressing shaping device 3 (left hot-pressing shaping device 3L, right hot-pressing shaping device 3R), a second wet blank transfer device 5, a first wet blank transfer device 7, a control system, and other components.

The suction filtration forming device 2 and the first wet blank transfer device 7 share an independent frame, with the first wet blank transfer device 7 positioned above the suction filtration forming device 2. The suction filtration forming device 2 contains a suction filtration forming mold 2*a* and a suction filtration forming pulp tank 2*b*; the first wet blank transfer device 7 contains a first wet blank transfer mold 7*a* and a power transmission mechanism of first wet blank transfer mold 7*b*.

The suction filtration forming mold 2*a* in the suction filtration forming device 2 forms the wet blank from the fibers in the pulp slurry; the first wet blank transfer mold 7*a* extracts the wet blank from the suction filtration forming mold 2*a* and rises into position, removing the wet blank from the suction filtration forming mold 2*a*.

The hot-pressing shaping device 3 includes a left hot-pressing shaping device 3L and a right hot-pressing shaping device 3R, where the wet blank of the product is hot-press dried and shaped. The left hot-pressing shaping device 3L and right hot-pressing shaping device 3R each have their own independent frames.

The lower hot-press mold 3*c* includes the left lower hot-press mold 3Lc and right lower hot-press mold 3Rc, while the upper hot-press mold 3*a* includes the left upper hot-press mold 3La and right upper hot-press mold 3Ra.

The left hot-pressing shaping device 3L contains a vertically movable left upper hot-press mold 3La and a fixed left lower hot-press mold 3Lc. The left upper hot-press mold 3La and left lower hot-press mold 3Lc are a matching pair of hot-press molds, called the left hot-pressing shaping mold (left hot-press mold). The left hot-pressing shaping mold can close vertically, and the wet blank of the product is hot-press dried and shaped in the left hot-pressing shaping device 3L.

The left lower hot-press mold 3Lc is fixed to the frame of the left hot-press clamping device.

The right hot-pressing shaping device 3R contains a vertically movable right upper hot-press mold 3Ra and a fixed right lower hot-press mold 3Rc. The right upper hot-press mold 3Ra and right lower hot-press mold 3Rc are a matching pair of right hot-press molds, called the right hot-pressing shaping mold. The right hot-pressing shaping mold can close vertically, and the wet blank of the product is hot-press dried and shaped in the right hot-pressing shaping device 3R.

The right lower hot-press mold 3Rc is fixed to the frame of the right hot-pressing shaping device.

Above the suction filtration forming device 2 is a first wet blank transfer device 7, which contains a vertically movable first wet blank transfer mold 7*a* and a power transmission mechanism of first wet blank transfer mold 7*b* that drives the vertical movement of the first wet blank transfer mold 7*a*. The first wet blank transfer mold 7*a* extracts the wet blank from the suction filtration forming mold 2*a* and rises into position.

The second wet blank transfer device 5 contains a second wet blank transfer mold 5*a* and a multi-degree-of-freedom robotic arm or mechanical arm that can drive the second wet blank transfer mold 5*a* to flip vertically and move in three dimensions, such as a 6-axis robotic arm or mechanical arm. Driven by the multi-degree-of-freedom robotic arm or mechanical arm, the second wet blank transfer mold 5*a* can perform a 180-degree vertical flip and can directly transfer the wet blank received from the first wet blank transfer mold 7*a* to either the left hot-pressing shaping device 3L or the right hot-pressing shaping device 3R.

The first wet blank transfer mold 7*a* extracts the wet blank from the suction filtration forming mold 2*a* and transfers it to the second wet blank transfer mold 5*a*. After receiving the wet blank, the flipping mold 5*a* moves out from under the first wet blank transfer mold 7*a*. The second wet blank transfer mold 5*a* then flips 180 degrees vertically with the wet blank and moves in three dimensions, alternately transferring the wet blank to the left hot-pressing shaping device 3L and right hot-pressing shaping device 3R for hot-press drying and shaping. The 180-degree vertical flip and three-dimensional movement of the second wet blank transfer mold 5*a* with the wet blank can be performed simultaneously.

In summary, the complete implementation process of this embodiment is typically as follows:

(1) The second wet blank transfer mold 5*a* below the first wet blank transfer mold 7*a* moves up, the first wet blank transfer mold 7*a* and second wet blank transfer mold 5*a* close together, and the first wet blank transfer mold 7*a* transfers the wet blank to the second wet blank transfer mold 5*a*. The second wet blank transfer mold 5*a* moves down, the second wet blank transfer mold 5*a* and first wet blank transfer mold 7*a* separate, and the second wet blank transfer mold 5*a* receives the wet blank. At this point, the second wet blank transfer mold working surface 5M and the wet blank are facing upwards.

(2) After receiving the wet blank, the second wet blank transfer mold 5*a* moves out from under the first wet blank transfer mold 7*a*. Driven by the wet blank flipping driver 5*b*, it performs a 180-degree vertical flip and three-dimensional movement, transferring the wet blank to either the left hot-pressing shaping device 3L or right hot-pressing shaping device 3R for hot-press drying and shaping. After hot-press drying and shaping, the hot-press mold opens, and the pulp molded product is promptly removed from the pulp molding machine at the appropriate time.

Meanwhile, the first wet blank transfer mold 7*a* moves down to the suction filtration forming mold 2*a*, extracts the wet blank from the suction filtration forming mold 2*a* again, and rises back into position.

The 180-degree vertical flip and three-dimensional movement of the second wet blank transfer mold 5*a* can be performed simultaneously or separately.

(3) After transferring the wet blank, the second wet blank transfer mold 5*a* performs another 180-degree vertical flip and three-dimensional movement to return to a position below the first wet blank transfer mold 7*a*. At this point, the second wet blank transfer mold working surface 5M is facing upwards towards the first wet blank transfer mold 7*a*.

(4) The second wet blank transfer mold 5*a* moves up, the first wet blank transfer mold 7*a* and second wet blank transfer mold 5*a* close together, and the first wet blank transfer mold 7*a* transfers the wet blank to the second wet blank transfer mold 5*a*. The second wet blank transfer mold 5*a* moves down, the second wet blank transfer mold 5*a* and first wet blank transfer mold 7*a* separate, and the second wet blank transfer mold 5*a* receives another wet blank. At this point, the second wet blank transfer mold working surface 5M and the wet blank are facing upwards.

(5) After receiving the wet blank again, the second wet blank transfer mold 5*a* moves out from under the first wet blank transfer mold 7*a*, performs a 180-degree vertical flip and three-dimensional movement, and transfers the wet blank to either the left hot-pressing shaping device 3L or right hot-pressing shaping device 3R for hot-press drying and shaping. After hot-press drying and shaping, the hot-press mold opens, and the pulp molded product is promptly removed from the pulp molding machine at the appropriate time.

Meanwhile, the first wet blank transfer mold 7*a* moves down to the suction filtration forming mold 2*a*, extracts the wet blank from the suction filtration forming mold 2*a* again, and rises back into position.

The 180-degree vertical flip and three-dimensional movement of the second wet blank transfer mold 5*a* can be performed simultaneously or separately.

The production continues in a cyclic manner according to the above process. Pulp molded products are continuously produced and promptly removed from the pulp molding machine or moved to the next process. Throughout the entire production process of pulp molded products, the wet blank made by the suction filtration forming mold 2*a* is taken by the first wet blank transfer mold 7*a* and sent to the second wet blank transfer mold 5*a*. It is then flipped 180 degrees vertically by the second wet blank transfer mold 5*a* before being sent into the left lower hot-press mold or right lower hot-press mold. The left hot-pressing shaping device or right hot-pressing shaping device closes the mold and performs hot-press drying and shaping on the wet blank. This achieves the effect of matching the "mesh surface of the wet blank" with the "smooth surface of the hot-press mold". It also achieves the ideal processing effect of uniform product wall thickness and easy demolding.

The left hot-pressing shaping device and right hot-pressing shaping device can be positioned on either side of the suction filtration forming device 2, or on the same side.

A simplified version of this embodiment is the "Wet Blank Flipping Direct Transfer Single Hot-Press Pulp Molding Machine", where the hot-pressing shaping device 3 includes only one hot-pressing shaping device. The principle remains the same, with the only difference being the number of hot-pressing shaping devices.

In this embodiment, typically the first wet blank transfer mold 7*a* extracts the wet blank from the suction filtration forming mold 2*a*, but it's also possible for the first wet blank transfer mold 7*a* to remain stationary while the suction filtration forming mold 2*a* in the suction filtration forming device 2 moves up and down, delivering the wet blank to the stationary first wet blank transfer mold 7*a*. The second wet blank transfer mold 5*a* extracts the wet blank from the stationary first wet blank transfer mold 7*a*. After receiving the wet blank, the flipping mold 5*a* moves out from under the first wet blank transfer mold 7*a*. The second wet blank transfer mold 5*a* then performs a 180-degree vertical flip and three-dimensional movement with the wet blank, alternately transferring the wet blank to the left hot-pressing shaping device 3L and right hot-pressing shaping device 3R for hot-press drying and shaping. The 180-degree vertical flip and three-dimensional movement of the second wet blank transfer mold 5*a* with the wet blank can be performed simultaneously.

Embodiment 6

Figure 17:
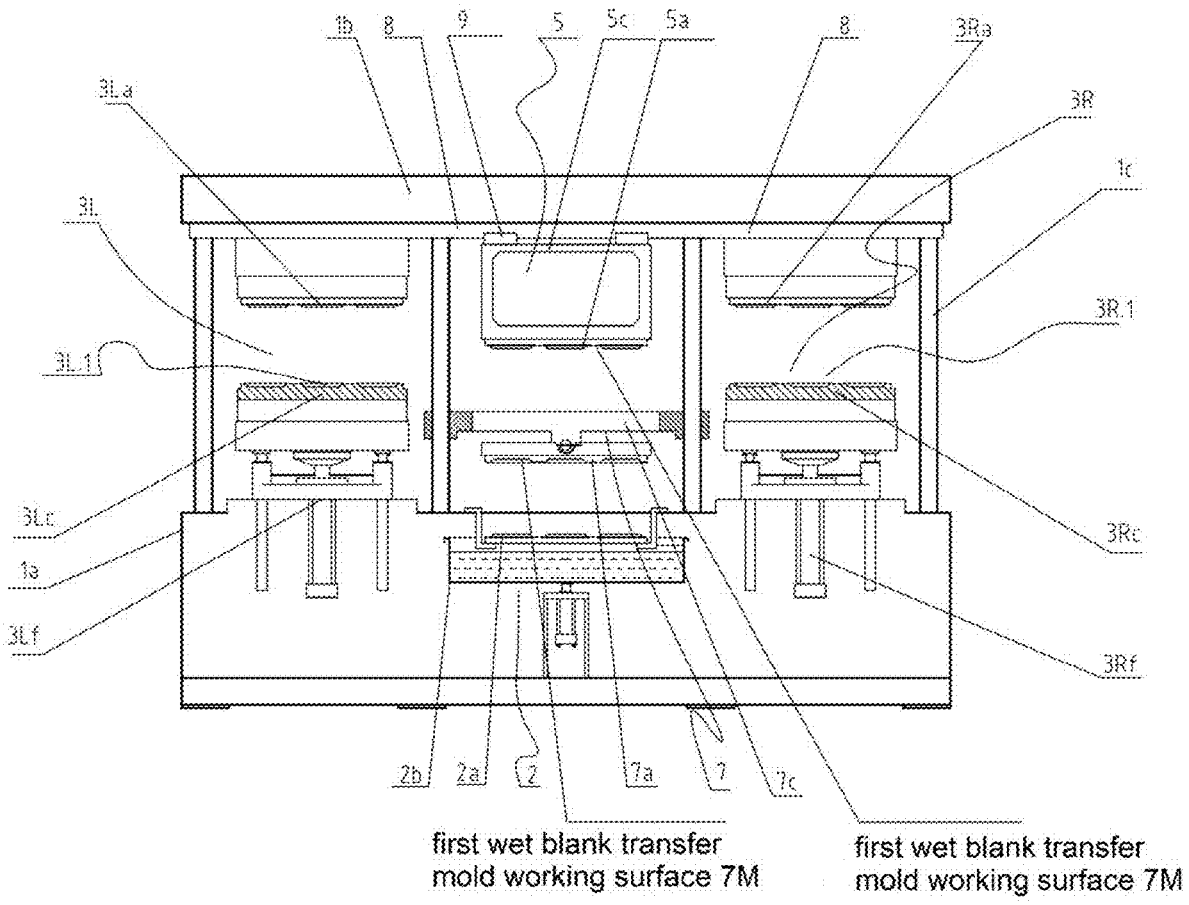
FIG. 17 is a front view structural diagram of Embodiment 6 of the "Wet Blank Flipping Pulp Molding Machine" (showing the state when the second wet blank transfer device 5 is above the first wet blank transfer mold 7*a*, with the working surface 7M of the first wet blank transfer mold facing down).

As shown in FIG. 17, in this embodiment, the wet blank flipping pulp molding machine includes a frame, a suction filtration forming device, a hot-pressing shaping device, a first wet blank transfer device, a second wet blank transfer device, a control system, and other components. The suction filtration forming device 2 is set in the middle of the lower frame 1*a*, with the first wet blank transfer device 7 positioned above it. On the left and right sides of the frame, there is one hot-pressing shaping device 3 each, namely the left hot-pressing shaping device 3L and the right hot-pressing shaping device 3R.

As shown in FIG. 17, the frame 1 consists of a lower frame 1*a* and an upper frame 1*b*, with tie rods 1*c* fixing the lower frame 1*a* and upper frame 1*b* together.

The suction filtration forming device 2 includes a suction filtration forming mold 2*a* and a suction filtration forming pulp tank 2*b*. A mixture of plant fibers and water of appropriate concentration (referred to as pulp slurry) is intermittently or continuously injected into the suction filtration forming pulp tank 2*b*. The suction filtration forming mold 2*a* forms the wet blank from the pulp slurry. Various methods can be used to achieve the production of the wet blank.

As shown in FIG. 17, the hot-pressing shaping device 3 includes a left hot-pressing shaping device 3L and a right hot-pressing shaping device 3R, and contains hot-pressing shaping molds. The left hot-pressing shaping device 3L contains a vertically movable left lower hot-press mold 3Lc, a left upper hot-press mold 3La fixed to the upper frame, and a left lower hot-press mold driving device 3Lf. The left lower hot-press mold 3Lc can move up and down driven by the left lower hot-press mold driving device 3Lf. The right hot-pressing shaping device 3R contains a vertically movable right lower hot-press mold 3Rc, a right upper hot-press mold 3Ra fixed to the upper frame, and a right lower hot-press mold driving device 3Rf. The right lower hot-press mold 3Rc can move up and down driven by the right lower hot-press mold driving device 3Rf.

The left lower hot-press mold 3Lc and right lower hot-press mold 3Rc are collectively referred to as the lower hot-press mold 3*c*, while the left upper hot-press mold 3La and right upper hot-press mold 3Ra are collectively referred to as the upper hot-press mold 3*a*. Furthermore, the left lower hot-press mold 3Lc only works in conjunction with the left upper hot-press mold 3La, and the right lower hot-press mold 3Rc only works in conjunction with the right upper hot-press mold 3Ra.

Figure 20:
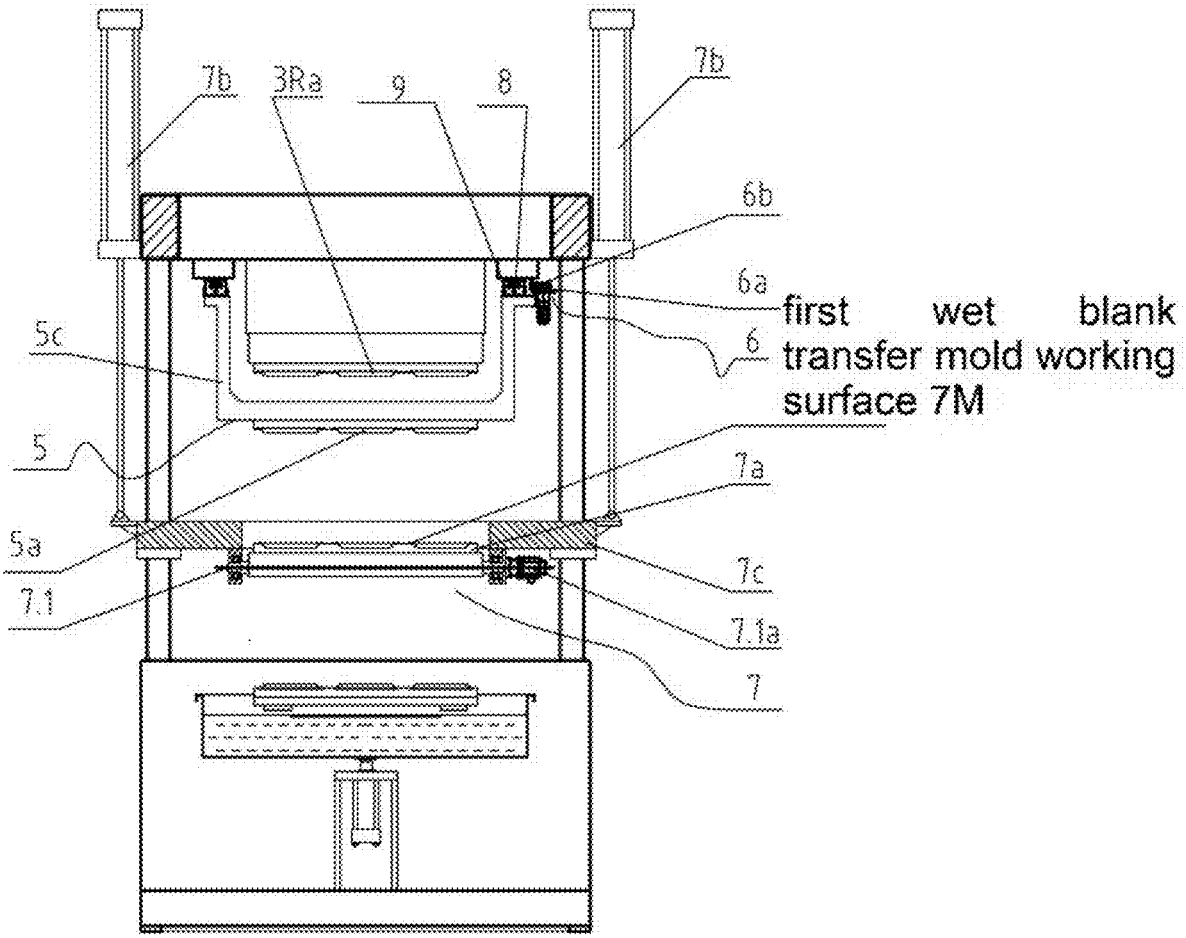
FIG. 20 is an E-E directional sectional view of FIG. 19, which shows the flipping drive method of the first wet blank transfer mold 7*a* and the horizontal movement drive method of the second wet blank transfer device 5.

As shown in FIGS. 17 and 20, the first wet blank transfer device 7 contains a first wet blank transfer mold 7*a*, a first wet blank moving frame 7*c*, a first wet blank transfer device driver 7*b*, and a first flipping shaft driver 7.1*a*. The first wet blank transfer mold 7*a* is rotatably positioned on the first wet blank moving frame 7*c*. The first flipping shaft driver 7.1*a* drives the first wet blank transfer mold 7*a* to flip 180 degrees vertically, while the first wet blank transfer device driver 7*b* drives the first wet blank transfer device 7 to move up and down. The mold face of the first wet blank transfer mold 7*a* used to adhere to the wet blank is called the "first wet blank transfer mold working surface" 7M.

The suction filtration forming mold 2*a* in the suction filtration forming device 2 forms the wet blank from the fibers in the pulp slurry. The first wet blank transfer device, which can both move vertically and flip 180 degrees vertically, extracts the wet blank from the suction filtration forming mold 2*a*, rises to a specific position, and then flips 180 degrees vertically with the wet blank. After completing the 180-degree vertical flip, the first wet blank transfer device transfers the flipped wet blank to the horizontally movable second wet blank transfer device.

As shown in FIGS. 17 and 20, the second wet blank transfer device 5 contains a second wet blank transfer mold 5*a*, a second wet blank transfer device moving frame 5*c*, and a horizontal driver of second wet blank transfer device 6. The mold face of the second wet blank transfer mold 5*a* used to adhere to the wet blank is called the "second wet blank transfer mold working surface" 5M. In this embodiment, the second wet blank transfer mold working surface 5M always faces downwards.

As shown in FIGS. 17 and 20, two (or two sets of) left-right translation rails 8 are fixed to the underside of the upper frame, extending from the left end to the right end. Left-right translation rail sliders 9 that can slide along the rails are set on the left-right translation rails 8. The second wet blank transfer device 5 is fixed to the left-right translation rail sliders 9, suspended from the underside of the upper frame through the left-right translation rail sliders 9, and can move horizontally left and right along the left-right translation rails 8 driven by the horizontal driver of second wet blank transfer device 6.

Figure 19:
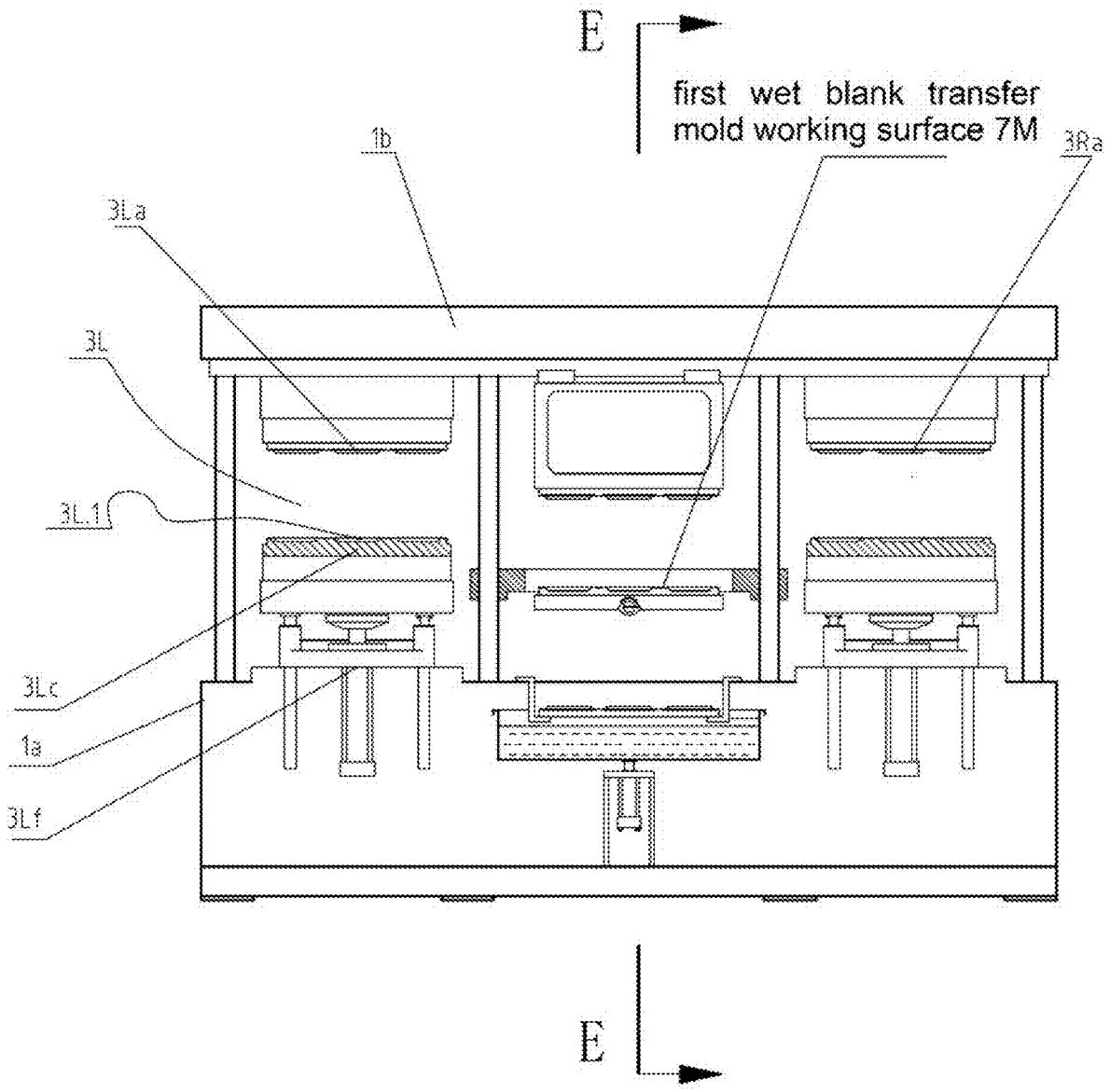
FIG. 19 is a front view structural diagram of Embodiment 6 of the "Wet Blank Flipping Pulp Molding Machine" (showing the state when the second wet blank transfer device 5 is above the first wet blank transfer mold 7*a*, with the working surface 7M of the first wet blank transfer mold facing up).

As shown in FIGS. 19 and 20, the horizontal movement of the second wet blank transfer device 5 is driven by the horizontal driver of second wet blank transfer device 6. As a preferred solution, the horizontal driver of second wet blank transfer device 6 uses a gear and rack drive method. The horizontal driver of second wet blank transfer device 6 contains a gear power head 6*a* fixed to the second wet blank transfer device 5, and a rack 6*b* fixed to the upper frame. The gear power head 6*a* contains a gear and a servo motor that drives the gear's rotation. The gear of the gear power head 6*a* meshes with the rack 6*b*, and the servo motor drives the gear's rotation, thus moving the second wet blank transfer device 5 horizontally left and right. Alternatively, the horizontal movement of the second wet blank transfer device 5 can be driven by a linear motor, with its moving part fixed to the second wet blank transfer device 5 and its stationary part fixed to the upper frame. Another alternative is to use a ball screw mechanism to drive the horizontal movement of the second wet blank transfer device 5.

The left-right translation rail 8 horizontally spans across the left hot-pressing shaping device 3L, above the first wet blank transfer device 7, and the right hot-pressing shaping device 3R. Driven by the horizontal driver of second wet blank transfer device 6, the second wet blank transfer device 5 can move along the left-right translation rail 8 between positions above the left lower hot-press mold 3Lc, above the first wet blank transfer device 7, and above the right lower hot-press mold 3Rc.

Before the first wet blank transfer mold 7*a* moves down to extract the wet blank from the suction filtration forming mold 2*a*, the first wet blank transfer mold working surface 7M should be facing downwards. If the first wet blank transfer mold working surface 7M is not facing downwards, then the first wet blank transfer mold 7*a* should flip to achieve this orientation.

Figure 18:
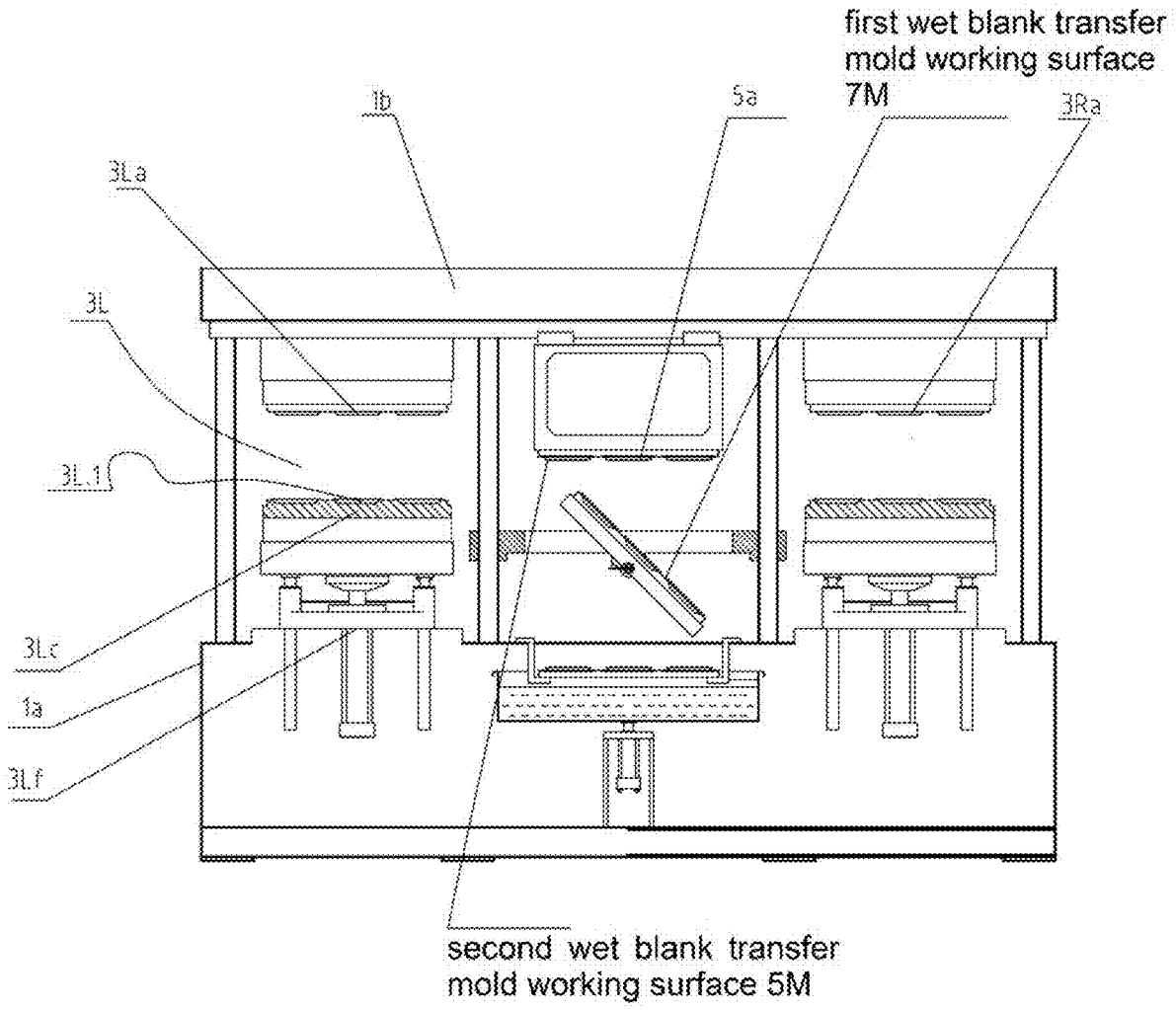
FIG. 18 is a front view structural diagram of Embodiment 6 of the "Wet Blank Flipping Pulp Molding Machine" (showing the state when the second wet blank transfer device 5 is above the first wet blank transfer mold 7*a*, and the first wet blank transfer mold 7*a* is flipping).

As shown in FIGS. 17, 18, and 19, after the wet blank is formed in the suction filtration forming device, the first wet blank transfer mold 7*a*, with its working surface 7M already facing downwards, moves down to extract the wet blank from the suction filtration forming mold 2*a* and rises to a specific position. Then, the first flipping shaft driver 7.1*a* drives the first wet blank transfer mold 7*a* to perform a 180-degree vertical flip with the wet blank, making the first wet blank transfer mold working surface 7M and the wet blank face upwards (with the mesh surface of the wet blank facing up).

The second wet blank transfer mold 5*a*, which can move horizontally left and right along the left-right translation rail 8, moves to a position above the first wet blank transfer mold 7*a*. The second wet blank transfer mold working surface 5M always faces downwards. The first wet blank transfer mold 7*a* moves up, closes with the second wet blank transfer mold 5*a*, transfers the wet blank to the second wet blank transfer mold 5*a*, and then moves back down. The second wet blank transfer mold 5*a* receives the wet blank. This process can also perform pre-shaping on the wet blank.

The second wet blank transfer mold, with the wet blank facing down, moves left to a position above the left lower hot-press mold in the left hot-pressing shaping device. Meanwhile, the first wet blank transfer mold 7*a*, which has had its wet blank transferred away, flips 180 degrees vertically, making the first wet blank transfer mold working surface 7M face downwards.

The first wet blank transfer mold 7*a*, with its working surface 7M facing downwards, moves down again to extract another wet blank from the suction filtration forming mold 2*a* and rises to a specific position. Then, the first flipping shaft driver 7.1*a* drives the first wet blank transfer mold 7*a* to perform a 180-degree vertical flip with the wet blank, making the first wet blank transfer mold working surface 7M and the wet blank face upwards (with the mesh surface of the wet blank facing up).

Meanwhile, the left lower hot-press mold 3Lc moves up to take the wet blank from the second wet blank transfer mold 5*a* and then moves down into position (this process can also perform pre-shaping on the wet blank). The second wet blank transfer mold 5*a* moves right along the left-right translation rail 8 back to a position above the first wet blank transfer mold 7*a*. The first wet blank transfer mold 7*a* moves up, transfers the wet blank to the second wet blank transfer mold 5*a*, and then moves back down to its original position. The second wet blank transfer mold 5*a* receives another wet blank. Simultaneously, the left hot-pressing shaping device closes to perform hot-press drying and shaping on the wet blank.

After the wet blank has been removed, the first wet blank transfer mold 7*a* flips 180 degrees vertically, with the first wet blank transfer mold working surface 7M facing downwards. The first wet blank transfer mold 7*a* moves down to extract the wet blank from the suction filtration forming mold 2*a* and rises to a specific position. Then, the first flipping shaft driver 7.1*a* drives the first wet blank transfer mold 7*a* to perform a 180-degree vertical flip with the wet blank, making the first wet blank transfer mold working surface 7M and the wet blank face upwards (with the mesh surface of the wet blank facing up).

The second wet blank transfer mold, with the wet blank, moves right to a position above the right lower hot-press mold in the hot-pressing shaping device. The right lower hot-press mold 3Rc moves up to take the wet blank from the second wet blank transfer mold 5*a* and then moves down into position. The second wet blank transfer mold 5*a* moves left along the left-right translation rail 8 back to a position above the first wet blank transfer mold 7*a*. The first wet blank transfer mold 7*a* moves up, transfers the wet blank to the second wet blank transfer mold 5*a*, and then moves back down. The second wet blank transfer mold 5*a* receives the wet blank. Simultaneously, the right hot-pressing shaping device closes to perform hot-press drying and shaping on the wet blank. The first wet blank transfer mold moves down and flips so that 7M faces downwards, continues to extract the wet blank from the suction filtration forming mold 2*a*, rises to a specific position, and flips the wet blank so that 7M faces upwards, waiting to transfer it to the second wet blank transfer mold 5*a*.

The smooth surface of the upper hot-press mold presses against the mesh surface of the wet blank, creating a dried and shaped pulp molded product. The product is then removed from the pulp molding machine, with both sides of the product achieving excellent processing effects.

As shown in FIGS. 19 and 20, the first wet blank transfer device 7 is equipped with a first wet blank transfer mold 7*a*. There are multiple ways for the first wet blank transfer mold 7*a* to perform a 180-degree flip. As a preferred solution, the 180-degree vertical flip of the first wet blank transfer mold 7*a* can be performed around an axis parallel to the horizontal plane, i.e., it can flip 180 degrees up and down around the first wet blank flipping shaft 7.1, achieving the purpose of flipping the first wet blank transfer mold working surface 7M from facing up to facing down or from facing down to facing up. As shown in FIGS. 17 and 20, the first flipping shaft driver 7.1*a* drives the first wet blank transfer mold 7*a* to perform the 180-degree flip. As can be seen from the figures: The first wet blank flipping shaft 7.1 is rotatably positioned on the first wet blank moving frame 7*c* through bearings. The base of the first flipping shaft driver 7.1*a* (such as a motor with a reducer) is fixed to one side of the first wet blank moving frame 7*c*. The drive shaft of the first flipping shaft driver 7.1*a* (such as the motor output shaft or reducer output shaft) is coaxially connected with the first wet blank flipping shaft 7.1. Obviously, when the wet blank flipping driver starts, it can drive the first wet blank flipping shaft 7.1 to rotate the first wet blank transfer mold 7*a* through a 180-degree flip.

The first wet blank transfer device 7 and the second wet blank transfer device 5 jointly achieve the function of transferring the wet blank from the suction filtration forming mold to the hot-pressing shaping mold. The coordinated actions between the first wet blank transfer device 7 and the second wet blank transfer device 5, and the left and right lower hot-press molds moving up to take the wet blank from the second wet blank transfer mold 5*a* and then moving down into position, can achieve two pre-shaping processes on the wet blank. The 180-degree flip of the wet blank achieves the purpose of having the "smooth surface of the hot-press mold" press against the dense, smooth, and high-quality "mesh surface of the wet blank", while allowing the "mesh surface of the hot-press mold", which has some flexibility and can easily press against the entire surface of the wet blank, to press against the "fuzzy surface of the wet blank". Both sides of the product achieve excellent processing effects, realizing dual-side optimization.

The complete implementation process of this embodiment is typically as follows:

(1) Above the suction filtration forming mold 2*a*, the first wet blank transfer mold 7*a*, whose 7M is not facing downwards, is flipped to its original position, making the first wet blank transfer mold working surface 7M face downwards. Then, the first wet blank transfer mold 7*a* moves down, extracts the wet blank from the suction filtration forming mold 2*a*, and rises to a specific position. After that, the first wet blank transfer mold 7*a* performs a 180-degree vertical flip with the wet blank, making the first wet blank transfer mold working surface 7M and the wet blank face upwards (with the mesh surface of the wet blank facing up);

(2) The second wet blank transfer mold 5*a*, which has had its wet blank transferred away, moves along the left-right translation rail 8 to a position above the first wet blank transfer mold 7*a*; the first wet blank transfer mold 7*a* moves up to transfer the wet blank to the second wet blank transfer mold 5*a*, then moves down to continue the actions in step (1), while the second wet blank transfer mold 5*a*, now with the wet blank, moves left along the left-right translation rail 8 to a position above the vertically movable left lower hot-press mold 3Lc; the left lower hot-press mold 3Lc moves up to take the wet blank from the second wet blank transfer mold 5*a* and then moves down into position;

(3) The second wet blank transfer mold 5*a*, which has had its wet blank transferred away, moves along the left-right translation rail 8 to a position above the first wet blank transfer mold 7*a;*

The first wet blank transfer mold 7*a* moves up again to transfer the wet blank to the second wet blank transfer mold 5*a*, then moves down to continue the actions in step (1), Meanwhile, the left lower hot-press mold 3Lc moves up to close with the left upper hot-press mold 3La to perform hot-press drying and shaping on the wet blank. After hot-press drying and shaping, the left hot-press mold opens, and the pulp molded product is promptly removed from the pulp molding machine at the appropriate time;

(4) The second wet blank transfer mold 5*a*, now with the wet blank, moves right to a position above the vertically movable right lower hot-press mold 3Rc; the right lower hot-press mold 3Rc moves up to take the wet blank from the second wet blank transfer mold 5*a* and then moves down into position;

(5) The second wet blank transfer mold 5*a*, which has had its wet blank transferred away, returns to a position above the first wet blank transfer mold 7*a;*

The first wet blank transfer mold 7*a* moves up again to transfer the wet blank to the second wet blank transfer mold 5*a*, then moves down to continue the actions in step (1), Meanwhile, the right lower hot-press mold 3Rc moves up to close with the right upper hot-press mold 3Ra to perform hot-press drying and shaping on the wet blank. After hot-press drying and shaping, the right hot-press mold opens, and the pulp molded product is promptly removed from the pulp molding machine at the appropriate time.

The wet blank flipping pulp molding machine operates in a cyclic manner according to the above steps (2)-(5), continuously producing pulp molded products, which are promptly removed from the pulp molding machine.

The above action sequence can be adjusted and varied. However, all sequences will include the following actions: The first wet blank transfer mold (7*a*) of the first wet blank transfer device first extracts the wet blank from the suction filtration forming mold 2*a*, then performs a 180-degree vertical flip, and then transfers the flipped wet blank to the second wet blank transfer mold (5*a*); The second wet blank transfer device (5) moves horizontally along the left-right translation rail (8) from above the first wet blank transfer device to above the hot-press lower mold (left or right lower hot-press mold), the vertically movable hot-press lower mold (left or right lower hot-press mold) moves up to extract the wet blank from the second wet blank transfer mold (5*a*), thus achieving the transfer of the flipped wet blank to the hot-pressing shaping device.

Throughout the entire production process of pulp molded products, the wet blank made by the suction filtration forming mold 2*a* is taken and flipped by the first wet blank transfer mold 7*a* (with the first wet blank transfer mold working surface 7M and the adhered wet blank facing up, and the mesh surface of the wet blank facing up), then transferred to the second wet blank transfer mold 5*a*, which then sends it into the left or right hot-pressing shaping device for hot-press drying and shaping.

This achieves two pre-shaping processes on the wet blank; it also achieves the matching of the "mesh surface of the wet blank" with the "smooth surface of the hot-press mold"; and it realizes the ideal processing effect of uniform product wall thickness and easy demolding. The machine's operational stability, product quality, and pass rate are greatly improved, while production costs are substantially reduced.

Embodiment 7

This embodiment is a simplified version of Embodiment 1. The wet blank flipping pulp molding machine in this embodiment contains only one hot-pressing shaping device. In this implementation, the wet blank flipping pulp molding machine includes a frame 1, a suction filtration forming device 2, a hot-pressing shaping device 3, a second wet blank transfer device 5, a first wet blank transfer device 7, a control system, and other components.

Because there is only one hot-pressing shaping device, there is no distinction between left and right hot-pressing shaping devices. The implementation principle is the same as in Embodiment 1.

Embodiment 8

Figure 21:
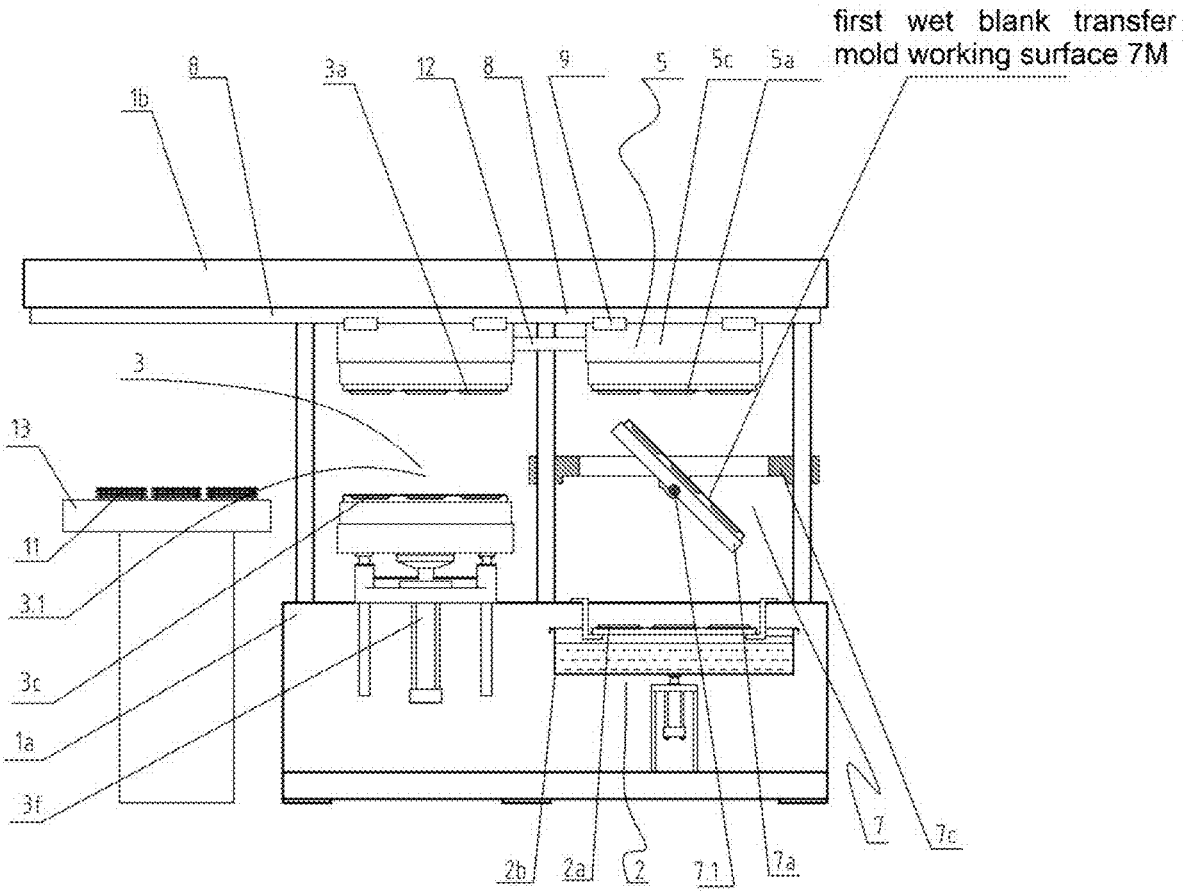
FIG. 21 is a front view structural diagram of Embodiment 8 of the "Wet Blank Flipping Pulp Molding Machine".
Figure 22:
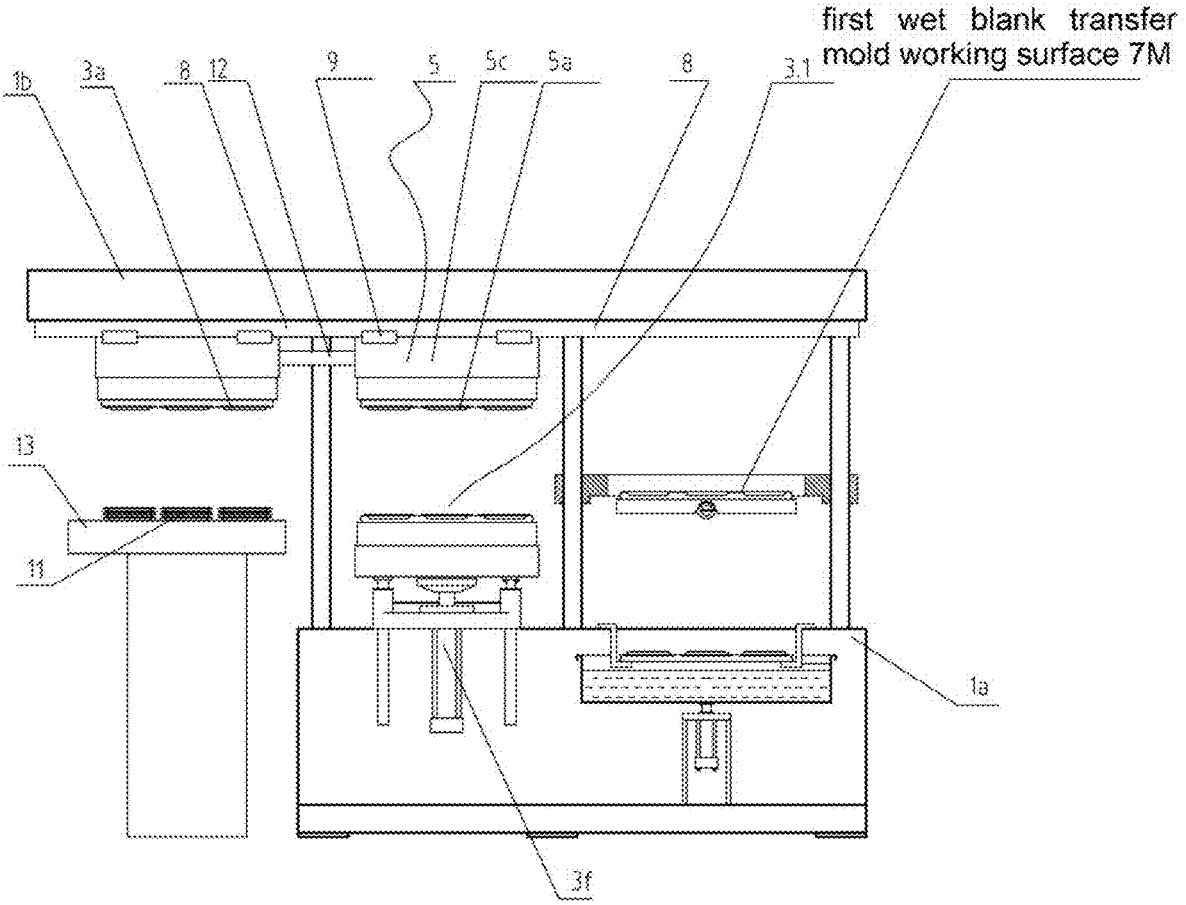
FIG. 22 is a front view structural diagram of Embodiment 8 of the "Wet Blank Flipping Pulp Molding Machine" (the second wet blank transfer device 5 has moved above the lower hot-press mold, and the upper hot-press mold has moved above the material receiving platform 13).

As shown in FIGS. 21 and 22, the wet blank flipping pulp molding machine includes a frame, a suction filtration forming device, a hot-pressing shaping device, a first wet blank transfer device, a second wet blank transfer device, a control system, and other components.

As shown in FIGS. 21 and 22, a material receiving platform 13 for dried and shaped products 11 is set up on the left side of the wet blank flipping pulp molding machine.

Two (or two sets of) left-right translation rails 8 are fixed to the underside of the upper frame, extending from the left end to the right end. The left-right translation rails 8 span across the top of the first wet blank transfer device 7, above the lower hot-press mold, and above the material receiving platform 13.

The suction filtration forming device and the first wet blank transfer device are the same as in Embodiments 1 and 2.

The hot-pressing shaping device and the second wet blank transfer device 5 in this embodiment are different from those in Embodiments 1 and 2. The lower hot-press mold can move up and down driven by the lower hot-press mold driving device 3*f*; the upper hot-press mold can move horizontally. The upper hot-press mold and the second wet blank transfer device 5 are movably positioned on the left-right translation rails 8 through left-right translation rail sliders 9, suspended from the underside of the upper frame. A connector 12 connects the upper hot-press mold with the second wet blank transfer device. Driven by the horizontal driver of second wet blank transfer device 6, the upper hot-press mold and the second wet blank transfer device can move left and right synchronously along the left-right translation rails 8. The second wet blank transfer mold 5*a* can move back and forth along the left-right translation rails 8 between positions above the first wet blank transfer device 7 and above the lower hot-press mold; the upper hot-press mold can move back and forth along the left-right translation rails 8 between positions above the lower hot-press mold and above the material receiving platform 13.

The frame 1 consists of a lower frame 1*a*, an upper frame 1*b*, and tie rods 1*c*.

The suction filtration forming device 2 contains a suction filtration forming mold 2*a* and a suction filtration forming pulp tank 2*b*.

The first wet blank transfer device 7 contains a first wet blank transfer mold 7*a*, a first wet blank moving frame 7*c*, a first wet blank transfer device driver 7*b*, and a first flipping shaft driver 7.1*a*. The first wet blank transfer mold 7*a* is rotatably positioned on the first wet blank moving frame 7*c*. The first flipping shaft driver 7.1*a* drives the first wet blank transfer mold 7*a* to perform a 180-degree vertical flip, while the first wet blank transfer device driver 7*b* drives the first wet blank transfer device 7 to move up and down. The mold face of the first wet blank transfer mold 7*a* used to adhere to the wet blank is called the "first wet blank transfer mold working surface" 7M.

The horizontal driver of second wet blank transfer device 6 that drives the second wet blank transfer device 5 and the upper hot-press mold to move horizontally together contains a gear power head 6*a* fixed to the second wet blank transfer device 5 or the upper hot-press mold, and a rack 6*b* fixed to the upper frame. The gear power head 6*a* contains a gear and a servo motor that drives the gear's rotation. The gear of the gear power head 6*a* meshes with the rack 6*b*, and the servo motor drives the gear's rotation, thus moving the second wet blank transfer device 5 and the upper hot-press mold horizontally left and right together. Alternatively, a linear motor can be used to drive the horizontal movement of the second wet blank transfer device 5 and the upper hot-press mold together, with the moving part of the linear motor fixed to the upper hot-press mold or the second wet blank transfer device 5, and the stationary part fixed to the upper frame. Another alternative is to use a ball screw mechanism to drive the horizontal movement of the second wet blank transfer device 5 and the upper hot-press mold together; or a horizontal cylinder can be used to drive the horizontal movement of the second wet blank transfer device 5 and the upper hot-press mold together.

The complete implementation process of this embodiment is typically as follows:

(1) Above the suction filtration forming mold 2*a*, the first wet blank transfer mold 7*a*, whose 7M is not facing downwards, is flipped up and down to its original position, making the first wet blank transfer mold working surface 7M face downwards. Then, the first wet blank transfer mold 7*a* moves down, extracts the wet blank from the suction filtration forming mold 2*a*, and rises to a specific position. After that, the first wet blank transfer mold 7*a* performs a 180-degree vertical flip with the wet blank, making the first wet blank transfer mold working surface 7M and the wet blank face upwards (with the mesh surface of the wet blank facing up);

(2) The upper hot-press mold and the second wet blank transfer mold 5*a* move synchronously along the left-right translation rail 8, with the upper hot-press mold moving to a position above the lower hot-press mold, and the second wet blank transfer mold 5*a* moving to a position above the first wet blank transfer mold 7*a*; The lower hot-press mold, already carrying the wet blank, moves up to close with the upper hot-press mold to perform hot-press drying and shaping on the wet blank, while the first wet blank transfer mold 7*a* moves up to transfer the wet blank to the second wet blank transfer mold 5*a*, then moves down to continue the actions in step (1);

(3) After completing the hot-press drying and shaping, the lower hot-press mold moves down to open the mold, and the dried and shaped product is adhered to the upper hot-press mold;

The upper hot-press mold and the second wet blank transfer mold 5*a* that has already received the wet blank move synchronously along the left-right translation rail 8, with the upper hot-press mold moving to a position above the material receiving platform 13 and the second wet blank transfer mold 5*a* moving to a position above the lower hot-press mold 3*c*; The hot-press dried and shaped product in the upper hot-press mold is placed on the material receiving platform, while the lower hot-press mold 3*c* moves up to take the wet blank from the second wet blank transfer mold 5*a* and then moves down into position;

(4) The upper hot-press mold and the second wet blank transfer mold 5*a* move together synchronously along the left-right translation rail 8, with the upper hot-press mold moving to a position above the lower hot-press mold, and the second wet blank transfer mold 5*a* moving to a position above the first wet blank transfer mold 7*a*; The lower hot-press mold, already carrying the wet blank, moves up to close with the upper hot-press mold to perform hot-press drying and shaping on the wet blank, while the first wet blank transfer mold 7*a* moves up to transfer the wet blank to the second wet blank transfer mold 5*a*, then moves down to continue the actions in step (1).

The wet blank flipping pulp molding machine operates in a cyclic manner according to the above steps (3)-(4), continuously producing pulp molded products, which are promptly removed from the pulp molding machine.

The above action sequence can be adjusted and varied. However, all sequences will include the following actions: The first wet blank transfer mold (7*a*) of the first wet blank transfer device first extracts the wet blank from the suction filtration forming mold 2*a*, then performs a 180-degree vertical flip, and then transfers the flipped wet blank to the second wet blank transfer mold (5*a*) of the second wet blank transfer device; The second wet blank transfer device (5) moves horizontally along the left-right translation rail (8) from above the first wet blank transfer device to above the lower hot-press mold, the vertically movable lower hot-press mold (3*c*) moves up to extract the wet blank from the second wet blank transfer mold (5*a*), thus achieving the transfer of the flipped wet blank to the hot-pressing shaping device.

Throughout the entire production process of pulp molded products, the wet blank made by the suction filtration forming mold 2*a* is taken and flipped by the first wet blank transfer mold 7*a* (with the first wet blank transfer mold working surface 7M and the adhered wet blank facing up, and the mesh surface of the wet blank facing up), then transferred to the second wet blank transfer mold 5*a*, which then sends it into the hot-pressing shaping device for hot-press drying and shaping.

This achieves two pre-shaping processes on the wet blank; it also achieves the matching of the "mesh surface of the wet blank" with the "smooth surface of the hot-press mold"; and it realizes the ideal processing effect of uniform product wall thickness and easy demolding. The machine's operational stability, product quality, and pass rate are greatly improved, while production costs are substantially reduced.

The invention claimed is:

1. A wet blank flipping method for manufacturing pulp molded products, comprising following steps:

after the wet blank is formed in a suction filtration forming mold, it is transferred to a hot-pressing shaping device for hot-press drying and shaping to create pulp molded products, characterized in that: said transfer is done using a first wet blank transfer device (7) and a second wet blank transfer device (5) to move the wet blank from the suction filtration forming mold (2*a*) to the hot-pressing shaping device having a lower hot-press mold and an upper hot-press mold; wherein, the first wet blank transfer device extracts the wet blank from the suction filtration forming mold (2*a*) and transfers it to the second wet blank transfer device, which then moves the wet blank to the hot-pressing shaping device, an orientation of the wet blank is flipped 180 degrees when it is transferred to the hot-pressing shaping device from its original orientation when being extracted from the suction filtration forming mold (2*a*) such that a smooth surface of the lower hot-press mold and the upper hot-press mold faces a mesh surface of the wet blank while a mesh surface of the lower hot-press mold and the upper hot-press mold faces a fuzzy surface of the wet blank;

there can be one or multiple hot-pressing shaping devices, where multiple devices include a left hot-pressing shaping device (3L) and a right hot-pressing shaping device (3R).

2. The wet blank flipping method for manufacturing pulp molded products according to claim 1, characterized in that: the first wet blank transfer mold (7*a*) of the first wet blank transfer device (7) transfers the wet blank extracted from the suction filtration forming mold (2*a*) to the second wet blank transfer mold (5*a*) of the second wet blank transfer device, the second wet blank transfer mold (5*a*) then flips the wet blank 180 degrees vertically before transferring it to the hot-pressing shaping device; or, the first wet blank transfer mold (7*a*) extracts the wet blank from the suction filtration forming mold (2*a*), flips it 180 degrees vertically first, then transfers the flipped wet blank to the second wet blank transfer mold (5*a*), which then transfers the received wet blank to the hot-pressing shaping device.

3. The wet blank flipping method for manufacturing pulp molded products according to claim 2, characterized in that: the second wet blank transfer mold (5*a*) can move horizontally along the left-right translation rail (8) to transfer the wet blank above the lower hot-press mold, the vertically movable lower hot-press mold then extracts the wet blank from the second wet blank transfer mold;

there can be one or multiple lower hot-press molds, where multiple molds include a left lower hot-press mold (3Lc) and a right lower hot-press mold (3Rc).

4. The wet blank flipping method for manufacturing pulp molded products according to claim 2, characterized in that: the transfer of the wet blank from the first wet blank transfer mold (7*a*) to the second wet blank transfer mold (5*a*), and the transfer of the flipped wet blank from the second wet blank transfer mold (5*a*) to the lower hot-press mold (3*c*), are both completed directly below the first wet blank transfer mold (7*a*);

the lower hot-press mold of the hot-pressing shaping device can move along the left-right translation rail (8) to a position directly below the first wet blank transfer mold (7*a*) to receive the flipped wet blank from the second wet blank transfer mold (5*a*); the second wet blank transfer mold (5*a*) moves below the first wet blank transfer mold (7*a*) to receive the wet blank transferred from the first wet blank transfer mold (7*a*), then either moves out from under the first wet blank transfer mold (7*a*) with the wet blank or directly flips 180 degrees vertically while under the first wet blank transfer mold (7*a*); it then transfers the flipped wet blank into the lower hot-press mold, which has moved along the left-right translation rail (8) to a position directly below the first wet blank transfer mold (7*a*); the lower hot-press mold, now containing the flipped wet blank, moves back along the left-right translation rail (8) to a position directly below the upper hot-press mold, thus achieving the flipping of the wet blank and its transfer to the hot-pressing shaping device;

there can be one or multiple lower hot-press molds, where multiple molds include a left lower hot-press mold (3Lc) and a right lower hot-press mold (3Rc); there can also be one or multiple upper hot-press molds, where multiple molds include a left upper hot-press mold (3La) and a right upper hot-press mold (3Ra).

5. The wet blank flipping method for manufacturing pulp molded products according to claim 2, characterized in that: in the hot-pressing shaping device, the lower hot-press mold is fixed while the upper hot-press mold can move vertically; the first wet blank transfer mold (7*a*) of the first wet blank transfer device (7) can move vertically to extract the wet blank from the suction filtration forming mold (2*a*); alternatively, the first wet blank transfer mold (7*a*) can be fixed while the suction filtration forming mold (2*a*) moves vertically, transferring the wet blank to the first wet blank transfer mold (7*a*) as it moves upward; the second wet blank transfer mold 5*a*, driven by a multi-degree-of-freedom robotic arm or mechanical arm, can flip vertically, move in three dimensions, or rotate to directly transfer the wet blank received from the first wet blank transfer mold 7*a* to the lower hot-press mold, which always remains below the upper hot-press mold, after flipping it vertically;

there can be one or multiple lower hot-press molds, where multiple molds include a left lower hot-press mold (3Lc) and a right lower hot-press mold (3Rc); there can also be one or multiple upper hot-press molds, where multiple molds include a left upper hot-press mold (3La) and a right upper hot-press mold (3Ra).

6. The wet blank flipping method for manufacturing pulp molded products according to claim 3, characterized in that: the 180-degree vertical flip of the first wet blank transfer mold (7*a*) or second wet blank transfer mold (5*a*) is performed around an axis.

7. A wet blank flipping pulp molding machine, including a frame, a suction filtration forming device (2), at least one hot-pressing shaping device (3), characterized in that: it also includes a first wet blank transfer device (7) and a second wet blank transfer device (5); the first wet blank transfer device (7) contains a first wet blank transfer mold (7*a*) that extracts the wet blank from the suction filtration forming mold (2*a*), the second wet blank transfer device contains a second wet blank transfer mold (5*a*) that receives the wet blank from the first wet blank transfer mold and transfers it to the hot-pressing shaping device having a lower hot-press mold and an upper hot-press mold, an orientation of the wet blank is flipped 180 degrees when it is transferred to the hot-pressing shaping device from its original orientation when being extracted from the suction filtration forming mold (2*a*) such that a smooth surface of the lower hot-press mold and the upper hot-press mold faces a mesh surface of the wet blank while a mesh surface of the lower hot-press mold and the upper hot-press mold faces a fuzzy surface of the wet blank.

8. The wet blank flipping pulp molding machine according to claim 7, characterized in that: the first wet blank transfer device contains a first wet blank transfer mold (7*a*) that can move vertically and extract the wet blank from the suction filtration forming mold (2*a*); the second wet blank transfer device (5) contains a second wet blank transfer mold (5*a*) that can perform a 180-degree vertical flip and move horizontally along the left-right translation rail (8) to receive the wet blank transferred from the first wet blank transfer mold, then flip the wet blank 180 degrees vertically before transferring it above the lower hot-press mold; the vertically movable lower hot-press mold extracts the flipped wet blank from the second wet blank transfer mold.

9. The wet blank flipping pulp molding machine according to claim 7, characterized in that: the first wet blank transfer device contains a first wet blank transfer mold (7*a*) that can both move vertically and flip 180 degrees vertically to extract the wet blank from the suction filtration forming mold (2*a*), flip it 180 degrees vertically, and then transfer it to the second wet blank transfer mold (5*a*); the second wet blank transfer device (5) contains a second wet blank transfer mold (5*a*) that can move horizontally along the left-right translation rail (8) fixed to the underside of the upper frame, to receive the flipped wet blank from the first wet blank transfer mold (7*a*) and transfer it above the lower hot-press mold; the vertically movable lower hot-press mold receives the flipped wet blank from the first wet blank transfer mold (7*a*).

10. The wet blank flipping pulp molding machine according to claim 7, characterized in that: the second wet blank transfer device (5) contains a second wet blank transfer mold (5*a*) that can receive the wet blank from below the first wet blank transfer mold (7*a*), flip it 180 degrees vertically, and transfer the flipped wet blank to the lower hot-press mold (3*c*) while still directly below the first wet blank transfer mold (7*a*); this achieves the goal of receiving the wet blank from the first wet blank transfer mold, flipping it, and transferring it to the hot-pressing shaping device; the 180-degree vertical flip of the wet blank can be performed either directly below the first wet blank transfer mold (7*a*) or after moving out from under it;

the hot-pressing shaping device contains a lower hot-press mold that can move along the left-right translation rail (8) between positions directly below the upper hot-press mold and directly below the first wet blank transfer mold (7*a*); it receives the 180-degree flipped wet blank transferred from the second wet blank transfer mold (5*a*), then returns along the left-right translation rail (8) to a position directly below the upper hot-press mold to perform hot-press clamping with the upper hot-press mold, drying and shaping the wet blank;

there can be one or multiple lower hot-press molds, where multiple molds include a left lower hot-press mold (3Lc) and a right lower hot-press mold (3Rc); there can also be one or multiple upper hot-press molds, where multiple molds include a left upper hot-press mold (3La) and a right upper hot-press mold (3Ra).

11. The wet blank flipping pulp molding machine according to claim 7, characterized in that: In the hot-pressing shaping device, the lower hot-press mold is fixed while the upper hot-press mold can move vertically; the first wet blank transfer device (7) contains a first wet blank transfer mold (7*a*) that can move vertically to extract the wet blank from the suction filtration forming mold (2*a*); alternatively, the first wet blank transfer device (7) contains a fixed first wet blank transfer mold (7*a*), while the suction filtration forming device (2) contains a vertically movable suction filtration forming mold (2*a*) that moves upward to transfer the wet blank to the first wet blank transfer mold (7*a*); the second wet blank transfer device (5) contains a second wet blank transfer mold (5*a*) driven by a multi-degree-of-freedom robotic arm or mechanical arm; the second wet blank transfer mold (5*a*) can flip vertically, move in three dimensions, or rotate; driven by the multi-degree-of-freedom robotic arm or mechanical arm, the second wet blank transfer mold (5*a*) extracts the wet blank from the first wet blank transfer mold (7*a*), flips it, and directly transfers it to the lower hot-press mold.

12. The wet blank flipping pulp molding machine according to claim 8, characterized in that: The horizontal movement of the second wet blank transfer device along the left-right translation rail (8) is driven by the horizontal driver of second wet blank transfer device (6);

The horizontal driver of second wet blank transfer device uses a gear and rack drive structure, consisting of a rack (6*b*) fixed to the frame and a gear power head (6*a*) fixed to the second wet blank transfer device; the gear power head contains a gear and a servo motor that drives the gear's rotation; the gear of the gear power head meshes with the rack, and the servo motor drives the gear's rotation, thus moving the second wet blank transfer device horizontally left and right; alternatively, the horizontal movement of the second wet blank transfer device can be driven by a linear motor, with its moving part fixed to the second wet blank transfer device and its stationary part fixed to the frame; another alternative is to use a ball screw mechanism to drive the horizontal movement of the second wet blank transfer device.

13. The wet blank flipping pulp molding machine according to claim 10, characterized in that: the second wet blank transfer mold (5*a*) can flip 180 degrees vertically around the second wet blank flipping shaft (5.1), move horizontally along the longitudinal rail (4), and move up and down along a vertical rail (4.1); this allows it to go under the first wet blank transfer mold to receive the wet blank, then flip it 180 degrees vertically before transferring it to the lower hot-press mold, which has moved horizontally along the left-right translation rail (8) to a position below the first wet blank transfer mold (7*a*); alternatively, the second wet blank transfer mold (5*a*) can be driven by a multi-degree-of-freedom robotic arm or mechanical arm to move and flip 180 degrees vertically, allowing it to receive the wet blank from below the first wet blank transfer mold, flip it 180 degrees vertically, and then transfer it to the lower hot-press mold that has moved along the left-right translation rail (8) to a position below the first wet blank transfer mold (7*a*).

14. The wet blank flipping pulp molding machine according to claim 7, characterized in that: the suction filtration forming mold is a convex mold for pulp suction, and the lower hot-press mold is a concave mold.

15. The wet blank flipping method for manufacturing pulp molded products according to claim 1, characterized in that: the suction filtration forming mold is a convex mold for pulp suction, and the lower hot-press mold is a concave mold.

16. The wet blank flipping method for manufacturing pulp molded products according to claim 1, characterized in that: a first pre-shaping on the wet blank is performed during the first wet blank transfer device transfers the wet blank to the second wet blank transfer device, and a second pre-shaping on the wet blank is performed during the second wet blank transfer device moves the wet blank to the hot-pressing shaping device.

* * * * *